US008069786B2

(12) United States Patent
Christel et al.

(10) Patent No.: US 8,069,786 B2
(45) Date of Patent: Dec. 6, 2011

(54) PRINTING GROUPS COMPRISING AT LEAST TWO COOPERATING CYLINDERS AND RADIALLY MOVABLE BEARING UNITS

(75) Inventors: Ralf Georg Christel, Veitshöchheim (DE); Bernd Klaus Faist, Ochsenfurt (DE); Michael Heinz Fischer, Würzburg (DE); Oliver Frank Hahn, Veitshöchheim (DE); Wolfgang Otto Reder, Veitshöchheim (DE); Karl Erich Albert Schaschek, Thüngen (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 871 days.

(21) Appl. No.: 11/918,949

(22) PCT Filed: Apr. 20, 2006

(86) PCT No.: PCT/EP2006/061695

§ 371 (c)(1),
(2), (4) Date: Apr. 9, 2008

(87) PCT Pub. No.: WO2006/111556

PCT Pub. Date: Oct. 26, 2006

(65) Prior Publication Data

US 2009/0020028 A1 Jan. 22, 2009

(30) Foreign Application Priority Data

Apr. 21, 2005 (DE) ..... 10 2005 018 473
Sep. 27, 2005 (DE) ..... 10 2005 045 984

(51) Int. Cl.
*B41F 13/24* (2006.01)

(52) U.S. Cl. ..... 101/248; 101/218

(58) Field of Classification Search ..... 101/248
See application file for complete search history.

(56) References Cited

U.S. PATENT DOCUMENTS

| | | | | |
|---|---|---|---|---|
| 2,557,381 | A | | 6/1951 | Huebner |
| 2,964,108 | A | * | 12/1960 | Snyder et al. ..... 400/177 |
| 3,892,178 | A | | 7/1975 | Staamann |
| 4,598,640 | A | * | 7/1986 | Nawrath ..... 101/177 |
| 4,690,052 | A | | 9/1987 | Paulsen |
| 4,796,452 | A | | 1/1989 | Schiel |
| 4,905,598 | A | | 3/1990 | Thomas et al. |

(Continued)

FOREIGN PATENT DOCUMENTS

CH 470 967 5/1969

(Continued)

*Primary Examiner* — Anthony Nguyen
(74) *Attorney, Agent, or Firm* — Mattingly & Malur, P.C.

(57) ABSTRACT

Printing groups are each comprised of at least two cooperating cylinders, each of which is mounted in a bearing unit that radially displaces its associated cylinder. At least one of these bearing units is provided with an actuator which is controlled, or regulated by a control unit. An inking unit, which encompasses at least one ink application roller, is provided for each printing group. At least one of the cylinders of the printing group, and an ink application roller of the associated inking unit can optionally be placed against each other. A dampening unit, comprising at least one dampening fluid application roller, is also provided. At least one of the cylinders of the printing group and a dampening fluid application roller of the dampening unit are also optionally placed against each other. The at least one actuator for the bearing unit is remotely controlled and is embodied either as a hydraulic actuator or as a pneumatic actuator.

49 Claims, 48 Drawing Sheets

U.S. PATENT DOCUMENTS

| | | | | |
|---|---|---|---|---|
| 5,040,459 | A * | 8/1991 | Rambausek | 101/217 |
| 5,142,977 | A | 9/1992 | Gertsch et al. | |
| 5,782,182 | A | 7/1998 | Ruckmann et al. | |
| 5,819,656 | A | 10/1998 | Gertsch et al. | |
| 6,098,542 | A | 8/2000 | Dufour | |
| 6,167,806 | B1 | 1/2001 | Chretinat et al. | |
| 6,330,859 | B1 * | 12/2001 | Jakobsen et al. | 101/484 |
| 6,408,748 | B1 | 6/2002 | Hajek et al. | |
| 6,684,775 | B2 | 2/2004 | Dufour et al. | |
| 6,761,112 | B2 | 7/2004 | Faist et al. | |
| 6,903,831 | B1 | 6/2005 | Rapke-Kraft et al. | |
| 7,011,023 | B2 | 3/2006 | Dittenhofer et al. | |
| 7,017,483 | B2 | 3/2006 | Bolza-Schunemann | |
| 7,021,209 | B2 | 4/2006 | Faist et al. | |
| 7,040,225 | B2 | 5/2006 | Bolza-Schunemann | |
| 7,117,792 | B2 | 10/2006 | Faist et al. | |
| 7,124,683 | B2 | 10/2006 | Faist et al. | |
| 7,156,019 | B2 | 1/2007 | Herbert et al. | |
| 7,258,065 | B2 | 8/2007 | Faist et al. | |
| 2003/0056641 | A1 * | 3/2003 | Liao et al. | 91/361 |
| 2004/0107849 | A1 | 6/2004 | Christel et al. | |
| 2004/0144268 | A1 | 7/2004 | Christel et al. | |
| 2004/0261608 | A1 * | 12/2004 | Bugel et al. | 91/465 |
| 2005/0034615 | A1 | 2/2005 | Holm et al. | |
| 2006/0042485 | A1 | 3/2006 | Schneider et al. | |
| 2006/0278106 | A1 | 12/2006 | Christel et al. | |
| 2007/0181021 | A1 | 8/2007 | Christel et al. | |
| 2008/0163771 | A1 | 7/2008 | Faist | |

FOREIGN PATENT DOCUMENTS

| | | | |
|---|---|---|---|
| CH | 480 180 | | 12/1969 |
| DE | 1 561 014 | | 2/1970 |
| DE | 1 807 751 | | 3/1970 |
| DE | 22 34 089 | | 1/1974 |
| DE | 35 29 680 | A1 | 3/1986 |
| DE | 36 10 107 | A1 | 10/1987 |
| DE | 38 25 517 | A1 | 2/1990 |
| DE | 43 27 278 | C2 | 2/1995 |
| DE | 195 34 651 | A1 | 3/1997 |
| DE | 197 30 681 | | 4/1998 |
| DE | 199 57 275 | A1 | 6/2000 |
| DE | 200 11 948 | | 12/2000 |
| DE | 100 52 014 | A1 | 5/2001 |
| DE | 102 02 385 | A1 | 8/2002 |
| DE | 10113313 | A1 | 9/2002 |
| DE | 101 45 322 | A1 | 4/2003 |
| DE | 102 44 043 | A1 | 6/2003 |
| EP | 0 246 081 | A2 | 11/1987 |
| EP | 0 331 870 | A2 | 1/1989 |
| EP | 0826501 | A1 | 3/1998 |
| EP | 0 941 850 | A1 | 9/1999 |
| EP | 1 029 672 | | 8/2000 |
| EP | 0 699 524 | B1 | 10/2001 |
| EP | 1 264 686 | A1 | 12/2002 |
| FR | 2 385 530 | | 5/1976 |
| GB | 1 213 903 | | 11/1970 |
| GB | 1 213 935 | | 11/1970 |
| GB | 1 223 506 | | 2/1971 |
| WO | WO 95/24314 | | 9/1995 |
| WO | 02/074541 | A1 | 9/2002 |
| WO | WO 02/081218 | A2 | 10/2002 |
| WO | WO 02/081218 | A3 | 10/2002 |
| WO | WO 03/025406 | A1 | 3/2003 |
| WO | 03/031179 | A2 | 4/2003 |
| WO | WO 03/039872 | A1 | 5/2003 |
| WO | WO 03/049946 | A2 | 6/2003 |
| WO | WO 03/049946 | A3 | 6/2003 |
| WO | WO 03/064763 | A1 | 8/2003 |
| WO | WO 2004/028810 | A1 | 4/2004 |
| WO | 2005/072965 | A1 | 8/2005 |

* cited by examiner a)

b)

a)

b)

a)

09.1 b)

09.2

PRINTING GROUPS COMPRISING AT LEAST TWO COOPERATING CYLINDERS AND RADIALLY MOVABLE BEARING UNITS

CROSS-REFERENCE TO RELATED APPLICATIONS

This application is the U.S. national phase, under 35 USC 371, of PCT/EP2006/061695, filed Apr. 20, 2006; published as WO 2006/111556 A2 and A3 on Oct. 26, 2006, and claiming priority to DE 10 2005 018 473.1, filed Apr. 21, 2005 and to DE 10 2005 045 984.6, filed Sep. 27, 2005, the disclosures of which are expressly incorporated herein by reference.

FIELD OF THE INVENTION

The present invention is directed to printing groups comprising at least two cooperating cylinders. Each of the cylinders is mounted in a bearing unit that is capable of displacing its respective cylinder radially.

BACKGROUND OF THE INVENTION

From WO 95/24314 A1 a printing unit of this general type is known. Four blanket-to-blanket printing groups are arranged vertically, one above another, and can be moved horizontally relative to one another in the area of their blanket-to-blanket printing points. To accomplish this, the printing groups situated on the same side of the web are each mounted within a shared frame. At least one of the frames can be moved horizontally.

EP 12 64 686 A1 discloses a printing unit with blanket-to-blanket printing groups arranged vertically one above another. The printing group cylinders are mounted in a center frame section, and the two inking units are each mounted in outer frame sections. These outer frame sections can be moved horizontally relative to the center frame section, in order to introduce plate-handling devices into the space between them as needed.

From DE 22 34 089 C3, a web-fed offset rotary printing press is known. A panel section having multiple printing groups can be moved relative to a panel section having the corresponding impression cylinders. The printing group cylinders and the allocated inking units are mounted together as units in this panel section such that they can be moved and/or removed.

In DE 43 27 278 C2 a printing unit having the structural design of a side frame is disclosed, on which transfer and forme cylinders, of a specific circumferential format, are rotatably mounted. Specific modular inking units from various types of inking units can be used as required.

U.S. Pat. No. 2,557,381 A shows a printing unit that can be flexibly equipped for various printing processes and numbers of printing points. In each case, the inking units and the printing group cylinders are arranged one above another in the form of a tower, and as such can be moved toward one another and/or away from one another. Different types and different numbers of printing units and inking units or inking systems can be selectively used in a standard frame.

From EP 02 46 081 A2, a printing unit, having multiple modular units, each containing the printing cylinders of a printing group, and containing units configured as inking units, is known. The inking units are horizontally adjustable relative to the printing cylinders for the purpose of engagement and disengagement, and vertically can be placed in contact with different printing groups, for example with different printing groups of different printing lengths. The modular units that contain the printing cylinders can be interchanged as needed with modular units of other printing lengths.

DE 102 02 385 A1 shows a drive train between the cylinders of a printing group with variable printing lengths. Two intermediate gears are arranged between cylindrical spur gears that do not mesh with one another.

In EP 06 99 524 B1 drive trains for printing units are disclosed. In one embodiment, a paired drive for the printing group cylinders is accomplished with a single motor via enmeshed spur gears.

WO 03/039872 A1 describes printing group cylinders that, in one embodiment, are actuated in pairs by a drive motor. A transmission that couples the two cylinders is enclosed in its own housing.

In DE 195 34 651 A1 a printing group for use in indirect printing, comprised of a three-cylinder system for single-sided printing or a four-cylinder system for double-sided printing on a web of printing substrate, is known. All of the cylinders, or all but one cylinder in the respective cylinder system have a bearing support on one side of each cylinder that has rectilinear, radially displaceable jaws, wherein the opposite, other side of each cylinder is equipped with a fixed bearing support without adjustable jaws. To execute a change in the axial distance to the adjacent cylinder in all but one cylinder, additional operating cylinders that act orthogonally to the movable jaws are provided for displacing the cylinders. Because the axial spacing of the cylinders is adjustable, different printing substrate thicknesses, etc. can be compensated for, and different web widths can be processed. An inclined positioning of the forme cylinder as a diagonal resister adjustment is also possible. All movement processes for the support elements can be implemented using a computing and storage unit, in which the target positions of the relevant mechanisms are stored, and which is connected at its input side to measured-value transducers that scan the positions of the cited mechanisms, and at its output side to drives for positioning these mechanisms. A separately actuated electric motor is provided for each of the cylinders. Each of the forme cylinders is also equipped with an auxiliary drive for an axial displacement that effects its lateral register adjustment.

From EP 03 31 870 A2 a device for mounting a pair of cylinders in a printing press is known. The bearing housings, each of which supports a journal of the cylinder, can be acted upon by an arrangement of pressure medium cylinders with forces that are equal to one another, different from one another, or the same in groups, in order to adjust a distance between the cylinders, wherein the respective direction of action of each of the pressure medium cylinders is the same. With this arrangement of pressure medium cylinders an essentially unidimensional adjustment is therefore possible. The adjustable forces can be adjusted or preselected during machine operation or even prior to the start of machine operation using an adjustment/preselection/control or regulation device. If the device is a controller, a sensor is allocated to this controller, and reports its observations to the controller. The pressure adjusted at the pressure medium cylinders by the controller can be continuously adjusted as needed, for example, to correspond to the press speed of the cylinders or to correspond to the rotational speed of these cylinders within broad limits during operation of the device.

EP 0 941 850 A1 relates to a control device for controlling the printing of one or more material webs in a rotary printing press from a control panel, which device comprises an analysis table configured to hold at least one printed sample for examination. The control device has an interface system between an operator and the individual components of the printing press, with a selection device for selecting all functions of the printing press. A control and monitoring system is provided, which is suitable for transferring selected data to the rotary printing press in order to activate the selected component of the printing press.

In WO 02/081218 A2 individual linear bearings for two transfer cylinders, each mounted in sliding frames, are known, An actuator for the sliding frames can be configured as a cylinder that can be acted upon by pressure medium. In order to define an end position for the adjusting movement extending crosswise to the cylinder plane, an adjustable stop is provided.

From DE 102 44 043 A1 devices for adjusting rollers in a printing press are known. The two ends of a roller that exerts a contact force on an adjacent rotational body are each mounted in a support bearing having a roller socket that is capable of radial travel. Each support bearing has a plurality of actuators that can be acted upon by a pressure medium and themselves act on the roller. A roller that can be adjusted in this manner is also engaged, for example, against a forme cylinder.

From DE 38 25 517 A1 a device for the engagement/disengagement and adjustment of inking unit and/or dampening unit rollers of a printing press is known. A memory-programmable control device automatically controls the position of an inking unit or dampening unit roller in relation to a stationary distribution roller using an input, predetermined contact force. The memory-programmable control device issues a positioning command to an electric actuator. The actuator, which is configured as a direct-current motor, passes the positioning command on to a corrector element. The corrector element is responsible for the mechanical displacement of the inking unit or dampening unit roller. The electric actuator and the corrector element are arranged in a roller socket of the adjustable inking unit or dampening unit roller. With the device known from DE 38 25 517 A1, a remote adjustment of the inking unit or dampening unit roller is possible. Based upon a basic setting for the adjustable inking unit or dampening unit rollers, for various production methods, adjustment values for other settings can be stored in the memory-programmable control device. Therefore, the adjustment values for the inking unit or dampening unit rollers are dependent upon the production method selected. Adjustment values, which are input in advance, for the various settings that correspond to the production method, are determined by the memory-programmable control device using a program.

From WO 03/049946 and WO 2004/028810 A1, methods for operating an inking unit or dampening unit of a printing press are known. In the inking unit or dampening unit at least three rollers or cylinders are provided, which can come into contact with one another in at least two roller strips. At least one of the rollers is mounted in a machine frame so as to be displaceable in relation to the other rollers. The displaceably mounted roller is pressed into the gap between the adjacent rollers with a force that is adjustable in terms of degree and direction, to effect the variable adjustment of the respective contact force.

From DE 36 10 107 A1, a setting device for adjusting the position of a roller is known, and with which, the roller can be engaged against a counter roller, or disengaged from that roller. At each roller end, a roller journal is mounted in a bearing block, resting in a stationary bearing housing. The latter is comprised of a base plate and a guide plate, which extends along the outer end surface of the bearing block. The bearing block has guide jaws that encompass the guide plate, so that the bearing block can be displaced along the guide plate. In the base plate are two hydraulic pistons that act on one side to displace the bearing block in one direction. To shift the bearing block in the other direction, in the upper area of the guide plate an additional hydraulic piston is arranged, which acts on the roller journal. A preferred area of application for adjustment devices of this type is wet pressing or smoothing units in paper machines. Other areas of application include plastic calenders or roller units.

SUMMARY OF THE INVENTION

The object of the present invention is to devise printing groups that can be easily adjusted using a control device.

The object of the present invention is attained, according to the invention with provision of a printing group having at least two coordinating cylinders. Each of the cylinders it mounted in a bearing unit that is capable of displacing the respective cylinder radially. At least one of the bearing units has at least one actuator.

The benefits to be achieved with the present invention consist especially in that a printing unit that is easy to produce and/or easy to operate is devised, in which a multitude of adjustments that affect the print quality of a printed product can be performed. The printing unit generates a printed product of high print quality based upon the adjustments performed on it.

With side frames that in one embodiment are separable, good accessibility, a contribution to potential modularity and a low height are achieved.

By using linear guides for the printing group cylinders, an ideal mounting position for the cylinders, with respect to potential cylinder vibrations, is achieved. In addition, by mounting the cylinders in linear guides, short adjustment paths are realized, eliminating the need for synchronizing spindles. The costly installation of three-ring bearings is eliminated.

The cylinder bearings, which are arranged on the interior of the side frames but which do not penetrate through those frames, enable side frame mounting without specific bearing bores. The frames can be configured to be independent of format. A cylinder unit can be installed in the frame panels, along with the preadjusted mount, on-site without further preparation. With the module size that comprises only one cylinder, or cylinder plus bearing units, cylinder formats of different sizes can be used and optionally combined.

With one or more cited preconditions established for modularity, considerable potential for savings is present. The number of parts in individual component groups is increased in terms of both structural design and production.

Because the drives for the printing group cylinders and/or for the individual inking units are structured to have separate motors or as complete transmission modules, lubricant is used, for example, only in the already preassembled functional modules.

The mounting on the interior of the side frames, in addition to allowing simple installation, also allows the cylinder journals to be shortened, which has the effect of reducing vibration.

The aforementioned embodiment comprising the linear bearing with movable stops enables a pressure-based adjustment of the cylinders along with an automatic basic adjustment—for a new configuration, a new printing blanket, etc.

In one embodiment of a modular automatic handling system, a simple plate change for different formats is optionally possible.

Further benefits to be achieved with the present invention consist in that the contact force exerted by a roller or a cylinder in a roller strip on an adjacent rotational body can be individually adjusted as needed by a control device, especially by addressing individual actuators involved in the adjustment, and an existing setting can preferably be adjusted via remote actuation, for example even during a production run on the printing group. As a result of the adjustability of the contact force, a width of the roller strip that is formed between the roller or the cylinder and its respective adjacent rotational body can be adjusted as needed, which produces a beneficial effect on the quality of the printed product produced by the printing group. The contact force is preferably adjusted by a support bearing, also called a roller socket, having at least one actuator. In each roller socket involved in the displacement of a roller, or in each bearing unit involved in the displacement of a cylinder, preferably a plurality of actuators are arranged, which are identifiable and individually selectable, and therefore can be individually actuated, directly or indirectly, via the control device. Each of the activated actuators exerts a radial force that is directed toward the interior of its roller socket or its bearing unit. The vector sums of the radial forces exerted by a plurality of actuators preferably make up the contact force exerted by the roller on the adjacent rotational body. The radial forces exerted by the actuators can preferably be adjusted individually and independently of one another, and are also set by the control unit for a desired operational position. Each of the actuators is clearly identifiable based upon an identifier, as are the respective roller strips and the roller sockets or bearing units allocated thereto. Actuators connected to a shared pressure medium source can be activated in groups, or preferably individually. Due to the arrangement of controllable devices and their respective connection, for example via pressure medium supply lines, actuators for a certain roller socket or a certain bearing unit that are connected to different pressure sources can be activated together, for example, while actuators for another roller socket or another bearing unit that are connected to the same pressure source remain inactive. Especially with a forme cylinder that is not completely loaded with printing formes in an axial direction, the contact force exerted by a roller that is engaged against this forme cylinder can be set differently at the two axial ends of this roller. When the control unit receives the instruction, for example from a corresponding input via a control element that is part of the control unit, to alter the setting of the contact force in a selected roller strip, the control unit calculates which actuator of the relevant roller socket is to be acted upon by what level of pressure, and performs the necessary adjustment, if applicable, in the pressure setting, for example by actuating one or more controllable devices in order to change the pressure in selected actuators. To implement the contact force that is to be adjusted in terms of its level, the control unit controls valves, especially rapid-reacting, electrically or electromagnetically actuated proportional valves, which are preferably arranged in the pressure lines, so that the adjustment of a contact force that is changed in terms of its value is achieved within a few seconds.

BRIEF DESCRIPTION OF THE DRAWINGS

Preferred embodiments of the present invention are represented in the set of drawings and will be described in greater detail in what follows.

The drawings show.

DETAILED DESCRIPTION OF THE PREFERRED EMBODIMENTS

Figure 1:
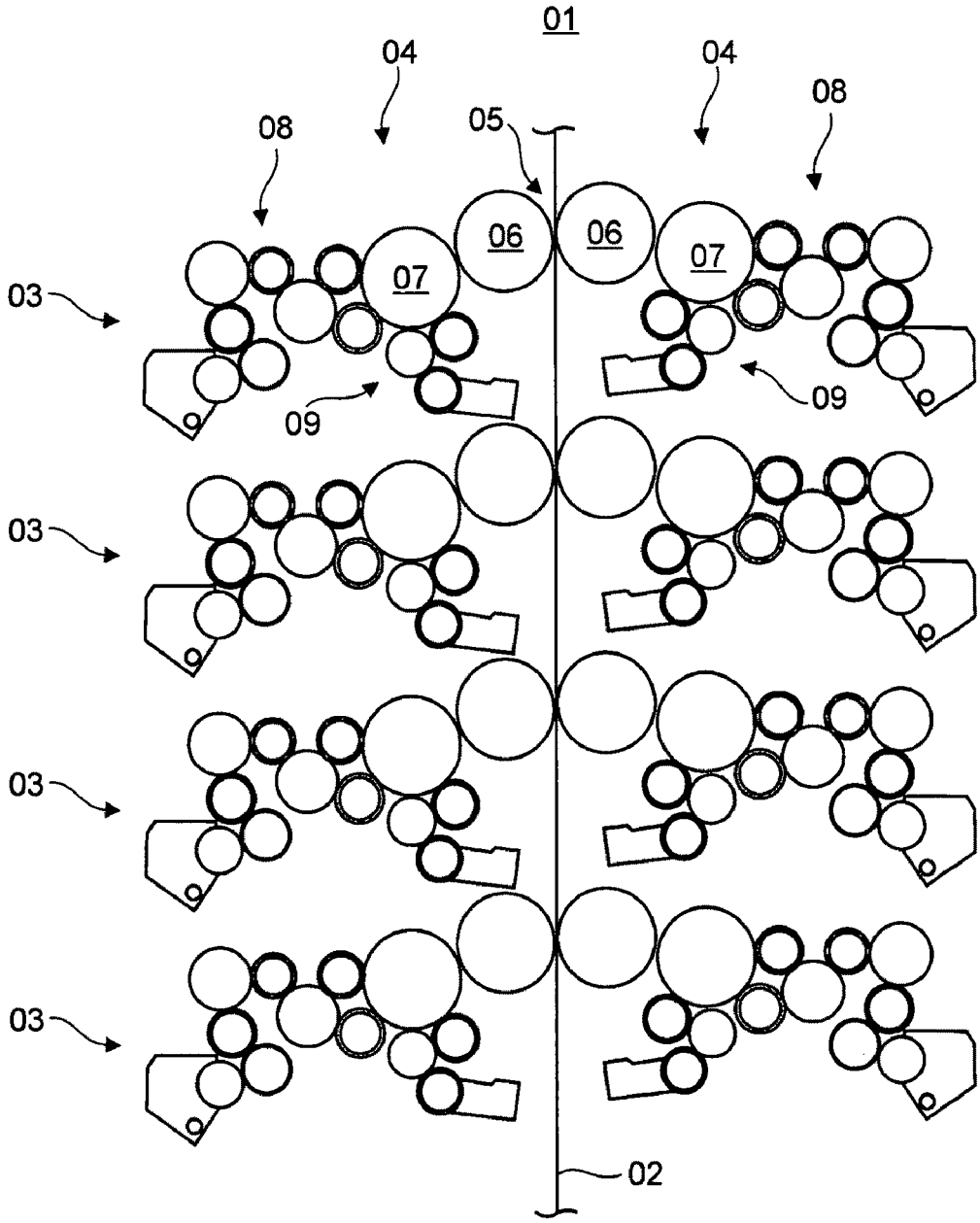
FIG. 1 a schematic representation of a printing unit.

A printing machine, for example a web-fed rotary printing press, and especially a multicolor web-fed rotary printing press, is shown in FIG. 1 and has a printing unit 01, in which a web of material 02, hereinafter shortened to web 02, can be printed on both sides in a single process or, especially successively, in a multi-step process, for example in this case a four-step process, or in which multiple webs can be printed simultaneously in a single-step process or in a multi-step process. The printing unit 01 has multiple, in the present case four blanket-to-blanket printing units 03 arranged vertically one above another for printing on both sides in a blanket-to-blanket operation. The blanket-to-blanket printing units 03, represented here in the form of arch-type printing unit or n-printing units—are each formed by two printing groups 04, each of which has cylinders 06; 07, one configured as a transfer cylinder 06 and one configured as a forme cylinder 07, for example printing group cylinders 06; 07, and one inking unit 08, and, in the case of wet offset printing, also a dampening unit 09. In each case, between the two transfer cylinders 06, at the position of engagement, a blanket-to-blanket printing point 05 is formed. The aforementioned component parts are identified only on the uppermost blanket-to-blanket printing group 03 in FIG. 1, wherein the blanket-to-blanket printing groups 03; 04 arranged one above another are essentially identical in design, especially in the embodiment of the characterizing features relevant to the invention. The blanket-to-blanket printing units 03, without the advantageous characterizing feature of the linear arrangement described below, can be implemented just as beneficially, in contrast to the representation in FIG. 1, as a U-shaped unit that is open toward the top.

In advantageous embodiments, the printing unit 01 has one or more of the following characterizing features—based upon requirements, the type of machine, the technology used and/or the project stage. The printing unit 01 or the blanket-to-blanket printing unit 03 is/are configured such that they can be functionally separated, for example, at the center, i.e. in the area of the blanket-to-blanket printing point(s) 05. The inking units 08, and optionally dampening units 09 may be configured as modules that already contain multiple rollers and can be installed as pre-assembled modules in the printing unit 01. Printing group cylinders 06; 07 of different diameters can be mounted in the side frame without requiring bearing bores. The cylinder bearings can be power-controlled in linear bearings, and/or the rotational axes of the printing group cylinders 06; 07 are configured to lie essentially in a common plane in the print-on position. Additionally, or optionally as a separate embodiment the modularity can be advantageously supported by the special paired drive connection, coupled via two intermediate gears, of a pair of printing group cylinders, or via separate drives for the cylinders 06; 07. This also applies in an advantageous embodiment to the mechanical independence of the drive for the inking unit 08 and, if applicable, the dampening unit 09 from the drives for the printing group cylinders 06; 07.

In principle, individual, or several of the aforementioned characterizing features are also viewed as beneficial for printing units that are not printing groups 03 configured as blanket-to-blanket printing units used in blanket-to-blanket printing, and instead have printing groups 03 that operate only in perfecting printing. The transfer cylinder 06 of a printing group then acts in coordination with an impression cylinder. Especially in the modular configuration, this can optionally be provided, wherein in place of the two cylinders 06; 07 of the second printing group 04 and of the printing unit 08 only one impression cylinder is then used. For the arrangement on the interior of the side panels, what is described below with respect to the other cylinders 06; 07 can then apply.

In the subsequent FIGS. 2 and 3, an advantageous embodiment of the printing unit 01 is represented, wherein this embodiment—in principle independent from the modular construction of the printing groups 04, also represented there and described in greater detail below, and/or the bearing units 14, indicated by way of example for only the upper blanket-to-blanket printing group 03 (see FIG. 18)—is configured such that it can be functionally separated in the area of its blanket-to-blanket printing point(s) 05, in other words for set-up and maintenance purposes, as compared with dismantling or a disassembly. The two parts that can be separated from one another, including the cylinders 06; 07, inking units 08 and, if present, dampening units 09 are referred to in what follows as printing unit sections 01.1 and 01.2.

In addition, the printing group cylinders 06; 07 of the multiple (four) blanket-to-blanket printing groups 03 arranged one above another are rotatably mounted in or on one right and one left frame or panel section 11; 12 in such a manner that the two printing group cylinders 06; 07 of the same printing group 04 are allocated to the same frame or panel section 11; 12. The printing group cylinders 06; 07 of multiple, especially all, printing groups 04 that print the web 02 on the same side are preferably mounted on the same frame or panel section 11; 12. In principle, the printing group cylinders 06; 07 can be mounted on only one side, i.e. cantilevered, on only one outside-surface frame section 11. Preferably, however, two frame sections 11; 12 arranged at the ends of the cylinders 06; 07 are provided per printing unit section 01.1; 01.2. The two parts that can be separated from one another are hereinafter referred to as printing unit sections 01.1 and 01.2, which comprise the respective frame sections 11; 12 and printing groups 04, printing group cylinders 06; 07 and inking units 08.

The printing unit sections 01.1; 01.2 can be moved in a direction that runs perpendicular to the rotational axis of the cylinders 06; 07, toward one another and away from one another, in which one of the two is preferably mounted fixed in space, in this case printing unit section 01.1, i.e. for example stationarily on a section of floor 13 in the printing shop, on a stationary support 13, on a mounting plate 13 or on a mounting frame 13 for the printing unit 01, and the other, in this case printing unit section 01.2 is mounted so as to be movable in relation to the floor 13 or support 13 or mounting plate 13 or mounting frame 13, hereinafter support 13.

To this end, the outer frame sections 12 are mounted in bearing elements of the frame section 12 and the support 13 that correspond to one another and are not shown here, for example together forming a linear guide 15. These can be configured as rollers that run on tracks or as slider- or roller-mounted linear guide elements that are allocated to one another.

Figure 2:
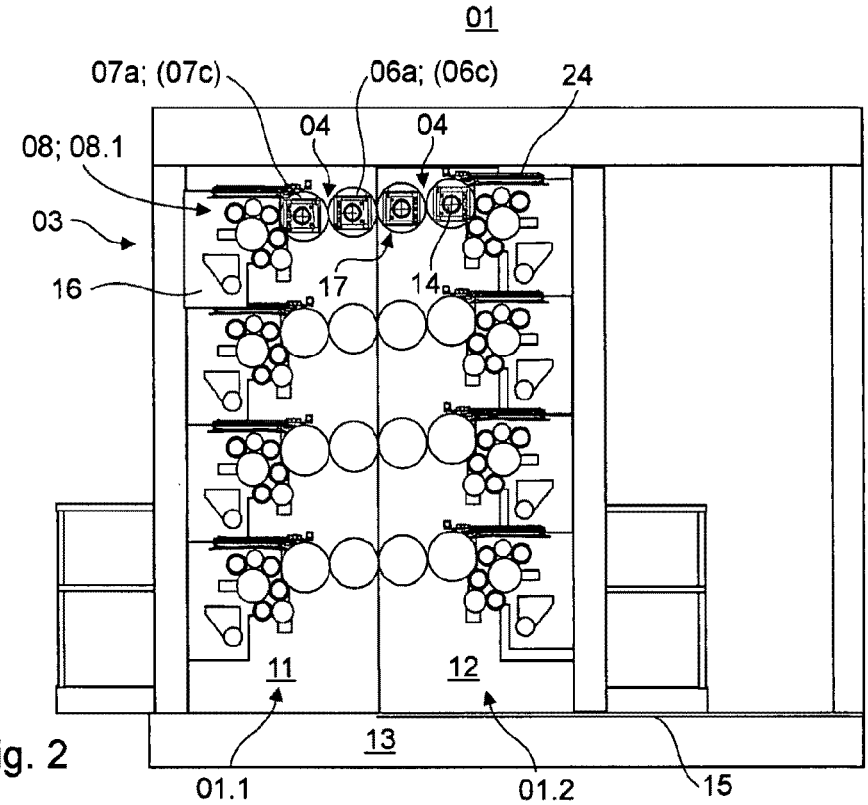
FIG. 2 a first operating position of a first embodiment of a printing unit.

The panel sections 11; 12 are preferably structured such that in their operational position A, FIG. 2 their facing sides are configured to have essentially complementary shapes in pairs, and to nevertheless form an essentially closed side front at their separation lines and/or impact lines when pushed together.

Figure 3:
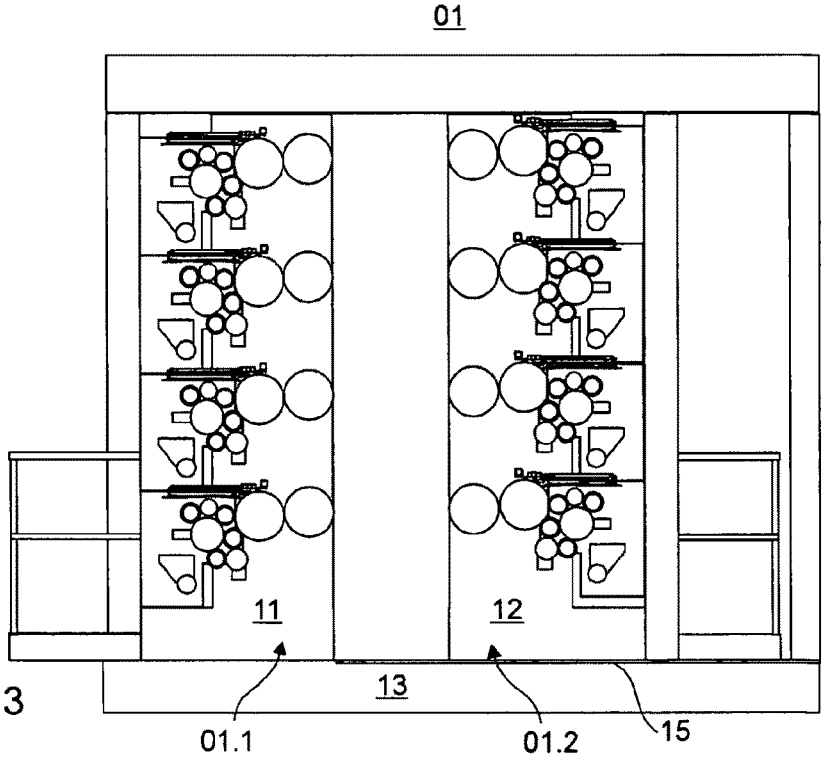
FIG. 3 a second operating position of a first embodiment of a printing unit.

FIG. 3 shows a maintenance position B for the printing unit 01, without the bearing units 14 shown in FIG. 2, wherein the positioning of the printing unit sections 01.1; 01.2 in relation to one another is effected by moving the frame sections 12. In principle, this relative positioning can also be accomplished in another embodiment, in which both printing unit sections 01.1; 01.2 and/or their frame sections 11; 12 are mounted so as to be movable.

In a first format embodiment, represented thus far in FIG. 1 through 3, the forme and transfer cylinders 07; 06 are preferably configured to have a cylinder width of at least four, for example four or even for a particularly high rate of production six vertical print pages in newspaper format, especially in broadsheet format, arranged side by side. Thus a double-width web 02 can be printed with four newspaper pages side by side, and a triple-width web 02 can be printed with six newspaper pages side by side, and the forme cylinder 07 can be correspondingly loaded with four or six printing formes side by side, especially with their ends aligned to one another. In a first advantageous format embodiment represented thus far in FIG. 1 through 3, the cylinders 06; 07 have a circumference that corresponds essentially to two print pages in newspaper format arranged in tandem.

In the embodiments of the printing unit 01 with forme cylinders 07 of double-sized format, two newspaper pages in tandem in circumference, the printing unit advantageously has two channels, offset 180° relative to one another in the circumferential direction, to accommodate the printing formes, which preferably are configured to be continuous over the entire active surface length. The forme cylinder 07 can then be loaded with four or six printing formes side by side, with every two printing formes in tandem.

In one embodiment, for example, in the double-sized format, with two newspaper pages in tandem in circumference the transfer cylinder 06 has only one channel configured to accommodate one or more printing blankets arranged side by side, which preferably is configured to be continuous over the entire active surface length. The transfer cylinder 06 can then be loaded with one printing blanket that is continuous over the surface length and extends over essentially the full circumference, or with two or three printing blankets side by side, extending over essentially the full circumference. In another embodiment of the double-sized transfer cylinder 06. The cylinder can have two or three printing blankets side by side, with the respective adjacent blankets being offset 180° in relation to one another in the circumferential direction. These printing blankets offset in relation to one another can be held in two or three channel sections, which also are offset, side by side, in the longitudinal direction of the cylinder 06, while the respective adjacent channel sections are offset 180° in relation to one another in the circumferential direction.

As already indicated in FIGS. 2 and 3, in one advantageous embodiment of the printing unit 01—in principle independent of an ability to be divided or separated—the inking units 08 or the cylinder units 17 formed from bearing units 14 and the relevant cylinder 06, or preferably both the inking units 08 and the cylinder units 17, are configured as modules, in other words as structural units considered as preassembled in structural terms.

The inking units 08 implemented as modules have, for example, a suitable frame 16 or a framework 16, in which multiple functional parts, in this case at least three, especially all of the rollers, and an ink source or ink supply, ink chamber blade, ink fountain, application nozzles, for the inking unit 08, even without connection to the side frame 11; 12 of the printing unit 01, maintain their firmly defined position in relation to one another, and, for example, can be installed preassembled and complete into the printing unit 01. The framework 16 or the frame 16 can be implemented especially as two side frames arranged at the end surfaces of the rollers, which are connected to one another, for example, via at least one cross member and/or base that is not represented here. During mounting, the frame 16 that accommodates the functional components of the module is securely connected, with adhesive force or in a separable positive connection to the side frame 11; 12 of the printing unit 01. If the printing unit 01 is implemented in the aforementioned manner to be dividable or separable, then the inking units 08 implemented as modules are connected to the respective frame or panel sections 11; 12—with adhesive force, such as welding or in a separable positive connection, such as screwing during mounting. The complete side frame on one side of the printing unit 01, or a complete side frame of a printing unit section 01.1; 01.2, is then comprised of multiple parts—comprising one side frame 11; 12 that accommodates the cylinders 06; 07 and partial side frames for the inking units 08. Separable in this context does not mean an operational separability, but only a dismantling in terms of a disassembly of the printing unit 01 or a removal/exchange of the inking unit 08.

Modules implemented as cylinder units 17 (see below in reference to FIGS. 17 and 18) have, for example, a cylinder 06; 07 with journals 63; 64 and a bearing unit 14 that is already mounted on the journals 63; 64 (prestressed and/or preadjusted). Bearing unit 14 and cylinder 06; 07 obtain their securely defined position relative to one another already prior to installation into the printing unit 01, and can be installed as a complete unit into the printing unit 01.

Figure 4:
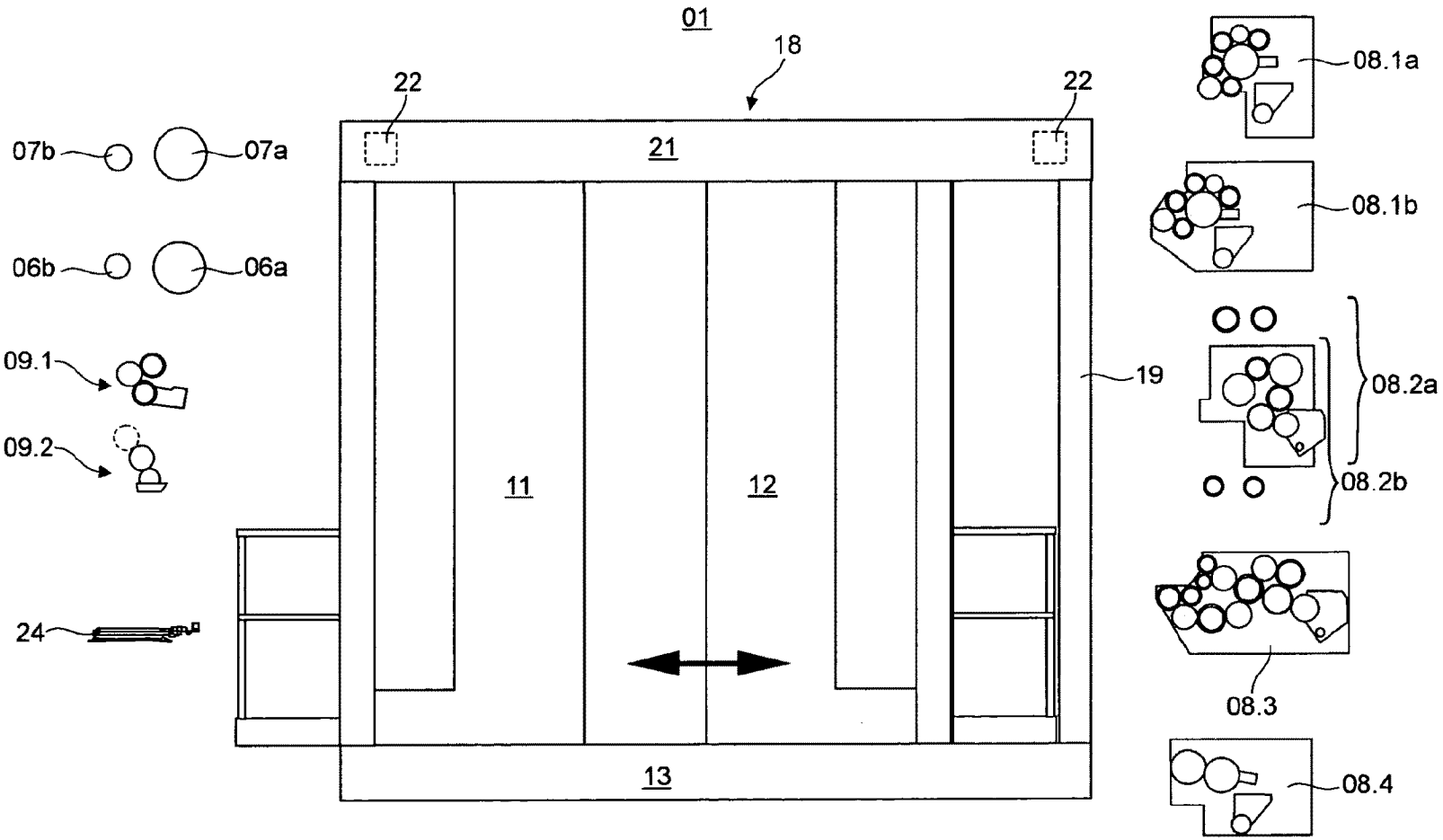
FIG. 4 a schematic representation of the modularity of a printing unit.

FIG. 4 illustrates a system for a printing unit 01 of modular construction, which can, in principle, be implemented to be either separable, as represented here or non-separable. In the latter case, the side frame 11; 12 that accommodates the cylinders 06; 07 would be arranged not in two parts, but as a single part, and fixed in space in the printing shop. However, the separable variant, as represented here, is advantageous.

In the case of the non-separable variant, for example, two side frames 11; 12 arranged at the end surfaces of the cylinders 06; 07, together with the support 13, or mounting plate 13 or mounting frame 13 and at least one and preferably two cross member that connects the two sides above a center height, not illustrated in this case, form a basic structure 18 for the printing unit 01.

For the separable version, the basic structure 18 is, for example, formed by the lower supports 13, the two frame sections 11, each of which is arranged fixed in space, at least one pillar 19 per side of the printing machine, an upper support 21 that connects the frame section 11 that is arranged fixed in space to the pillars 19 on each side of the printing machine, and at least one, and preferably at least two cross member 22 that connects the two sides above a center height, represented here only by a dashed line. The frame sections 11; 12 can be configured as essentially continuous panel sections, each as a single piece and flat, or, to allow a lighter construction and/or improved accessibility of the unit, as represented here, can be kept thin and, optionally, can also be connected with one or more vertical support pillars per side frame, not separately provided with reference symbols, for the purpose of stabilization.

This "hollow" basic structure can now be configured or equipped with printing group cylinders 06; 07 and inking units 08 of various constructions.

As also represented in FIG. 4, a transfer cylinder 06*a* having the circumference of two printed pages in vertical position, especially newspaper pages in broadsheet format, or double sized, or a transfer cylinder 06*b* having the circumference of one printed page, especially a newspaper page in broadsheet format or single sized, can be used accordingly as the transfer cylinder 06. It is also possible to load it with forme cylinders 07*a*) having the circumference of two printed pages in vertical position, especially newspaper pages, or having a single circumference, forme cylinder 07*b*, i.e. one printed page, especially one newspaper page in broadsheet format, in circumference. In principle, any combination of forme and transfer cylinders 07; 06 having a whole-number circumferential ratio of forme cylinder to transfer cylinder 07; 06, for example 1:1, 1:2, 2:1, 3:1, 1:3, 3:2, 2:3, but preferably with a forme cylinder 07 that is equal or equal to the transfer cylinder 06, can be provided.

In the implementations of the printing unit 01 with forme cylinders 07 of single-sized format, one newspaper page in circumference, the printing unit is advantageously equipped, viewed in a circumferential direction, with a channel configured to accommodate the printing formes, which preferably is configured to be continuous over the entire active barrel length. The forme cylinder 07 can then be loaded with four or six printing formes side by side.

In the case of a single-size format, one newspaper page in circumference, in one embodiment, for example, the transfer cylinder 06 has only one channel configured to accommodate one or more printing blankets arranged side by side, which is preferably configured to be continuous over the entire active barrel length. The single-circumference transfer cylinder 06 can then be loaded with one printing blanket that is continuous over the barrel length and extends over essentially the entire circumference, or with two or three printing blankets arranged side by side and extending over essentially the entire circumference.

In embodiments in which a single-sized forme cylinder 07 operates in coordination with a double-sized transfer cylinder 06, those parts that are mentioned in reference to the double-sized transfer cylinders 06 and the single-sized forme cylinders 07 can be utilized together.

The optional configuration with, for example single-sized or double-sized cylinders 06; 07 having circumferences for different printed page formats, for example newspaper formats, with circumferences that differ from one another, is also possible. Thus the circumferences of the double-sized cylinders 06*a*; 07*a* can range from 840 to 1,300 mm, especially 860 to 1,120 mm, and those of the single-sized cylinder 06*b*; 07*b* can correspondingly range from 420 to 650 mm, especially 430 to 560 mm, or even from 430 to 540 mm. With the cylinder unit 17 that is described in greater detail below, this modular construction is favored to a considerable degree, as in this case it is not necessary to provide bearing bores that take into account the precise positioning and geometry of the cylinders 06; 07, for the precise accommodation of three- or four-ring bearings having, for example, eccentrics in the side frame 11; 12.

Figure 5:
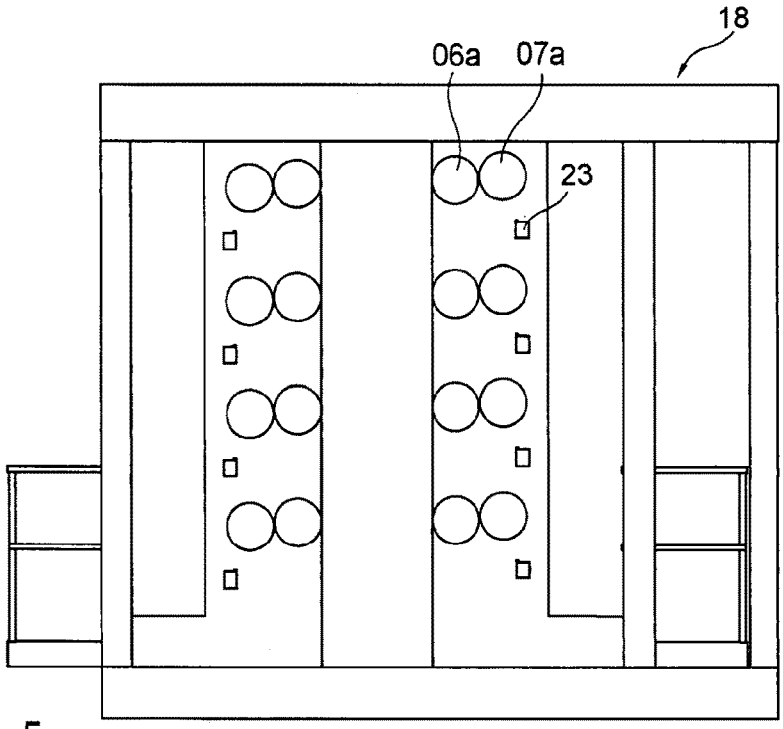
FIG. 5 a stage of assembly of a printing unit to be configured.

In FIG. 5 the printing unit 01 is implemented, by way of example, with cylinders 06*a*; 07*a* of double circumference. If it is equipped with single-sized forme cylinders 07*b*, these can coordinate with double-sized transfer cylinders 06*a* for the purpose of increasing stability, as discussed below in reference to FIG. 7, 9, 13, or also with single-sized transfer cylinders 06*b* for the purpose of conserving space.

Most advantageously, it is possible, at least in principle independently of the separability of the printing unit 01 and/or of the modular installation of cylinder units 17, to configure the printing unit 01 in a modular fashion with inking units 08 of various types, based upon a client's needs. The various inking unit types can include short inking units 08.1, single-train roller inking units 08.2, for example with two distribution cylinders, for example from newspaper printing or roller inking units 08.3 with two ink trains and, for example, three distribution cylinders, for example from commercial printing.

The inking unit 08 which is implemented as a short inking unit 08.1 in a first variant, FIG. 6*a* has a central roller 26 with grid marks or cells, for example an anilox roller 26, which receives the ink from an inking device 27, especially an ink chamber blade 27, or also from an ink fountain via a roller train that is not illustrated here, and delivers it to the printing forme of the forme cylinder 07 via at least one, preferably at least two, roller(s) 28, for example forme rollers 28, for example an ink forme roller, especially having a soft surface. Advantageously, the central roller 26 acts in coordination with two additional soft rollers 29, for example inking or forme rollers 29. To even out the ink distribution, an axial roller 31, for example an oscillating distribution roller 31, preferably with a hard surface, acts in coordination with each forme roller 28 and its adjacent inking rollers 29. The ink application device 27 receives its ink, for example, from an ink reservoir 32, especially via a pump device that is not illustrated here, into which excess ink can also drip. The anilox roller 26 is preferably rotationally actuated by its own drive motor that is independent of the cylinders 06; 07. The remaining rollers 28; 29; 31 are preferably actuated via friction. In the case of an increased requirement for variation, the oscillating motion can be provided by a separate drive element, or, as in this case at reduced expense, by a transmission, which converts the rotational motion into axial motion.

The inking unit 08 that is implemented as a single-train roller inking unit 08.2, also a "long inking unit", FIG. 6*b* has at least two forme rollers 28 that apply the ink to the printing forme, which receives the ink via a roller 33 that is near the printing forme, especially an oscillating distribution roller 33 or distribution cylinder 33, for example with a hard surface, a roller 34, especially an ink or transfer roller 34, for example with a soft surface, an oscillating distribution roller 33 or distribution cylinder 33 arranged distant from the printing group, an additional inking or transfer roller 34, for example with a soft surface, a roller 37, especially a film roller 37 and a roller 36, especially an ink fountain roller or dipping roller 36, from an ink fountain 38. Dipping and film rollers 36; 37, which are characteristic of a film inking unit can also be replaced by a different ink supply or metering system, for example a pump system in an ink injector system, or a vibrator system in a vibrator inking unit. In one embodiment, the distribution cylinders 33, together or respectively individually, are rotationally actuated by their own drive motor that is independent from the cylinders 06; 07. The roller 36, and in a further development optionally the film roller 37, is also advantageously provided with its own rotational drive motor. In the case of an increased requirement for variation, the oscillating motion of the distribution cylinder 33 can be provided via a separate drive element, or as in this case at decreased expense, via a transmission, which converts the rotational motion into axial motion. An advantageous further embodiment of the single-train inking unit 08.2—for example also implemented in the form of a module—is presented below in the framework of the description of FIG. 31 through 35.

The inking unit 08 implemented as a two-train roller inking unit 08.3, FIG. 6*c* has at least three, and in this case has four, forme rollers 28 that apply the ink to the printing forme, which receives the ink via a first ink train comprised of a first distribution cylinder 33, a soft inking roller 34 and a hard transfer roller 39, and via a second ink train with a second distribution cylinder 33 from a shared soft inking roller 34, a distribution cylinder 33 that is distant from the forme cylinder, a further soft inking roller 34, a film roller 37 and an ink fountain roller 36, from an ink fountain 38. As mentioned above, the ink fountain and film rollers 36; 38 can also be replaced in this case by a different ink supply or metering system.

Preferably, the three distribution cylinders 33, together or each separately, can be rotationally actuated by their own drive motors, which are independent from the cylinders 06; 07. The ink fountain roller 36, and in a further development optionally the film roller 37, are preferably also provided with their own separate rotational drive motors. In the case of an increased requirement for variation, the oscillating motion of the distribution cylinders 33 can also be provided, together or each individually, by a separate drive element, or as in this case at reduced expense, by a transmission, which converts the rotational motion into axial motion. Although this inking unit 08.3 can also be used in newspaper printing, it is preferably provided for the configuration of the printing unit for commercial printing.

In a second variant, FIG. 6*d* for a short inking unit 08.4, which is also called an "anilox inking unit", the unit has only one large forme roller 28', especially one whose size corresponds to that of the forme cylinder 07, which receives the ink from the anilox roller 26, which is also large in one variant, and is inked up by the ink application device 27, for example a blade system 27, especially the ink chamber blade 27. This inking unit 08.4, because of its inclination toward doubling, due to the 1:1 ratio between the forme roller 28' and the forme cylinder 07, can be used equally well in printing units 01 configured for newspaper printing, and especially in those for commercial printing.

Figure 7:
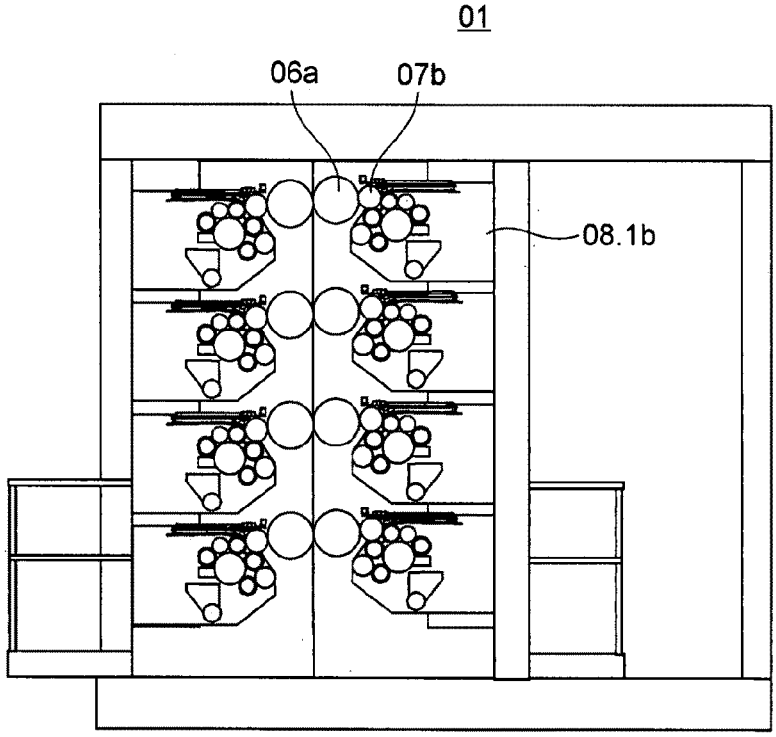
FIG. 7 a second embodiment of the configuration of a printing unit.

Advantageously, for inking units 08.*x* of the same type x, different embodiments can be provided for the respective different formats of the forme cylinder 07*a*; 07*b*, as indicated in FIG. 4. In addition to the modular use of different inking unit technologies, the different formats can then also be operated in a modular fashion. The inking units 08.*x* of the same type are then advantageously constructed in the same manner, but differ from one another, optionally, in their geometric orientation overall, or at least in the geometric orientation of the forme rollers 28; 28'. Thus, depending upon the forme cylinder 07*a*; 07*b*, either the short inking unit 08.1*a*, FIG. 2 or the short inking unit 08.1*b*, FIG. 7 is to be used. If a differentiation is made between more than two circumferential formats for the forme cylinder 07 that can be distinguished from one another, then there can be a corresponding number of embodiments for inking units 08 of the same type. What is essential here is that at least the actuated components, either rotationally or axially assume the same position at least in relation to one another, at least for the different inking unit formats of the same type.

The side frames 11; 12 for a plurality of inking units 08 of the same type and/or different types advantageously have the same base that supports the inking unit 08, and the same recess or stops. However, they can also be configured in terms of their shape such that they are capable of accommodating multiple inking units 08 of the same type and/or of different types. In addition, suspension edges or bearing surfaces that can be used for different inking units 08, or multiple different suspension edges/bearing surfaces at the same time, each configured to work with different inking units 08, can be prepared in the side frame 11; 12 after manufacture.

By way of example, in FIG. 5 one cross member 23 is shown per printing group 04, on which the respective inking unit 08 can be seated or suspended. In addition, or as an alternative, in the mounted state, the inking units 08 can be stacked one above another, and/or additionally secured or fastened to the vertical pillars.

As is already represented in FIGS. 2 and 3, the printing unit 01, for example for newspaper printing, is equipped in an advantageous first embodiment with short inking units 08.1, FIG. 6*a*. Because the forme cylinder 07*a* is implemented there in double format, the printing unit 01 is equipped, for example, with the corresponding short inking units 08.1*a*. In this, the printing and inking units 04; 08 are configured for "dry offset" or "waterless offset printing", i.e. the configuration of the printing forme and the inking unit 08 is such that no dampening agent and thus no dampening unit 09 are provided.

FIG. 7 shows, in a second embodiment, for example for newspaper printing, the loading of the printing unit 01 in dry offset printing with short inking units 08.1*b* for the case of a single-sized forme cylinder 07*b*.

Figure 8:
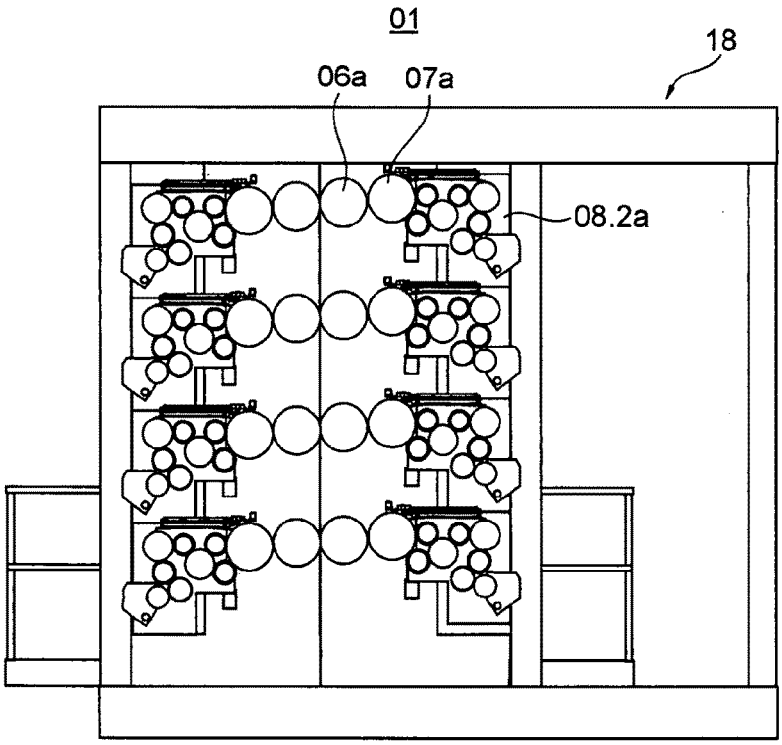
FIG. 8 a third embodiment of the configuration of a printing unit.
Figure 9:
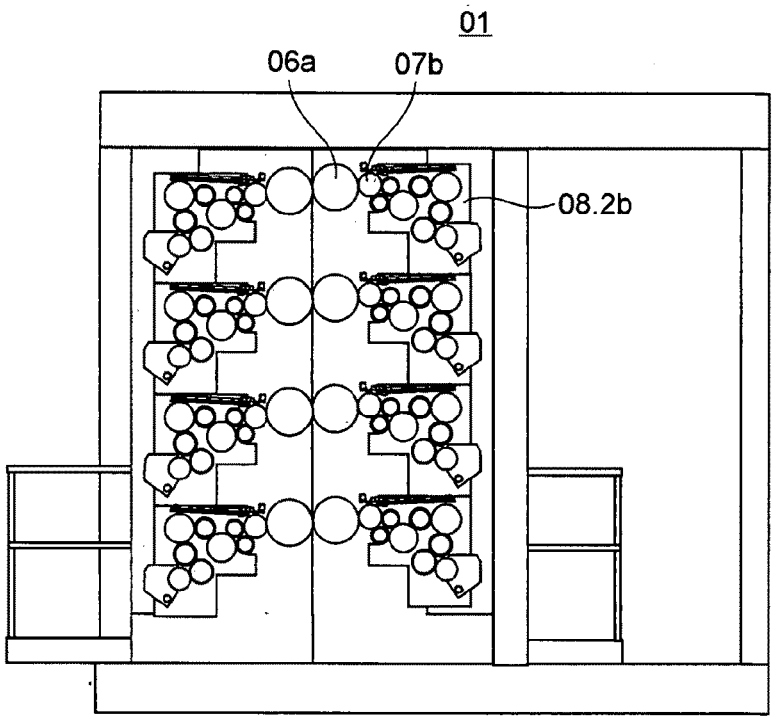
FIG. 9 a fourth embodiment of the configuration of a printing unit.

FIG. 8 and FIG. 9 show the printing unit 01, for example for newspaper printing, in a third and a fourth embodiment, respectively, loaded with single-train roller inking units 08.2*a*; 08.2*b*—one with double-sized forme cylinders 07*a* and in the second case with single-sized forme cylinders 07*b*, each for dry offset printing.

Figure 10:
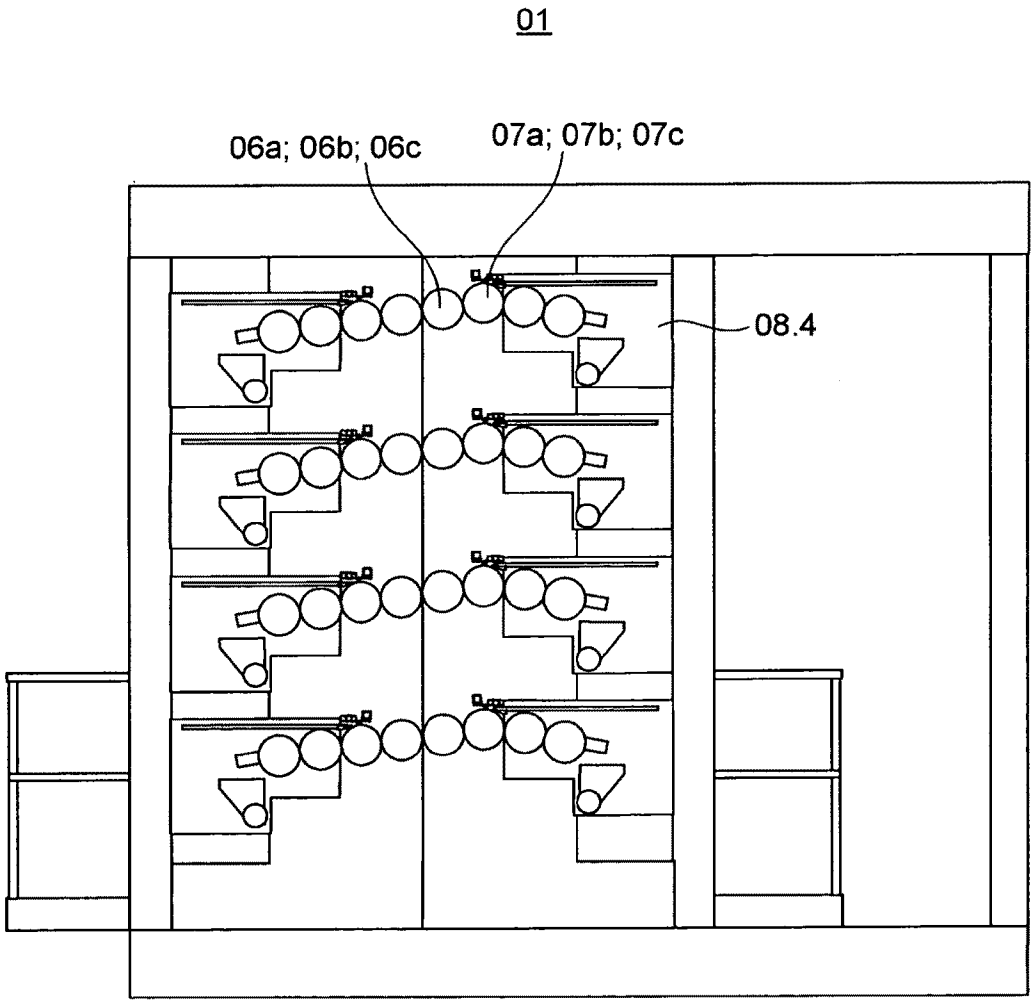
FIG. 10 a fifth, sixth and seventh embodiment of the configuration of a printing unit.

FIG. 10 shows the printing unit 01, alternatively intended for newspaper printing or for commercial printing, but indicated here in a shared representation, in fifth, sixth and seventh embodiments, equipped with the second variant of the short inking units 08.4—with double-sized forme cylinders 07*a*, with single-sized forme cylinders 07*b*, or with a forme cylinder 07*c*, described below, for commercial printing, each in a dry offset printing process. The forme roller 28', FIG. 6*d* in each case preferably has the circumference of the allocated forme cylinder 07*a*; 07*b*; 07*c*.

In addition to the embodiments for dry offset printing described thus far, the embodiment of printing groups 04 operated in "wet offset printing" is also advantageously provided in the modular concept. In other words, in addition to ink, dampening agent is also supplied to the printing forme via a dampening unit 09, strictly separated from the inking unit 08, or connected in parallel via a stripper roller to the inking unit 08.

Figure 11:
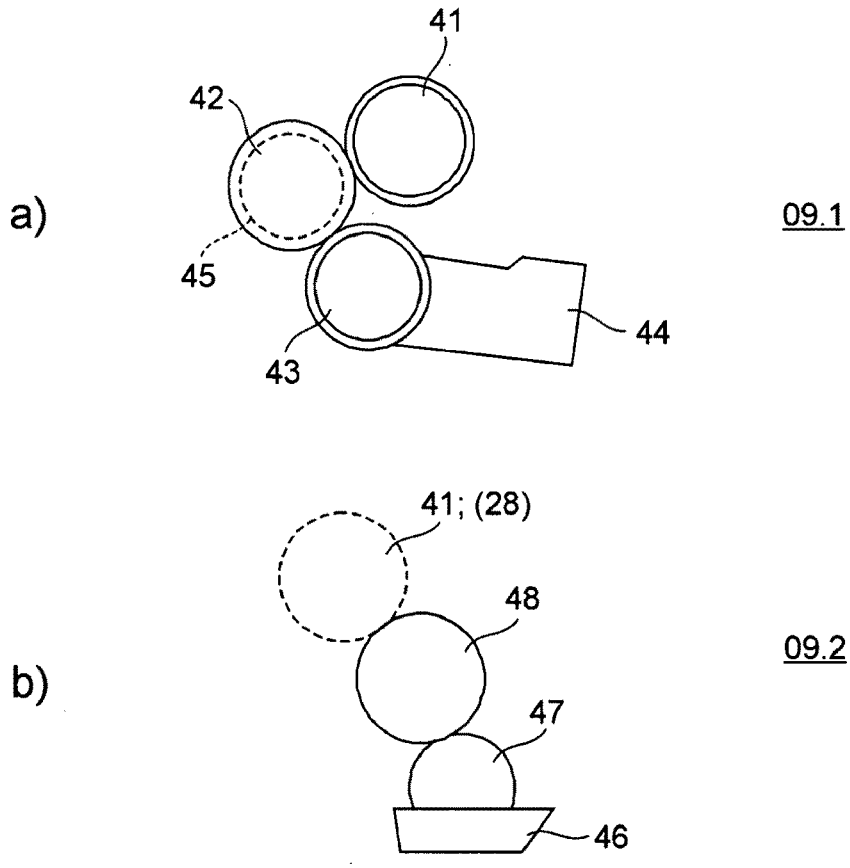
FIG. 11 various examples of modular dampening units.

In FIG. 4 and FIG. 11 *a*), a first embodiment of the dampening unit 09 is represented by a solid line as the dampening unit 09.1 having at least three rollers 41; 42; 43. Preferably, the dampening unit 09.1 is implemented as a so-called contactless dampening unit 09.1, especially a spray-type dampening unit 09.1, wherein the dampening agent is transferred to a last roller 43 in the dampening unit 09 in a contactless manner from a dampening agent source 44. This can be accomplished, for example, via contactless casting, contactless brushes, or in some other manner, but preferably via spray nozzles in a spray bar 44. If three rollers 41; 42; 43 are present in a row between the spray bar 44 and the forme cylinder 07, without optional rider rollers, then the roller 41 that acts in coordination with the printing forme, for example the forme roller 41, for example a wetting roller 41, is preferably implemented with a soft surface, for example rubber, a subsequent roller 42, preferably configured as an oscillating distribution cylinder 42, is preferably implemented with a hard surface, for example chromium or precious steel, and the roller 43 that in a three-roller dampening unit 09.1 receives the dampening agent from the dampening agent source 44 is preferably implemented with a soft surface, for example rubber. In an alternative four-roller, contactless dampening unit 09, a fourth roller having, for example, a hard surface, which is not illustrated here, follows the soft roller 43, and receives the dampening agent. In this embodiment, the distribution cylinder 42 is preferably rotationally actuated via its own drive motor that is independent from the cylinders 06; 07, wherein the two rollers 41 and 43 are actuated via friction. In an alternative variant, a separate rotational drive motor can also be provided for the roller 43. The oscillating motion of the distribution cylinder 42 can be accomplished via its own drive element, or, as provided for here at reduced expense, by means of a transmission that converts its rotational motion into axial motion.

FIG. 11 *a*), in its representation involving the circle shown by a dashed line, illustrates a particularly advantageous further development of the three-roller dampening unit 09.1 from FIG. 11 *a*), wherein in contrast to the dampening unit 09.1 according to FIG. 11 *a*) the roller 42 is configured with an ink-friendly or oleophilic surface 45, i.e. the contact angle of the wetting with corresponding fluid, especially the ink, is smaller than 90°, for example made of rubber or plastic, for example a polyamide material. Thus, in this embodiment, the circumferential surfaces of all three rollers 41; 42; 43 in the dampening unit 09 are configured with an ink-friendly or oleophilic surface 45, i.e. the contact angle of the wetting with corresponding fluid, especially the ink, is smaller than 90°. In principle, this center roller 42 can be configured as a roller 42 that is secured in an axial direction, in other words it cannot oscillate. Especially for the case in which the roller 42 is configured with a soft surface, especially of rubber, a positive rotational drive for the rollers 41; 42; 43 can be omitted and these can all be actuated merely via the friction of the forme cylinder 07—roller 41 by forme cylinder 07, roller 42 by roller 41, and roller 43 by roller 42. A positive drive provided in connection with FIG. 26 through 30 via a separate drive motor 132 or a drive connection 141 is entirely omitted in this embodiment. None of the rollers 41; 42; 43 has an additional positive rotational drive in addition to the friction. If the roller 42 is configured as an oscillating roller 42, then the forced oscillating motion can be provided either by an expressly provided motorized oscillation drive or by a transmission that converts the rotational motion into axial motion.

In one variant of the embodiment according to FIG. 11 *a*), in the representation involving the circle shown by a dashed line, the center roller 42 of the three rollers 41; 42; 43 in the dampening unit roller train has an ink-friendly surface or circumferential surface 45 made of plastic, for example a polyamide material such as especially Rilsan. In this connection, in one embodiment it can be advantageous for this roller 42 to be positively rotationally actuated via its own drive motor 132, which is mechanically independent of the printing unit cylinders 06; 07, or via a drive connection 141 by the printing group 04 and/or the inking unit 08, see below in reference to FIGS. 26 and 30. If the roller 42 is configured as an oscillating roller 42, then for the forced oscillating motion either a motorized oscillating drive or a transmission that converts the rotational motion into axial motion can again be provided.

A "soft" surface in this connection is understood to mean a surface that is elastic in a radial direction. In other words, it has an elasticity modulus in a radial direction of preferably at most 200 mpa, especially less than or equal to 100 mpa. The roller 43 that receives the dampening agent from the dampening agent source 44 and/or the roller 42 that is arranged in the roller train downstream in the direction toward the forme cylinder 07 preferably has a circumferential surface having a hardness in the range of between 55° and 80° Shore A. The roller 41 that applies the dampening agent to the forme cylinder 07 preferably has a circumferential surface having a hardness that ranges from 25° to 35° Shore A.

Figure 14:
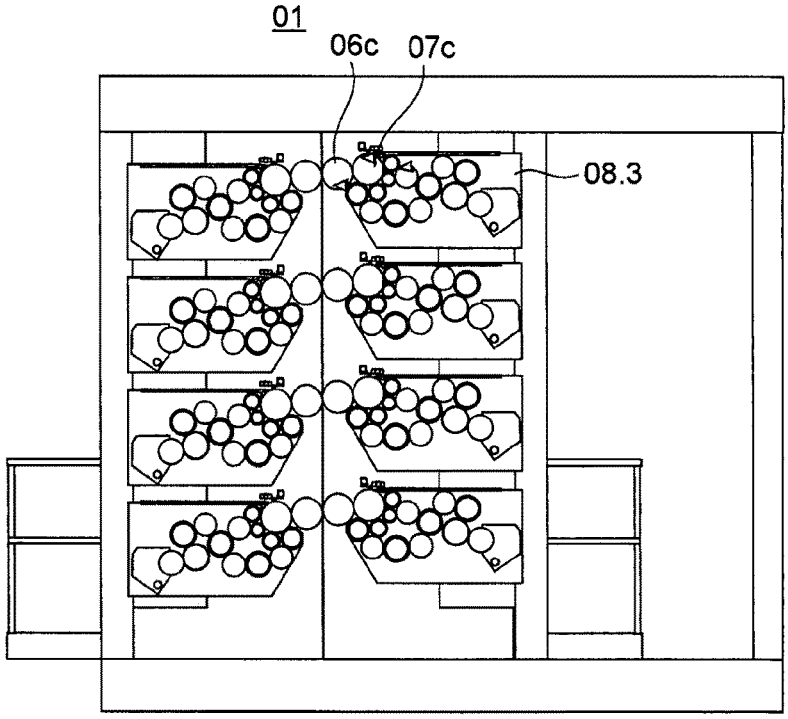
FIG. 14 a tenth embodiment for the configuration of a printing unit.

In FIG. 4 and FIG. 11 *b*) is a second embodiment of the dampening unit 09 as a contact dampening unit 09.2, film dampening unit, vibrator, rag or brush dampening unit having a total of three rollers 47; 48; 41 (28) in a row between the dampening agent receiver 46 and the forme cylinder 07. The dampening unit 09.2 is preferably configured as a so-called film dampening unit 09.2, wherein a last roller 47, which is configured as a dipping roller or a fountain roller 47, dips into the dampening agent receiver 46, for example a dampening agent pan 46, and transfers the dampening agent it takes up via a roller 48, for example an oscillating distribution roller 48, especially with a smooth and hard surface, for example chromium, onto at least one forme roller 41 having a soft surface. The at least one forme roller 41 is indicated here only by a dashed line, as it can be a shared forme roller 28 (41) that is either allocated only to the dampening unit 09, not shown in FIG. 14, or, as illustrated in FIG. 14, is allocated to both the inking and dampening units 08; 09 simultaneously, and, for example, optionally guides only dampening agent, or guides dampening agent and ink. If the dampening unit 09.2, FIG. 11 *b* is configured, as shown here, with a total of three rollers, then the dipping roller 47 is preferably implemented with a soft surface. In an alternative four-roller contact dampening unit 09.2, a fourth roller with, for example, a hard surface, which is not shown here, follows the soft roller 47, and dips into the dampening agent pan 46 in place of the roller 47. Preferably, at least the dipping roller 47 is rotationally actuated by its own drive motor, which is independent from the cylinders 06; 07 and the other inking unit rollers, wherein the roller 41 is actuated via friction. In an advantageous variant, the distribution cylinder 48 can also be provided with its own rotational drive motor. The oscillating motion of the distribution cylinder 48 can be implemented by its own drive element, or as provided here, at reduced expense, by a transmission that converts its rotational motion into axial motion.

The dampening unit 09 can either be implemented as a separate module, or in other words largely preassembled in its own frame, or, in an advantageous embodiment, for use in wet offset printing, it can be integrated into the "inking unit 08" module.

Figure 12:
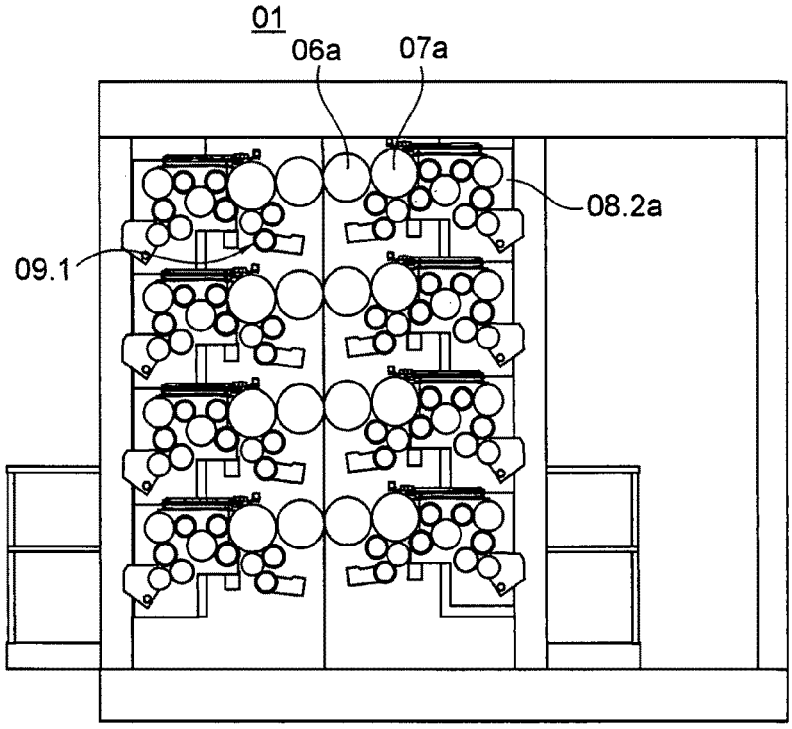
FIG. 12 an eighth embodiment for the configuration of a printing unit.
Figure 13:
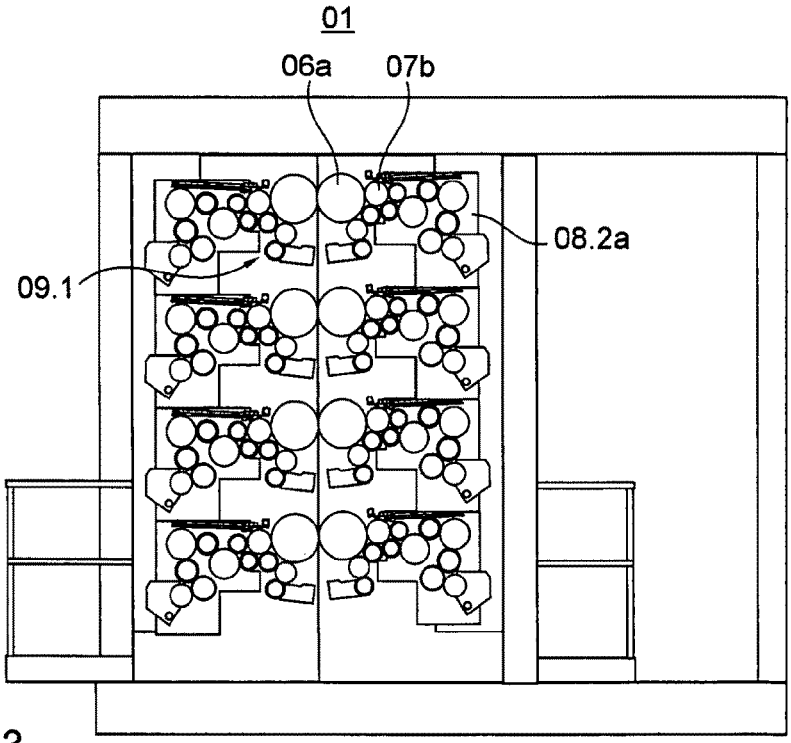
FIG. 13 a ninth embodiment for the configuration of a printing unit.

FIG. 12 and/or FIG. 13 show the printing unit 01, for example for newspaper printing, in eighth and ninth embodiments, equipped with single-train roller inking units 08.2*a*; 08.2*b*—the first case with double-sized forme cylinders 07*a*, FIG. 12 and the second case with single-sized forme cylinders 07*b*, FIG. 13, but, in contrast to FIGS. 8 and 9, in wet offset printing with the arrangement of dampening units 09, in this case, for example, three-roller spray-type dampening units 09.1.

The aforementioned double-sized forme cylinders 07*a*, which have a circumference of two printed pages implemented as newspaper pages, preferably have two channels arranged in tandem in a circumferential direction for the purpose of affixing two printing formes arranged in tandem in a circumferential direction, each the length of one printed page. The two channels, which, in an advantageous embodiment, are continuous in an axial direction, or the two groups of multiple channel segments arranged side by side in an axial direction, and/or the corresponding clamping devices are configured in such a way that at least two separate printing formes, each one or two newspaper pages wide, can be affixed side by side in an axial direction. In one operating configuration, the forme cylinder 07*a* is then implemented with two printing formes in a circumferential direction, each the length of one printed page, and multiple, for example two, three, four, or even six printing formes in a longitudinal direction, each the width of one printed page. Printing formes that are the width of one printed page, or two or even three printed pages, can also be mixed side by side, or only multiple printing formes the width of two or even three printed pages can be arranged side by side on the forme cylinder 07*a*.

The aforementioned single-sized forme cylinders 07*b* having a circumference of one printed page implemented as a newspaper page preferably have, viewed in a circumferential direction, only one channel for affixing the ends of a printing forme having the length of one printed page. The channel, which in the advantageous embodiment is continuous, or a group of multiple channel segments arranged side by side in an axial direction, and/or corresponding clamping devices for this, are configured in such a way that at least two separate printing formes, each the width of one or two newspaper pages, can be affixed side by side in an axial direction. In one operating configuration, the forme cylinder 07*b* is then implemented with one printing forme the length of one printed page, especially a newspaper page, in a circumferential direction, and with multiple printing formes, for example two, three, four, or even six, each the width of at least one printed page, especially the width of a newspaper page, in a longitudinal direction. Printing formes the width of one printed page and the width of two or even three printed pages can also be arranged side by side mixed together, or only multiple printing formes measuring the width of two or even three printed pages can be arranged side by side on the forme cylinder 07*b*.

In a further embodiment, the printing unit 01, in addition to newspaper printing, is also usable for printing a format that differs from newspaper printing and/or for a print quality that deviates from that of newspaper printing. This is reflected, for example, in the printing unit 01 or in the printing groups 04 by a specific embodiment of the inking and/or dampening unit 08; 09, by a specific embodiment of the printing group cylinders 06; 07, by a specific embodiment of the rubber packing, printing formes, rubber printing blankets on the cylinders 06; 07, by a paper web thickness and/or quality that under certain circumstances differs substantially, and/or by a drying stage that is subsequent to the printing process in an advantageous embodiment.

In other words, between newspaper printing and a higher-quality printing, for example customarily referred to as commercial printing, in some cases significant differences can be identified in the implementation and the construction of the printing groups 04. As a rule, web-fed rotary printing presses for newspaper and commercial printing, or their printing units 01, are configured and produced largely independently of one another with respect to side frames 11; 12, cylinder arrangement and/or inking unit structure.

Thus one printing group 04 of this type has forme cylinders 07*c* having only one channel on their circumference which channel is continuous over the barrel length of said forme cylinder 07*c*, and bearing a single printing forme that extends around the full circumference and the entire barrel length. The usable barrel length corresponds, for example, to four, six, or even eight printed pages in a vertical position, for example in DIN A4 format, or a number of pages that corresponds to this length of a different format, side by side in a crosswise direction, and two printed pages of this type, in tandem in a lengthwise direction. The full-circumference printing forme accordingly contains all the printed pages. The transfer cylinder 06*c* also has only one continuous channel, and only a single full-circumference packing, for example a rubber printing blanket, especially one multilayer printing blanket implemented, for example, as a metal printing blanket, which has a dimensionally stable support plate with an elastic layer. A circumference of the forme cylinder 07*c*, and thereby a maximum printing length on the web 02, totals, for example, 520 to 650 mm, especially 545 to 630 mm. The same preferably also applies to the corresponding transfer cylinders 06*c*.

Figure 15:
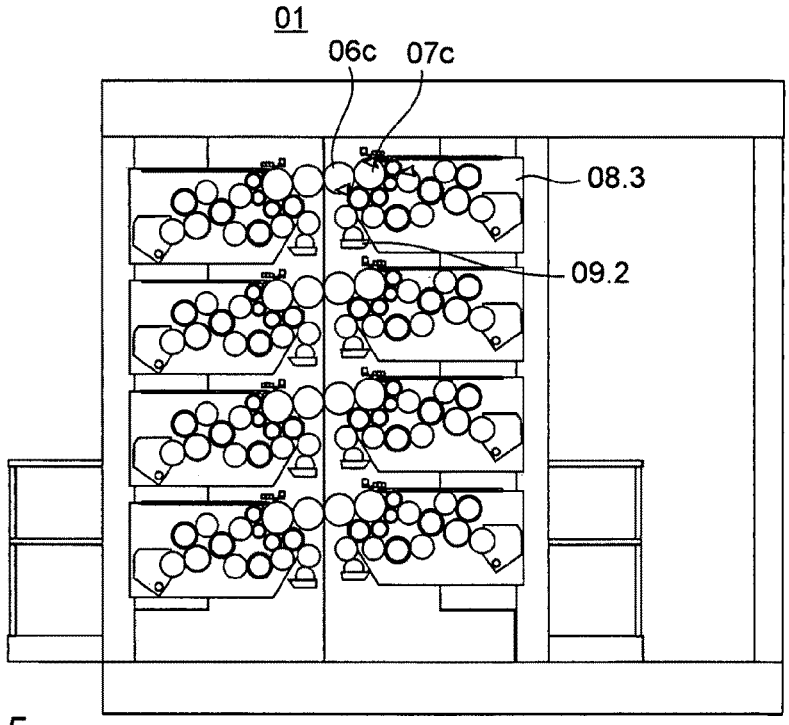
FIG. 15 an eleventh embodiment for the configuration of a printing unit.

FIG. 14 and FIG. 15 now show the printing unit 01, for example for commercial printing, in a tenth and an eleventh embodiment, respectively, equipped with forme cylinders 07*c* for commercial printing, and two-train roller inking units 08.3, one waterless and the second in wet offset printing with an arrangement of dampening units 09.2, here for example with three-roller film units 09.1, wherein their forme roller 41 is simultaneously allocated to the inking unit 08.3, for example as a fourth forme roller 28.

In a twelfth embodiment that is not specifically represented in a separate figure but which is indicated by symbols in parentheses in FIG. 2, the printing unit 01 has short inking units 08.1 or single-train inking units 08.2, as in FIG. 2, which in this case act in coordination with cylinders 06*c*; 07*c* for commercial printing.

The modular construction of the inking units 08 or the printing unit 01 with respect to the inking units 08 makes it possible for the construction of the inking units 08.*x* of a certain type to be the same with the exception of the format-dependent, double, single, commercial, arrangement/embodiment of the forme rollers 28, so that the distribution cylinder diameter of at least one type, with the exception of the inking unit 08.4 can be the same in many or even all formats. If a separate rotational drive is provided for the inking unit 08, a coupling to the cylinders 06; 07 is omitted, which further benefits a modular construction. The drive and transmission can be configured to be independent of format.

The printing units 01 of FIGS. 2, 7 through 10, and 12 through 15 that contain the modules can be advantageously configured, as indicated by the dividing line in FIGS. 2 and 3, to have separated or separable frame panels 11; 12, or in principle also with conventional, closed side frames 11; 12.

Figure 24:
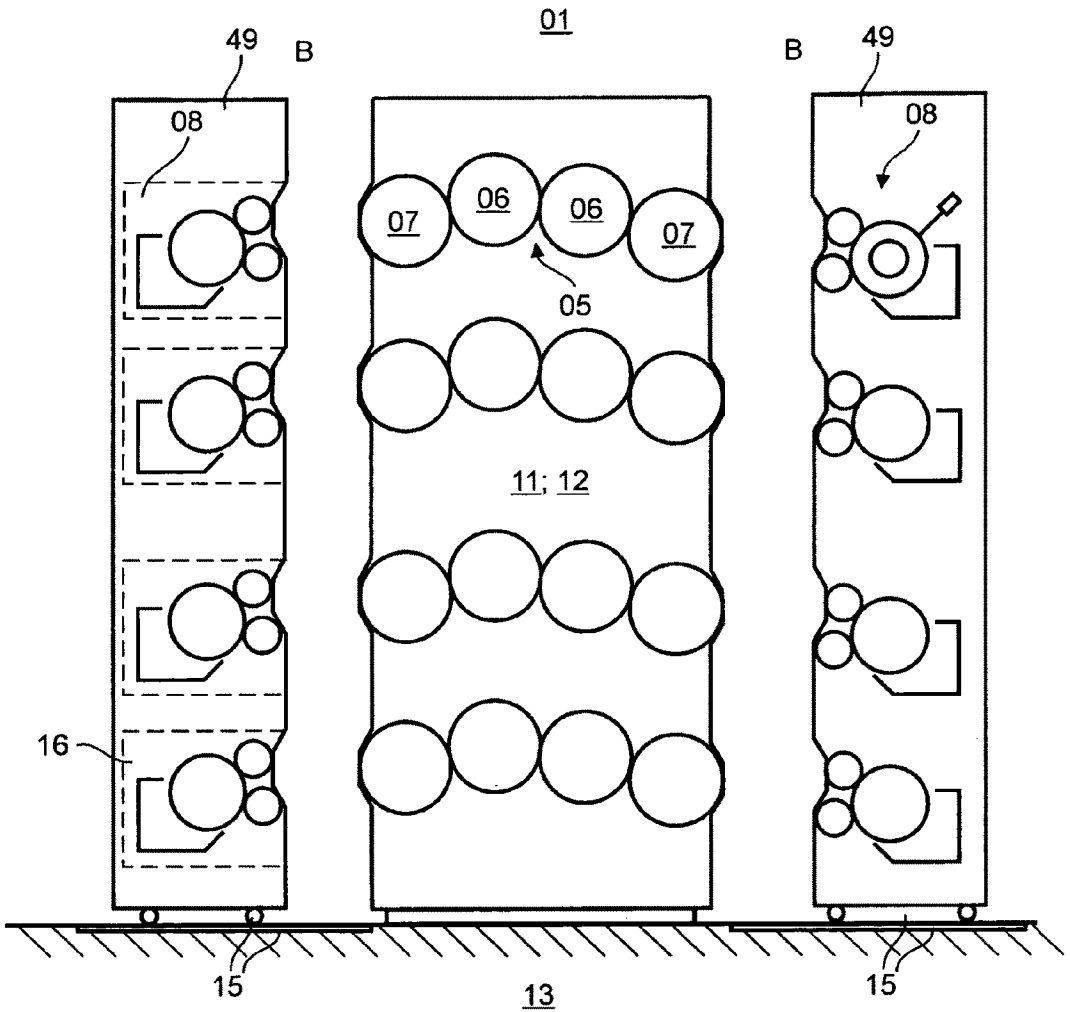
FIG. 24 a variant of a printing unit that can be separated.

In one variant, as seen in FIG. 24 of a separable printing unit 01, the side frame 11; 12 is not separable in such a way that the printing group cylinders 06; 07 are separated at the printing points 05, rather the printing group cylinders 06; 07 are mounted in or on a common side frame such that they cannot be separated, while at both sides panel sections 49 that accommodate the inking units 08 can be placed in an operational position A, which is not shown here or in a maintenance position B, which is shown here. Here, the separation takes place between the forme cylinder 07 and the inking or optionally the dampening units 08, 09. The inking units 08, which are represented here only schematically, and the optional dampening units 09 can be accommodated in the panel sections 49 in the sense of the above-described modular construction as modules, as seen in FIG. 24, left side. As an alternative to this, as shown in FIG. 24 on the right, the structural unit comprised of the inking units 08 and the panel sections 49 is configured overall as a preassembled module. Depending upon the requirements of a client, the center sections, side frame 11; 12 can then be combined with the appropriate cylinder equipment and the side components containing the inking units 08.

As a further module, as already indicated in FIG. 4, and in the printing units 01 of FIGS. 2, 3, 7 through 10 and 12 through 15, a handling device 24, for use in supporting the exchange of printing formes can be provided. In the preferred embodiment, the handling device 24 is implemented as an at least partially automated or even fully automated printing forme changer 24.

Figure 16:
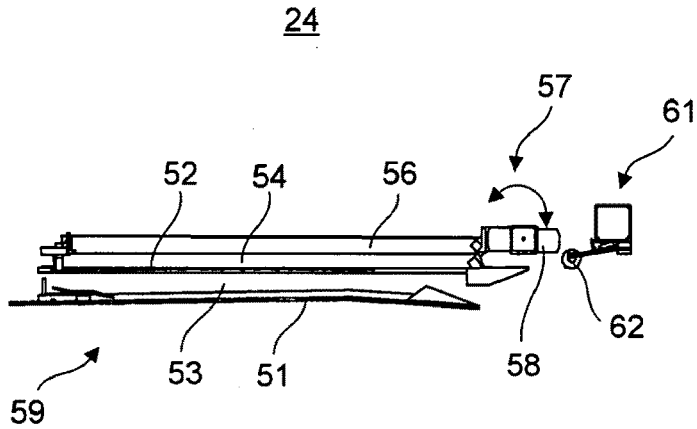
FIG. 16 an embodiment of a modular automatic handling system.

As illustrated in FIG. 16, between a lower guide 51, preferably configured to be flat, brace-like, or frame-like, and an upper guide 52, the handling device 24 has a chute-like receiving area 53 configured to receive printing formes. In a basic arrangement, the receiving area 53 is preferably configured in terms of modularity such that, with respect to space, in principle, at least up to optionally non-structural additional components, both wide printing formes that extend over the length of the barrel and multiple printing formes measuring one or two pages wide and arranged side by side can be accommodated. Non-structural and/or removable additional components could, for example, be lateral guides for center printing formes in the case of multiple printing formes arranged side by side on the forme cylinder 07*a*; 07*b*. The same space conditions advantageously apply to an intake area 54 for printing formes to be newly plated. This can be bordered by the upper guide 52 and optionally by a cover 56, either flat or braced, also chute-like toward the top, and optionally covered to prevent contamination. The guide 52 that supports the new printing formes should preferably be flat or at least braced in such a way that the printing forme will not bend in any way. The handling device 24 is preferably equipped with a lateral register device 57, which, in one embodiment, has only one lateral stop 58, for example lateral stops 58 for a single continuous printing forme, and in another embodiment has multiple stops 58 spaced axially from one another for multiple printing formes to be arranged side by side. Ideally, the lateral register device 57 is structured such that in one operating position a number n, and in another operating position a number m of lateral stops 58, wherein n>m and m=1, 2, 3, . . . can be placed in the infeed path of the printing forme(s). In another embodiment, in different operating positions, although the same number n of lateral stops 58 can be placed in the infeed path, these are spaced from one another in a manner that differs from those of the first position, in other words they are provided for another printing forme width or printing page width. In a third embodiment, in one operating configuration generally only one lateral stop 58, for the commercial printing forme and in another operating configuration a defined number n, can be placed in the infeed path.

The part of the handling device 24 that comprises the receiving area 53, the intake area 54 and the lateral register device 57 is preferably implemented as a preassembled module or component part, hereinafter referred to as the magazine 59, which can be installed as a complete unit, based upon equipment requirements for the printing machine, into the printing unit 01. This magazine 59 preferably has a drive mechanism that is not illustrated here, for example one or more sliding frames or belt conveyors, and a corresponding control for the purpose of conveying the printing formes to be plated off and on, and enables a fully automatic printing forme change. In principle this magazine 59 can also have elements for pressing and/or guiding the printing formes during the change, for example adjustable rollers. Preferably, however, the handling device 24 is modular in construction, wherein on one side the magazine 59, which enables a fully automatic printing forme change, is provided, and on the other side a pressing device 61 with rollers 62 that are adjustable, for example via elements actuated with pressure medium, is provided. The pressing device 61 alone supports both a fully automatic printing forme change with the magazine 59 and a semiautomatic, or partially manual printing forme change without the magazine 59, and, in contrast to the magazine 59, is preferably provided in principle in the printing unit 01.

Figure 17:
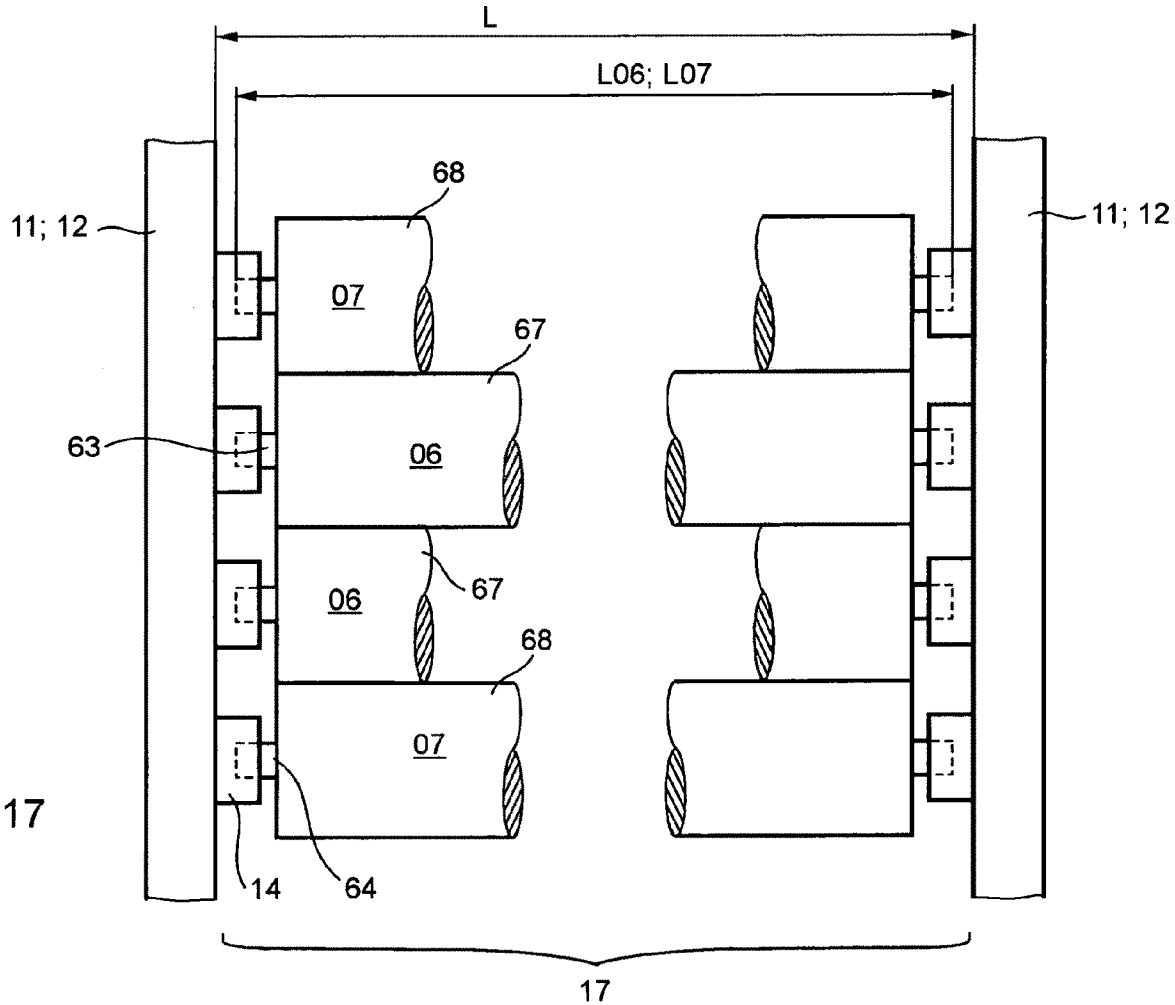
FIG. 17 a plan view of a blanket-to-blanket printing unit.

First, independently of the described modular construction and/or the separability of the side frame 11; 12, in one advantageous embodiment of the printing unit 01 it is provided for the cylinders 06; 07 to be rotatably mounted in bearing units 14 on the side frames 11; 12, which do not penetrate the alignment of the side frames 11; 12, and/or the cylinders 06; 07 with their barrels 67; 68, including their journals 63; 64, have a length L06; L07, which is smaller than, or equal to an inside width L between the side frames 11; 12 that support the printing unit cylinders 06; 07 at both end surfaces, as seen in FIG. 17. The side frames 11; 12 that support the printing unit cylinders 06; 07 at both end surfaces are preferably not side frames that are open at the sides such that the cylinders 06; 07 can be removed axially. Rather, they are side frames 11; 12 that in an axial direction overlap the end surface of the mounted cylinder 06; 07 at least partially, in other words the cylinder 06; 07, especially its bearing, see below, is at least partially enclosed at the end surface by the two side frames 11; 12.

Preferably, each of the four printing group cylinders 06; 07, but at least three has its own bearing unit 14, into which the on/off adjustment mechanism is already integrated. Bearing units 14 that have the on/off adjustment mechanism can also be provided for three of the four cylinders 06; 07, while bearing units without the on/off adjustment mechanism are provided for the fourth.

Figure 18:
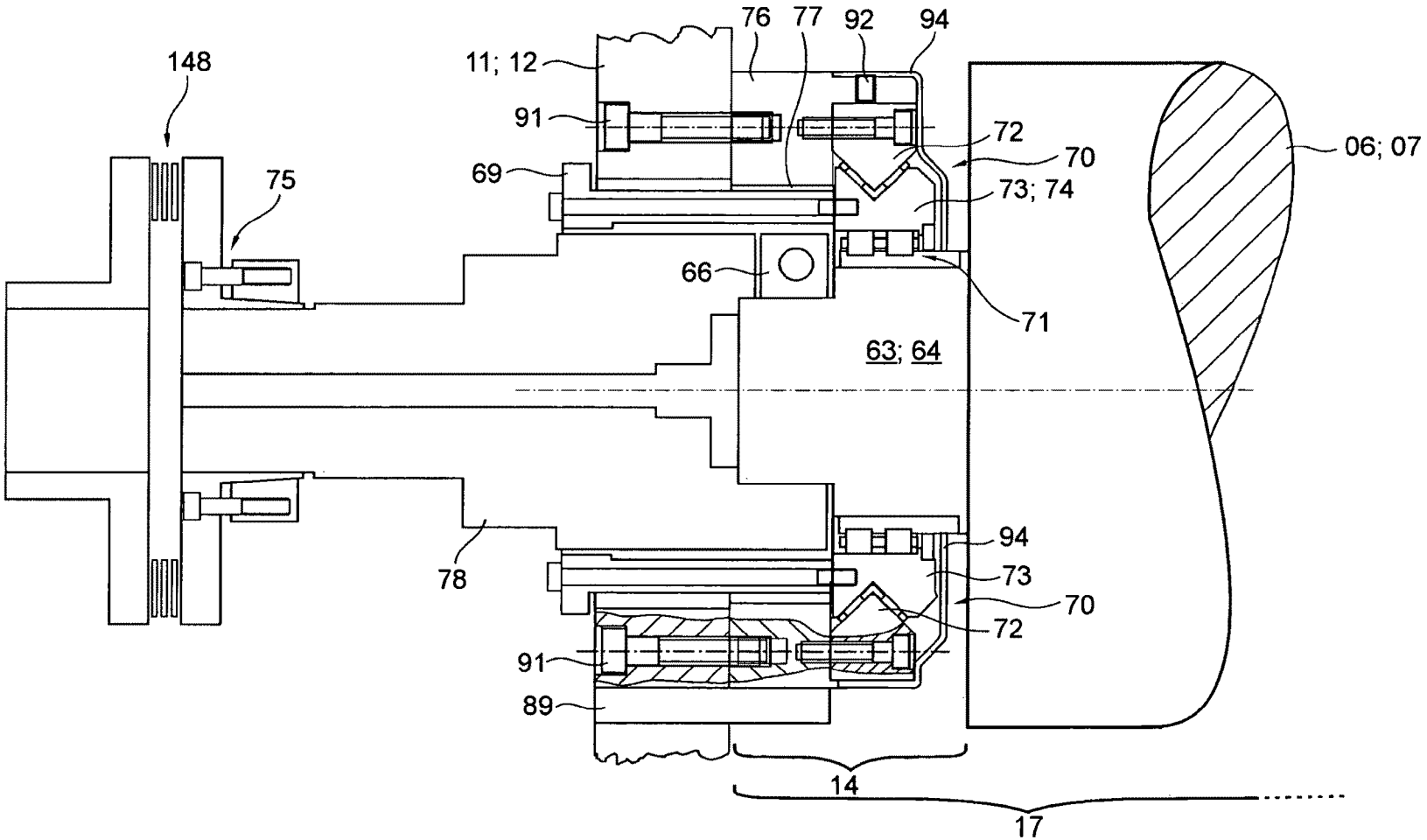
FIG. 18 a schematic longitudinal section of a bearing unit.
Figure 19:
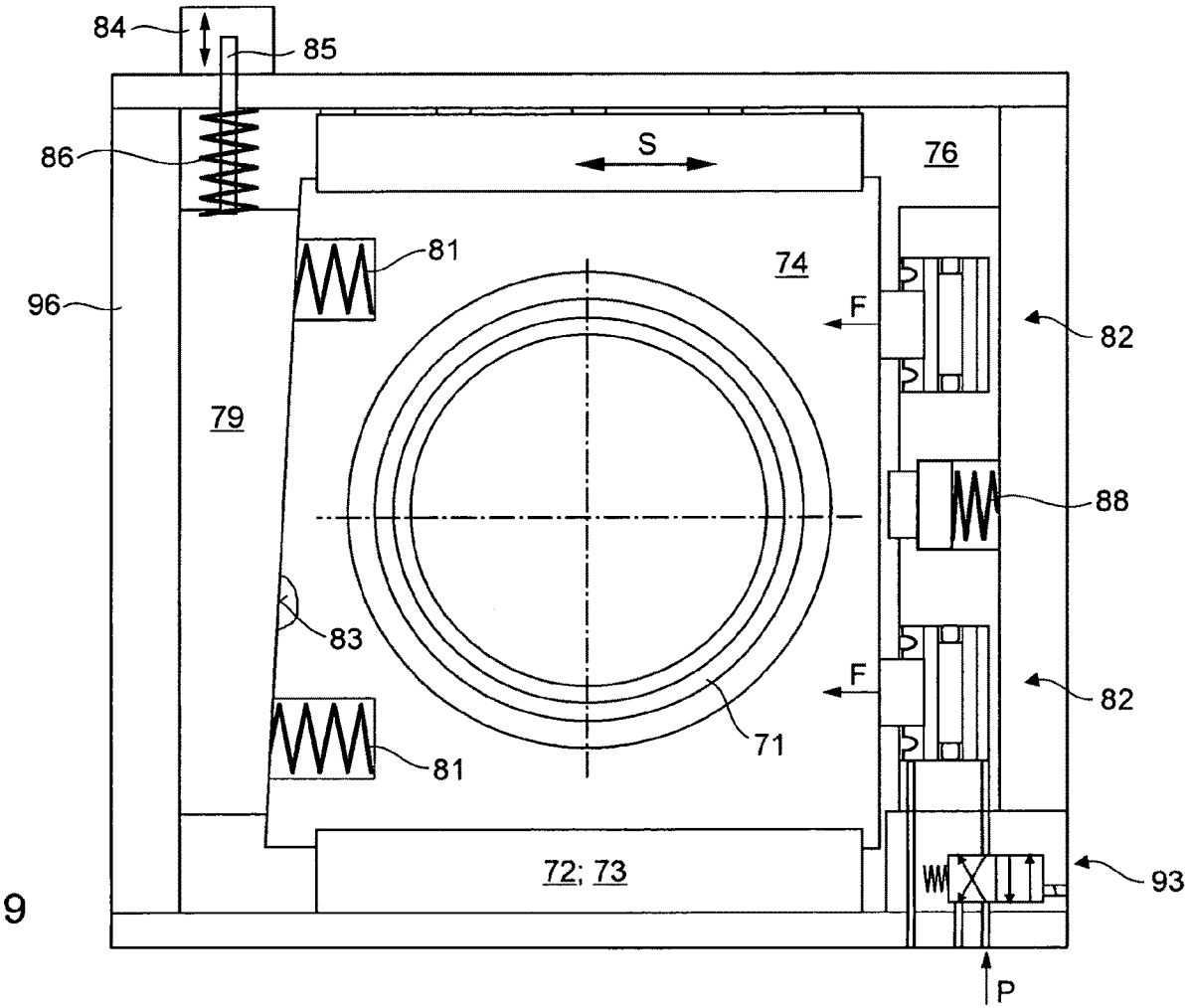
FIG. 19 a schematic cross-section of a bearing unit.

FIGS. 18 and 19 show a bearing unit 14, preferably based upon linear adjustment paths, in schematic longitudinal and cross sections. The bearing unit 14 into which the on/off adjustment mechanism is integrated, in addition to a bearing 71, for example a radial bearing 71, such as a cylindrical roller bearing 71, for the rotational mounting of the cylinder 06; 07, also has bearing elements 72; 73 which are configured to allow the radial movement of the cylinder 06; 07, for adjustment to the print-on or print-off position. In addition, the bearing unit 14 has bearing elements 72 fixed on the support or fixed on the frame once the bearing unit 14 is mounted, and bearing elements 73 that can be moved in relation to these. The bearing elements that are fixed on the support and those that are movable 72; 73 are configured as interacting linear elements 72; 73 and, together with corresponding sliding surfaces or roller elements positioned between them, as linear bearings 70. The linear elements 72; 73 accommodate in pairs a bearing block 74 between them, for example a sliding frame 74, which accommodates the radial bearing 71. The bearing block 74 and the movable bearing elements 73 can also be configured as a single piece. The bearing elements 72 fixed to the support are arranged on a support 76, which will be or is connected as a unit to the side frame 11; 12. For example, the support 76 is implemented as a mounting plate 76, which has, for example, at least on a drive side, a recess 77 for the penetration of a shaft 78, for example a drive shaft 78 for a cylinder journal 63; 64, which is not illustrated in FIG. 19. The frame panel 11; 12 on the drive side is also preferably equipped with a recess or an opening for a drive shaft 78. On the end surface opposite the drive side, it is not essential to provide a recess 77 or an opening in the side frame 12; 11.

Preferably, a length of the linear bearing 70, especially at least a length of the bearing element 72 that in its mounted state is fixed to the frame, is smaller than a diameter of the allocated printing group cylinder 06; 07, viewed in the direction of adjustment S.

The coupling of the cylinder 06; 07 or the bearing block 74 on a drive side of the printing unit 01 to a drive, for example to a drive motor 121 and/or to a drive train 122 or transmission 150, as described in reference to FIG. 26 through 30, is accomplished as illustrated by way of example in FIG. 18 via the shaft 78, which at its end that is near the cylinder encompasses an end of the journal 63; 64, and is connected, for example, without torsion via a clamping device 66 to the journal 63; 64. The clamping device 66 in this case is configured, for example, as a partially slotted hollow shaft end, which encompasses the journal end, or journal 63; 64 and can be drawn together by the use of a screw connection in such a manner that a non-positive, non-rotatable connection between the journal end, or journal 63; 64 and the inner surface of the hollow shaft can be created. The coupling can also be implemented in another manner, for example using a form closure in a circumferential direction. The shaft 78 passes through an opening in the side frame 11; 12, which is sufficiently large in dimension for the movement of the shaft 78 together with the bearing block 74, and which is configured, for example, as an elongated hole. A cover 69 with a collar that overlaps the elongated hole, and which is connected, for example, to the bearing block 74 but not to the shaft 78, can be provided as protection against contamination.

At the end of the shaft 78 that is distant from the cylinder, as illustrated in FIG. 18, one coupling 148 of optionally many arranged in series, especially a multi-disk coupling 148, see the discussion in reference to FIG. 26 through 29 can be coupled by use of a non-rotatable connection 75, for example a clamping element 75. In another embodiment, as described in reference to the further development of FIG. 30, the transmission 150 with the drive motor 121 can be coupled directly to the shaft 78 without a coupling 148 configured to compensate for angle and/or offset. In this embodiment, the drive motor 121 is not fixed to the frame, rather it is arranged fixed to the cylinder, and is moved along with the cylinder 06; 07.

Figure 36:
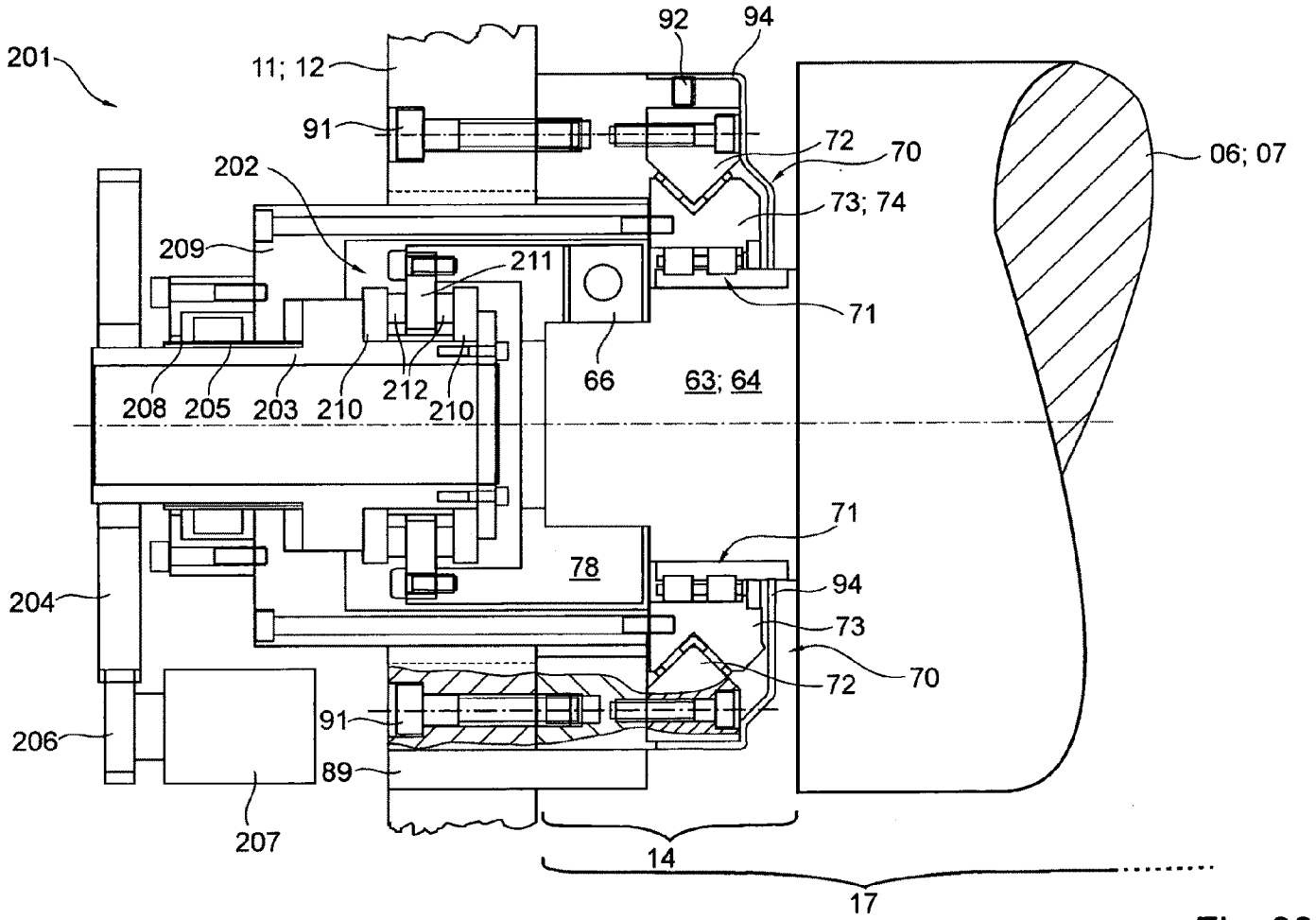
FIG. 36 a coupling of a cylinder to a lateral register drive.

On a side of the cylinder 06; 07 that is opposite the drive side, especially the cylinder 07 that is configured as a forme cylinder 07, the journal 64 is preferably coupled with a device for axially moving the cylinder 07; i.e. with a lateral register drive 201 (FIG. 36). The shaft 78, which is connected to the journal 63; 64, for example, in the manner shown in FIG. 18, is connected via a bearing 202, for example an axial bearing 202 with an axial drive 203, 204, 206, 207. The axial drive comprises a spindle 203, especially with at least one threaded section 205, a spur gear 204 that is non-rotatably connected to the spindle 203, a sprocket 206, and a motor 207 that drives said sprocket 206. The threaded section 205 acts in coordination with internal threading 208 that is fixed on the bearing block, for example internal threading 208 of a pot 209 that is connected to the bearing block 74, and, with the rotation of the spindle 203, effects an axial movement of the same, along with the shaft 78, via the axial bearing 202 and the journal 63; 64. The axial bearing 202 permits relative rotation between the shaft 78 and the spindle 203, but is configured to be rigid to compression and tension in relation to an axial direction of the cylinder 07. This is accomplished by the use of a disk 211 arranged on the shaft 78, which is mounted on both sides, for example, via rolling elements 212, and is limited in its travel in both directions by stops 210 that are fixed to the spindle. An adjustment of the lateral register is accomplished with the motor 207, via a control device that is not illustrated here. In this, either the motor 207 can be equipped with a position reset indicator internal to the motor, for example appropriately calibrated beforehand, or a position reset message can be sent to the control unit by a sensor that is not illustrated here, for example a correspondingly calibrated rotary potentiometer, which is coupled to a rotational component of the axial drive.

The configuration of the linear bearing 70 in such a manner that both of the interacting bearing elements 72; 73 are provided on the bearing unit 14 component, and not a part on the side frame 11; 12 of the printing unit 01, enables a preassembly and a prealignment or adjustment of the bearing tension. The advantageous arrangement of the two linear bearings 70 that encompass the bearing block 74 enables an adjustment free from play, since the two linear bearings 70 are arranged opposite one another in such a way that the bearing pretension and the bearing forces encounter or accommodate a significant component in a direction that is perpendicular to the rotational axis of the cylinder 06; 07. The linear bearings 70 can therefore be adjusted in the same direction as the play-free adjustment of the cylinder 06; 07.

Because the cylinders 06; 07 along with the journal 63; 64 and bearing unit 14 do not penetrate through the frame panel 11; 12, these can be installed already preassembled, with the bearings, both radial bearings 71 and linear bearings 70 preadjusted or correctly pre-stressed, as a modular cylinder unit 17 into the printing unit 01. The phrase "do not penetrate through" and the above definition with respect to the inside width L are also advantageously understood to mean that, at least in the area of the provided end position of the cylinder 06; 07, and at least on a continuous path from a frame edge to the point of the end position, a "non-penetration" of this type is present, so that the cylinder unit 17 can be moved to approach the end position from an open side that lies between the two end-surface side frames 11; 12, without tipping, in other words in a position in which the rotational axis is perpendicular to the plane of the frame, and can be arranged there between the two inner panels of the frame, especially it can be fastened to the inner panels of the frame. This is also possible if cast pieces or other elevated areas are present on the inner surface, as long as the aforementioned continuous assembly path is provided.

The bearing units 14 are arranged on the inner panels of the side frame 11; 12 in such a manner that the cylinders 06; 07, especially their bearing units 14 on the side distant from the cylinder, are protected by the side frame 11; 12, which provides static and installation advantages.

Figure 42:
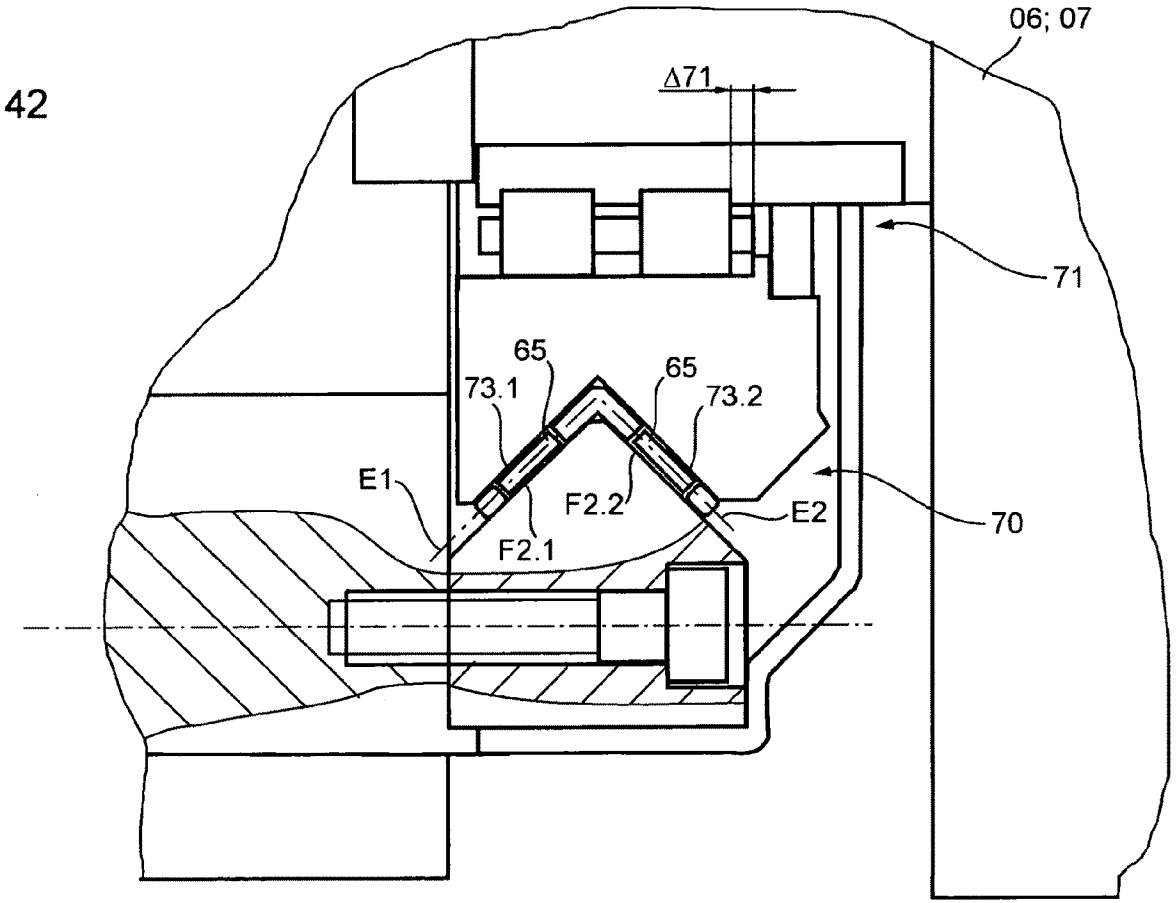
FIG. 42 an enlarged representation of the linear bearing of FIG. 18 or FIG. 36.

The linear bearings 70, 72, 73 identifiable in FIGS. 18 and 19 thus each have pairs of corresponding, coordinating bearing elements 72 and 73 or their guide or active surfaces, configured as sliding surfaces, not shown or with rolling elements 65 arranged between them. As shown in FIG. 42, in the preferred embodiment at least one of the two, and advantageously both, linear bearings 70 of a bearing unit 14 are configured such that the two corresponding bearing elements 72 and 73 each have at least two guide surfaces 72.1; 72.2; 73.1; 73.2, which lie in two planes inclined relative to one another. The two guide surfaces 72.1; 72.2; 73.1; 73.2, or their planes E1; E2 of the same bearing element 72; 73 are, for example, v-shaped relative to one another, for example they are inclined at an angle of between 30 and 60° relative to one another, especially between 40 and 50°. In this, the two guide surfaces 73.1; 73.2; 72.1; 72.2 of the cooperating bearing element 73; 72 are inclined relative to one another in a manner that complements their shape. At least one of the two pairs of cooperating guide surfaces 72.1; 72.2; 73.1; 73.2 lies parallel to a plane E1, which has a component that is not equal to zero in the radial direction of the cylindrical axis, and thereby suppresses the degree of freedom of movement in a purely axial direction of the cylinder. Preferably, both pairs lie at the planes E1; E2, both of which have a component that is not equal to zero in the radial direction of the cylindrical axis, but in the reverse inclination have one that is against the cylindrical axis, thereby suppressing the degree of freedom of movement in both axial directions of the cylinder. A line of intersection of the two planes E1; E2 runs parallel to the direction of adjustment S.

If, as is apparent in FIG. 18, the bearing block 74 is bordered between the two linear bearings 70, each of which has two pairs of cooperating guide surfaces 72.1; 73.1 and 72.2; 73.2, especially if it is prestressed with a level of pre-tension, then the bearing block 74 has only a single degree of freedom of movement along the direction of adjustment S.

The inclined active or guide surfaces 72.1; 72.2; 73.1; 73.2 are arranged such that they counteract a relative movement of the bearing parts of the linear bearing 70 in an axial direction of the cylinder 06; 07, in other words the bearing is "set" in an axial direction.

The linear bearings 70 of both bearing units 14 allocated at the end surface of a cylinder 06; 07 preferably have two pairs of cooperating guide surfaces 72.1; 72.2; 73.1; 73.2 arranged in this manner in relation to one another. In this case, however, at least one of the two radial bearings 71 of the two bearing units 14 advantageously has a slight bearing clearance Δ71 in an axial direction.

In FIGS. 18 and 42, the guide surfaces 72.1; 72.2 of the bearing elements 72 that are fixed to the frame point the linear guide 70 in the half-space that faces the journal 63; 64. In this case, the bearing elements 72 that are fixed to the frame wrap around the bearing block 74, which is arranged between them. The guide surfaces 72.1; 72.2 of the two linear bearings 70, which are fixed to the frame, thus wrap partially around the guide surfaces 73.1; 73.2 of the bearing block 74 relative to an axial direction of the cylinder 06; 07.

For the correct placement of the bearing units 14, or the cylinder units 17 including the bearing unit 14, mounting aids 89, for example alignment pins 89, can be provided in the side frame 11; 12, on which the bearing unit 14 of the fully assembled cylinder unit 17 is aligned before these aids are connected to the side frame 11; 12 via separable connecting elements 91, such as screws 91, or even with adhesive force via welding. For the adjustment of the bearing pre-stress in the linear bearings 70, which is to be performed already prior to installation in the printing unit 01 and/or to be readjusted after installation, appropriate elements 92, for example adjustment screws 92, can be provided, as seen in FIG. 18. The bearing unit 14, at least toward the cylinder side, is preferably largely protected against contamination by a cover 94, or is even implemented completely encapsulated as a structural unit.

In FIG. 18 the cylinder 06; 07 with the journal 63; 64 and a preassembled bearing unit 14 is schematically characterized. This component group can be easily installed thus, preassembled, between the side frames 11; 12 of the printing unit 01, and can be fastened at points designated for this purpose. Preferably, for a modular construction, the bearing units 14 for the forme and transfer cylinders 07; 06, optionally up to the permitted operational size of the adjustment path are configured to have the same construction. With the embodiment that can be reassembled, the active inner surface of the radial bearing 71 and the active outer circumferential surface of the journal 63; 64 can be cylindrical rather than conical in structure, as both the mounting of the bearing unit 14 on the journal 63; 64 and the adjustment of the bearing clearance can be performed outside of the printing unit 01. For example, the bearing unit 14 can be shrunk to fit.

The structural unit that can be mounted as a complete unit, i.e. bearing unit 14 is advantageous in the form of a housing that is optionally partially open from, for example, the support 76, and/or, for example, from a frame, in FIG. 19, without reference symbols, for example, the four plates that border the bearing unit 14 toward the outside on all four sides and/or, for example, from the cover 94 (FIG. 18). The bearing block 74 having the radial bearing 71, the linear guides 70, and in one advantageous embodiment, for example, the actuator 82 or the actuators 82 are accommodated inside this housing or this frame.

The bearing elements 72 that are fixed to the frame are arranged essentially parallel to one another and define a direction of adjustment, as seen in FIG. 19.

An adjustment to a print-on position is accomplished by moving the bearing block 74 in the direction of the printing point by the use of a force F that is applied to the bearing block 74 by at least one actuator 82, especially by an actuator 82 that is power-controlled or that is defined by a force, and can apply a defined or definable force F to the bearing block 74 in the print-on direction to accomplish adjustment to the on position, FIG. 19. The linear force at the nip points, which is decisive for ink transfer and thus for print quality, among other factors, is thus defined not by an adjustment path, but by the equilibrium of forces between the force F and the linear force $F_L$ that results between the cylinders 06; 07, and the resulting equilibrium. In a first embodiment, which is not shown separately, cylinders 06; 07 are engaged on one another in pairs, in that the bearing block 74 is acted upon by the correspondingly adjusted force F via the actuator(s) 82. If multiple, for example three or four cylinders 06; 07 that are adjacent to one another in direct sequence, each acting in coordinating pairs, are implemented without a possibility for fixing or limiting the adjustment path S via a purely force-based adjustment mechanism, then although a system that has already been adjusted with respect to the necessary pressures or linear forces can be again correctly adjusted in sequence and in succession, it is possible to implement a basic adjustment only with difficulty, due to the somewhat overlapping reactions.

For adjusting the basic setting of a system, with corresponding packings and the like, it is thus provided, in one advantageous embodiment, that at least the two center cylinders of the four cylinders 06, in other words, at least all the cylinders 06 that differ from the two outer cylinders 07, can be fixed or at least limited in their travel, at least during a period of adjustment to a defined position, advantageously to the position of engagement determined by the equilibrium of forces.

Particularly advantageous is an embodiment in which the bearing block 74, even during its operation, is mounted such that it can move in at least one direction away from the printing point against a force, for example against a spring force, especially a definable force. With this, and in contrast to mere travel limitation, on one hand a maximum linear force is defined by the coordination of the cylinders 06; 07, and on the other hand a yielding is enabled, for example in the case of a web tear associated with a paper jam on the cylinder 06; 07.

On one side that faces the printing point 05, the bearing unit 14, at least during the adjustment process, has a movable stop 79, which stop 79 limits the adjustment path up to the printing point 05. The stop 79 is movable in such a manner that the stop surface 83 that acts as the stop can be varied in at least one area along the direction of adjustment. Thus, in one advantageous embodiment, an adjustment device, or an adjustable stop 79 is provided, by the use of which, the position of an end position of the bearing block 74 that is near the printing point can be adjusted. For travel limitation/adjustment, for example, a wedge drive, described below, is provided. In principle, the stop 79 can be adjusted manually or via an adjustment element 84 implemented as an actuator 84, see below. Further, in one advantageous embodiment, a holding or clamping element, not specifically illustrated in FIGS. 18 and 19, is provided, by the use of which the stop 79 can be secured in the desired position. Further, at least one spring-force element 81, for example a spring element 81, is provided, which exerts a force $F_R$ from the stop 79 on the bearing block 74 in a direction away from the stop. In other words, the spring element 81 effects an adjustment to the print-off position when the movement of the bearing block 74 is not impeded in some other way. An adjustment to the print-on position is accomplished by moving the bearing block 74 in the direction of the stop 79 via at least one actuator 82, and especially a power-controlled actuator 82, by the use of which, a defined or definable force F can optionally be applied to the bearing block 74 in the print-on direction for the purpose of adjustment. If this force F is greater than the restoring force $F_R$ of the spring elements 81, then, with a corresponding spatial configuration, an adjustment of the cylinder 06; 07 in relation to the adjacent cylinder 06; 07 and/or an adjustment of the bearing block 74 in relation to the stop 79 takes place.

In an ideal case, the applied force F, the restoring force $F_R$ and the position of the stop 79 is selected such that between the stop 79 and the stop surface of the bearing block 74, in the adjustment position, no substantial force AF is transferred, and such that, for example, $|\Delta F|<0.1*(F-F_R)$, especially $|\Delta F|<0.05*(F-F_R)$, ideally $|\Delta F|=0$ applies. In this case, the adjustment force between the cylinders 06; 07 is essentially determined from the force F that is applied via the actuators 82. The linear force at the nip points that is decisive for ink transfer and thereby for print quality, among other factors, is thus defined primarily not by an adjustment path, but, in the case of a quasi-free stop 79, by the force F and the resulting equilibrium. In principle, once the basic adjustment has been determined with the forces F necessary for this, a removal of the stop 79 or a corresponding immobilization element that is effective only during the basic adjustment, would be conceivable.

In principle, the actuator 82 can be configured as any actuator 82 that will exert a defined force F. Advantageously, the actuator 82 is configured as a correcting element 82 that can be actuated with pressure medium, especially as pistons 82 that can be moved using a fluid. Advantageously, with respect to a possible tilting, the arrangement involves multiple, in this case two, actuators 82 of this type. A liquid, such as oil or water, is preferably used as the fluid due to its incompressibility.

To actuate the actuators 82, configured in this case as hydraulic pistons 82, a controllable valve 93 is provided in the bearing unit 14. This valve is configured, for example, to be electronically actuatable, and places the hydraulic pistons 82 in one position that is pressureless or at least at a low pressure level, while in another position the pressure P that conditions the force F is present. In addition, for safety purposes, a leakage line, not indicated here, is also provided.

In order to prevent on and off adjustment paths that are too large, while still protecting against web wrap-up, on the side of the bearing block 74 that is distant from the printing points, a travel limitation by a movable, force-limited stop 88 as an overload protection element 88, for example a spring element 88, can be provided, which, in the operational print-off position, in which the pistons 82 are disengaged and/or drawn in, can serve as a stop 88 for the bearing block 74 in the print-off position. In the case of a web wrap-up or other excessive forces from the printing point 05, it will yield and will open up a larger path. A spring force for this overload protection element 88 is therefore selected to be greater than the sum of forces from the spring elements 81. Thus, in operational on/off adjustment, only a very short adjustment path, for example only 1 to 3 mm, can be provided.

In the represented embodiment, as shown in FIG. 19, the stop 79 is implemented as a wedge 79 that can be moved crosswise to the direction of adjustment S, wherein in the movement of this wedge 79, the position of the respective effective stop surface 83 along the direction of adjustment S varies. The wedge 79 is supported, for example, against a stop 96 that is stationarily fixed to the support.

The stop 79, which is configured here as a wedge 79, can be moved by an actuator 84, for example a correcting element 84 that can be actuated with pressure medium, such as a piston 84 that is actuatable with pressure medium, in a working cylinder with dual-action pistons, via a transfer element 85, configured, for example, as a piston rod 85, or by an electric motor via a transfer element 85 configured as a threaded spindle. This actuator 84 can either be active in both directions, or, as illustrated here, configured as a one-way actuator, which, when activated, works against a restoring spring 86. For the aforementioned reasons, largely powerless stop 79 the force of the restoring spring 86 is selected to be weak enough that the wedge 79 is held in its correct position against only the force of gravity or vibration forces.

In principle, the stop 79 can also be implemented in another manner, for example as a ram that can be adjusted and affixed in the direction of adjustment, etc., in such a way that it forms a stop surface 83 for the movement of the bearing block 74 in the direction of the printing point 05, which is variable in the direction of adjustment S and, at least during the adjustment process, can be fixed in place. In an embodiment which is not illustrated here, an adjustment of the stop 79 is implemented, for example, directly parallel to the direction of adjustment S via a drive element, for example a cylinder that is actuatable with pressure medium, with dual-action pistons or an electric motor.

Figure 20:
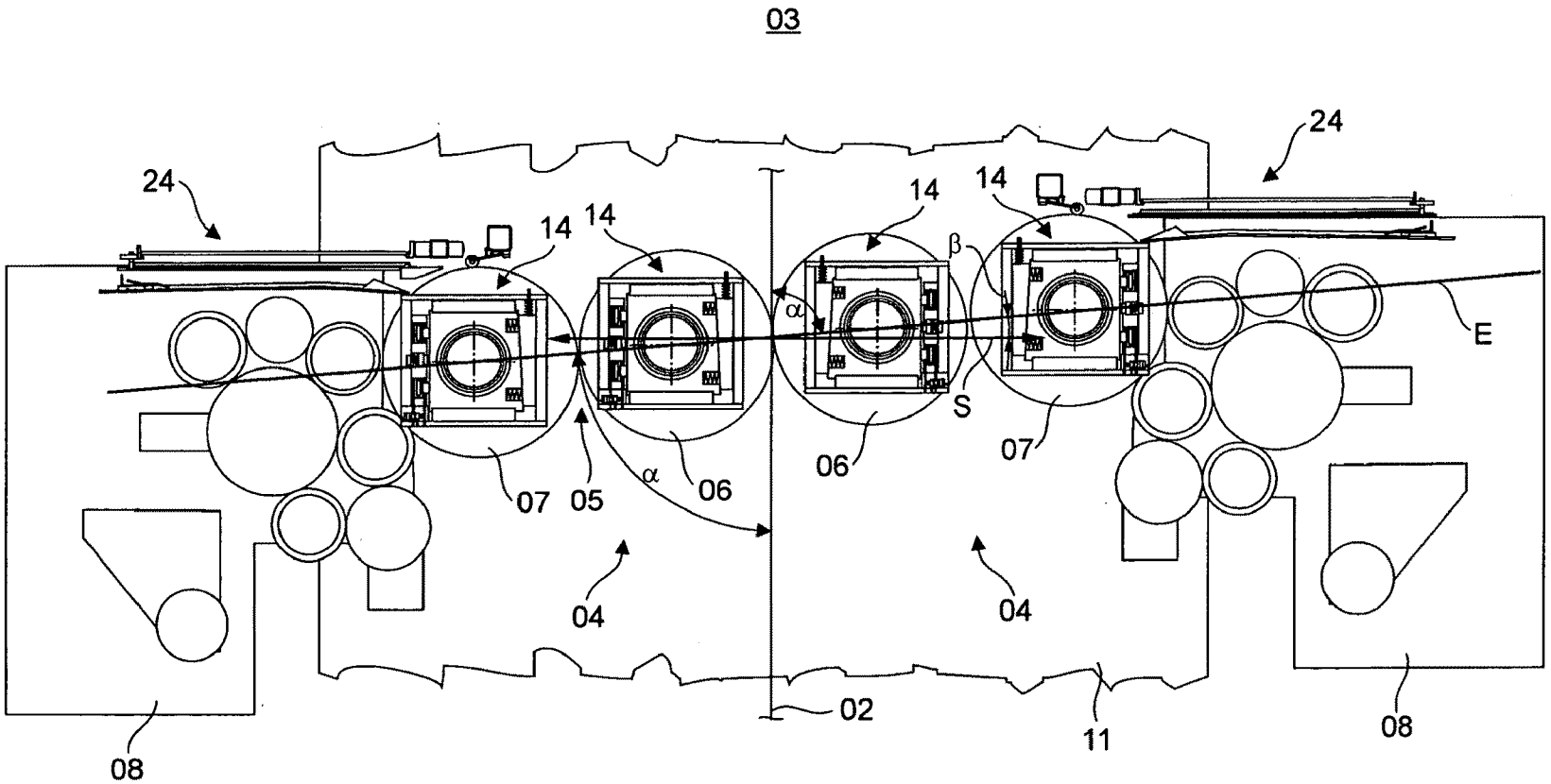
FIG. 20 a first bearing arrangement of a blanket-to-blanket printing unit.

FIG. 20 schematically shows, on the printing unit 03 configured as a blanket-to-blanket printing unit 03, one bearing unit 14 arranged on the side frame 11 for each cylinder 06; 07. In one advantageous embodiment which is illustrated here, in the print-on position the rotational centers of the cylinders 06; 07 form an imaginary line or plane of connection E, hereinafter referred to as the "linear blanket-to-blanket printing unit". The plane E and the entering and exiting web 02 preferably form an interior angle α that deviates from 90°, measuring between 75 and 88°, especially between 80 and 86°. In the mounted state of the embodiment depicted in FIG. 20, the bearing unit 14 of the transfer cylinder 06, especially of all cylinders 06; 07, are arranged on the side frame 11 in such a way that their directions of adjustment S, for example, for the purpose of a power-defined print-on adjustment, as discussed below, form a maximum angle of 15° with the plane of connection E, for example an acute angle β of approximately 2° to 15°, especially 4 to 10°, with one another. This arrangement is of particular advantage with respect to mounting if the direction of adjustment S extends horizontally and the web 02 extends essentially vertically. Each of the bearing units 14 is structured to be shorter in its respective direction of adjustment S than the diameter of the cylinder 06; 07 that is mounted in the respective bearing unit 14. Each side frame 11 of the printing group 04 overlaps the respective cross-section of the cylinders 06; 07 mounted in the bearing units 14.

In a modified embodiment of a blanket-to-blanket printing unit 03 arranged in an angular fashion, n or u printing unit 03, the plane E' is understood as the plane of connection for the cylinders 06 that form the printing points 05, and the plane E" is understood as the plane of connection between the forme and transfer cylinders 07; 06. What is described above in reference to the angle β is referred to the direction of adjustment S for at least one of the cylinders 06 that form the printing points 05, or the forme cylinders 07, and the planes E' or E".

One of the cylinders 06 that form the printing points 05 can also be arranged in the side frame 11; 12 such that it is stationary and functionally non-adjustable, but is optionally adjustable, while the other is mounted such that it is movable along the direction of adjustment S.

A functional adjustment path for adjustment to the on/off positions along the direction of adjustment S between the print-off and print-on positions, for example in the case of the transfer cylinder 06, measures between 0.5 and 3 mm, especially between 0.5 and 1.5 mm, and in the case of the forme cylinder 07 measures between 1 and 5 mm, especially between 1 and 3 mm.

In the embodiment as a linear blanket-to-blanket printing unit 03, the plane E is inclined from the planes of the incoming and outgoing web 02 for example, at an angle α of 75° to 88° or 92 to 105°, preferably from C 80 to 86° or 96 to 100°, in each case on one side of the web, or 96 to 100° or C 80 to 86° on the respective other side of the web.

Figure 21:
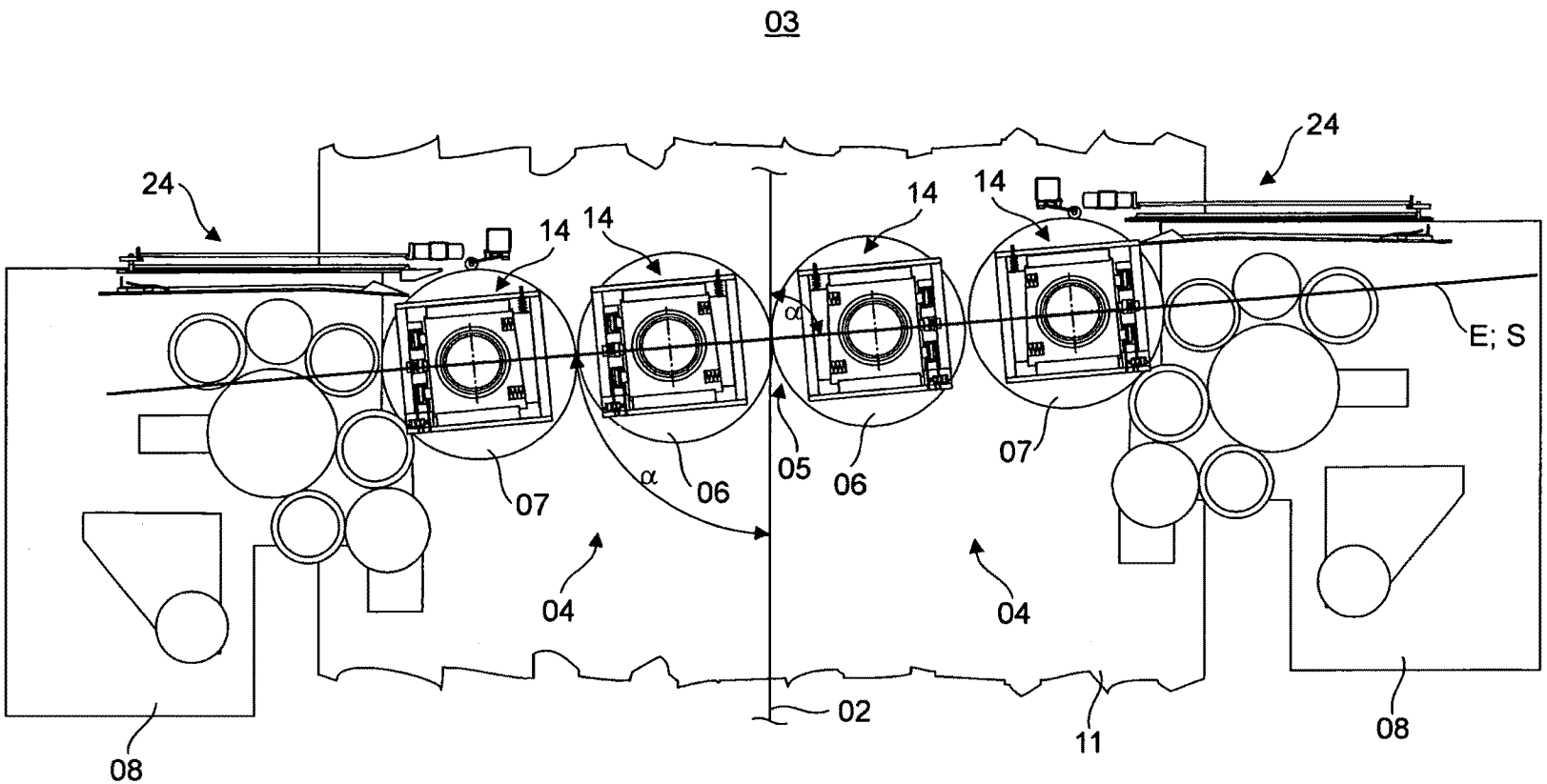
FIG. 21 a second bearing arrangement of a blanket-to-blanket printing unit.

In another embodiment illustrated in FIG. 21, the bearing units 14 of the transfer cylinder 06, and especially of all cylinders 06; 07, are arranged in the mounted state on the side frame 11 in such a way that their directions of adjustment S coincide with the planes of connection E. In other words, they form an acute angle β of approximately 0°. Thus all the directions of adjustment S coincide, and are not spaced from one another.

Figure 22:
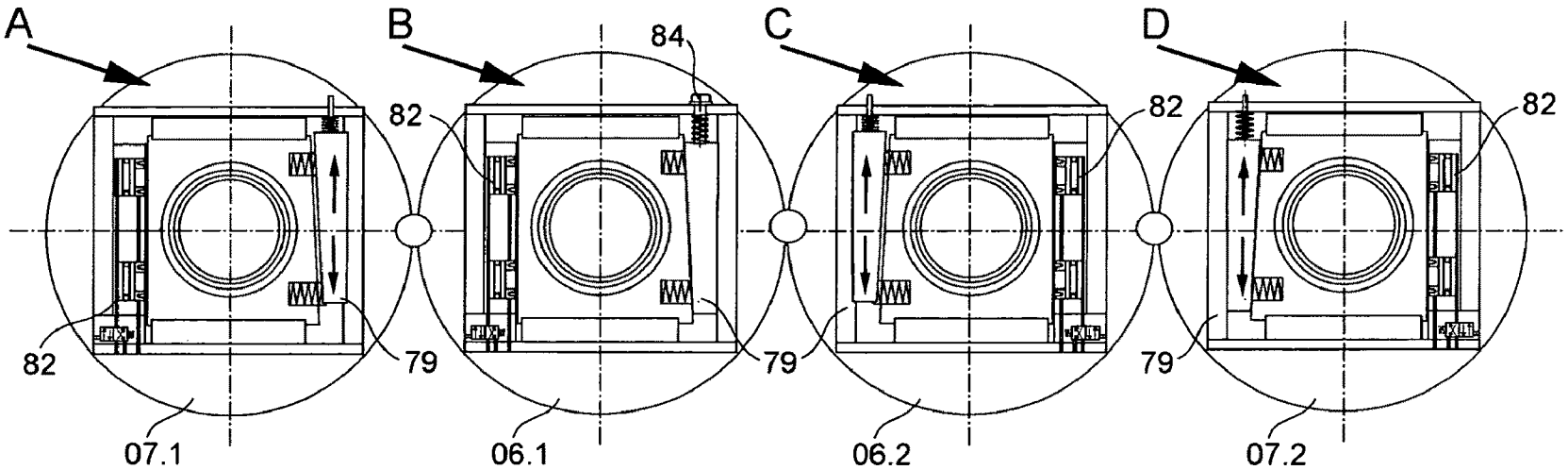
FIG. 22 a drawing sketch illustrating, in principle, the mounting and adjustment of the cylinder.

Independent of the inclination of the adjustment paths, shown in FIGS. 20 and 21, relative to the planes E or E' or E", with slight inclination or with no inclination, in the schematic example of FIG. 22, an advantageous process method for adjusting the cylinders 06; 07, which (in this case are assigned the suffixes "1" and "2" to differentiate between the left and right printing groups or their print-on position is described in what follows First, a first cylinder 06.1 that participates in defining the printing point 05, for example a transfer cylinder 06.1, is aligned in its position in the print-on setting (i.e. actuators 82 are active) within the printing unit 01 and relative to the web 02 by adjusting the stops 79, at both end surfaces. This can be accomplished, as indicated here, by means of an actuator 84, or adjustment screw, shown here, by way of example, as being manually actuatable. A so-called "0-position" that defines the printing point is hereby established.

Once the stop 79 of the assigned forme cylinder 07.1 has been released, in other words the stop 79 has been removed, for example, beforehand by drawing it toward the top, and the print-on position of the transfer cylinder 06.1 is still activated, in other words actuators 82 of the transfer cylinder 06.1 are activated, the amount of force F desired between the forme and transfer cylinders 07.1; 06.1 for the print-on position is exerted. Here, this is accomplished by an impingement of the actuators 82 of the forme cylinder 07.1 with the desired amount of contact force P. If the bearing unit 14 of the first forme cylinder 07.1 is also equipped with an adjustable top 79, then, in a first variant, this stop 79 can now be placed, essentially without force, in contact with the corresponding stop surface of the bearing block 74 on the first forme cylinder 07.1.

When the print-on position is activated, or in other words when force is respectively exerted in the direction of the printing point 05 for the two first cylinders 06.1; 07.1 and the print-off position of the second forme cylinder 07.2 is activated, while the stop 79 of the third cylinder 06.2 is being released, or after it has been released, the desired amount of force, or pressure P for the print-on position, is exerted on the second transfer cylinder 06.2 or its bearing block 74, and once equilibrium is reached, its stop 79 is placed, essentially without force, in contact with the corresponding stop surface of the bearing block 74. Within this framework, the stop 79 of the first forme cylinder 07.1 can also be placed in contact with the assigned bearing block 79 before, during, or afterward, if this has not already taken place as in the aforementioned variant.

In a final step, with a free or an already released stop 79, the second forme cylinder 07.2 or its bearing block 74 is placed in the print-on position, while the assigned transfer cylinder 06.2 is also in print-on. Once a steady-state condition is reached, if a stop 79 is provided there, this stop 79 is also placed, essentially without force, in contact with the corresponding stop surface of the bearing block 74 on the second forme cylinder 07.2.

In this manner, an adjustment of the cylinders 06; 07 of the blanket-to-blanket printing unit 03 that is optimal for the printing process is accomplished.

Figure 23:
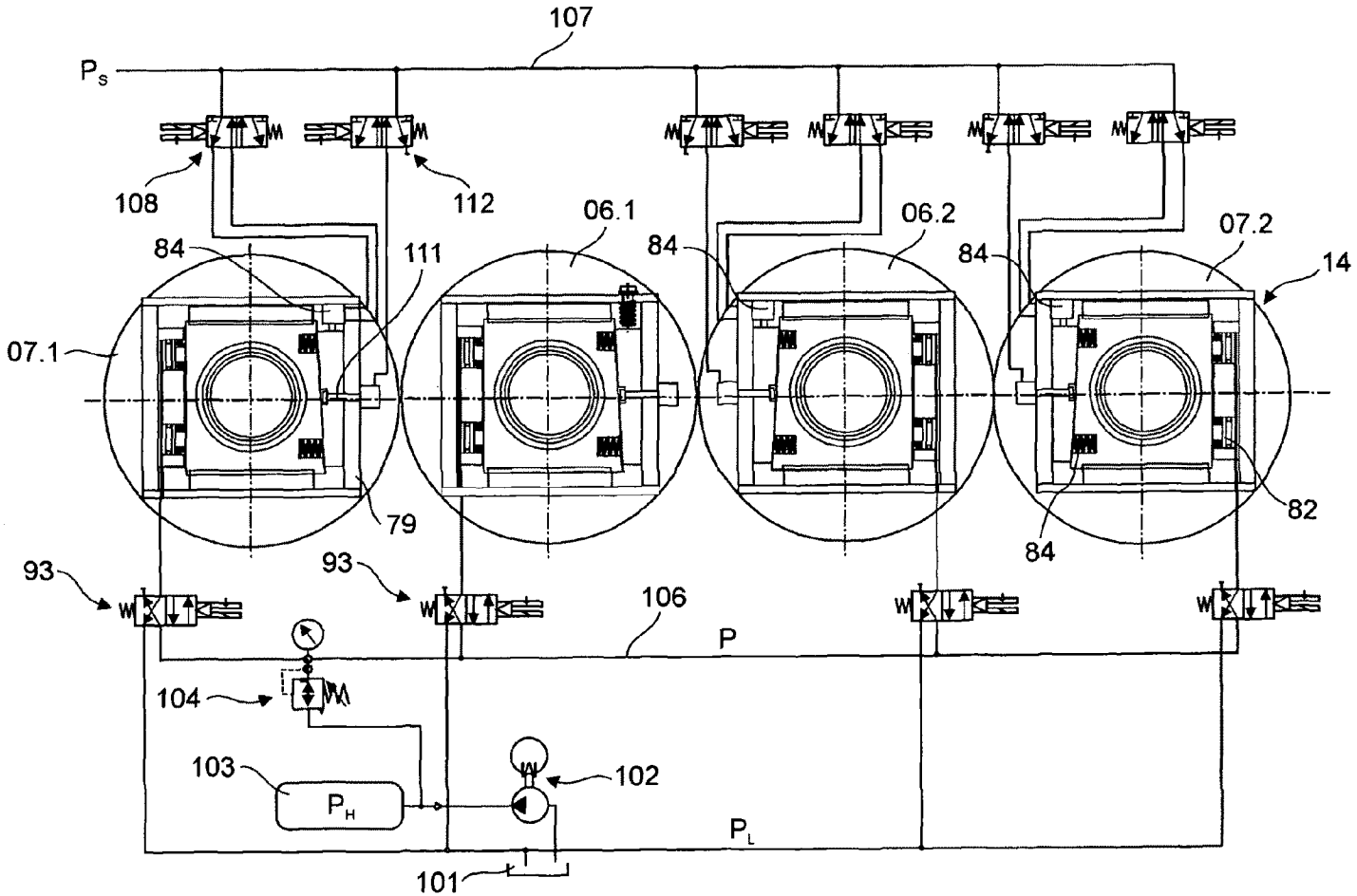
FIG. 23 a preferred embodiment of an interconnection for a supply of pressure medium.

In FIG. 23, a preferred embodiment of an interconnection of a pressure medium supply arrangement, suitable for implementing the aforementioned process method, is shown. A fluid reservoir 101 that is open or closed toward the outside is set at a pressure level for a pressure $P_L$, for example ambient pressure that is lower than a pressure P that corresponds to the restoring force $F_R$ of the spring elements 81 of a bearing unit 14. The pressure medium, or fluid is compressed by a compressor 102, for example a pump or a turbine, to a pressure level for a pressure $P_H$, which corresponds at least to the pressure P that is required for the contact force F. In order to minimize pressure medium fluctuations caused by the removal of pressure medium, fluid compressed to the pressure $P_H$ can be advantageously stored in a pressurized tank 103. From the pressure medium line that contains the high pressure level $P_H$, a supply line 106 is pressurized via a control element 104, especially an adjustable pressure-reducing element 104, wherein the pressure level of the supply line is adjusted via the pressure reducing element 104 to the pressure P that is suitable for adjustment to the print-on position, corresponding force F; if applicable taking into account the restoring force $F_R$ and optionally the force ΔF. In an embodiment that is not specifically shown here, two different pressure levels P, for example $P_{DS}$ for the contact force at the printing point, and $P_{DW}$ for the contact force between the printing group cylinders 06; 07 can also be provided via two adjustable pressure reducing elements 104 in two supply lines 106.

The intakes of the valves 93 already mentioned in connection with FIG. 19, especially multiway valves, for each adjustable cylinder 06; 07 are now connected to the supply line 106 for the pressure P. With the two aforementioned levels the intakes of the valves 93 that are allocated to the movable transfer cylinders 06 are connected, for example, to the pressure $P_{DS}$, and the intakes of the valves 93 that are allocated to the forme cylinders 07 are connected, for example, to the pressure $P_{DW}$. The outlets of the valves 93 are connected to the fluid reservoir 101.

An adjustment of the stops 79, which are configured to be movable not solely manually, via the correcting elements 84 that are configured as actuators 84 that can be actuated with pressure medium, is accomplished, for example, either advantageously via a separate supply line 107 that supplies a pressure $P_S$ shown or optionally integrated into the aforementioned pressure level. As shown in FIG. 23, the fluid that supplies the pressure $P_S$ as a gaseous pressure medium, such as compressed air, can be provided in an open system. An intake of a valve 108 that is connected to the assigned actuator 84 is connected to the supply line 107, wherein, depending upon the embodiment of the actuator 84, dual-action in both directions or active in only one or two possible directions, one or two outlets for the valve 108 are connected to one or two intakes for the actuator 84.

In a further development, which is illustrated in FIG. 23, for the purpose of fixing the stop 79 in place, an actuatable holding element 111 is also provided, for example a ram, by the use of which, the stop 79 can be held in its essentially force-free position, without changing its position when released for adjustment to the print-off position. This holding element 111 can also be connected to the pneumatic supply line 107 via corresponding lines and additional valves 112 for the purpose of actuation or release. In the example shown, the holding element 111 is configured to optionally clamp the stop 79, during activation in relation to the bearing block 74 in a non-positive fashion.

Figure 37:
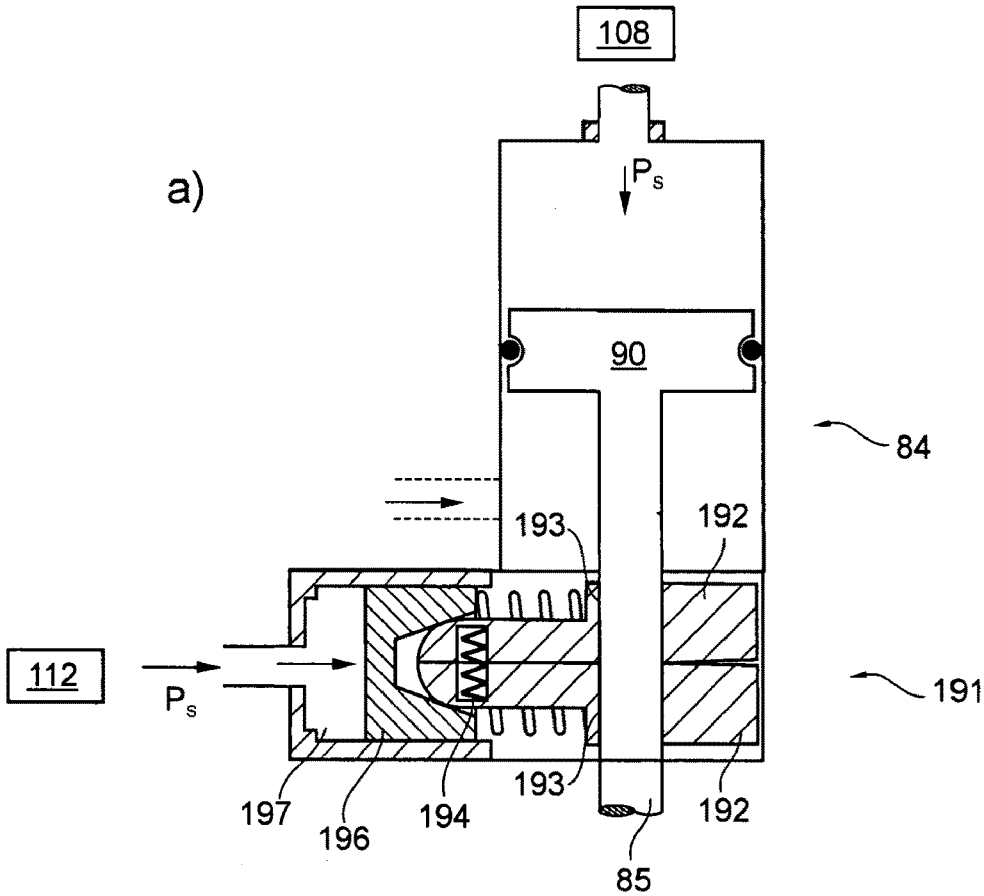
FIG. 37 an embodiment of a support element for a stop for the bearing unit according to FIG. 23.
Figure 37:
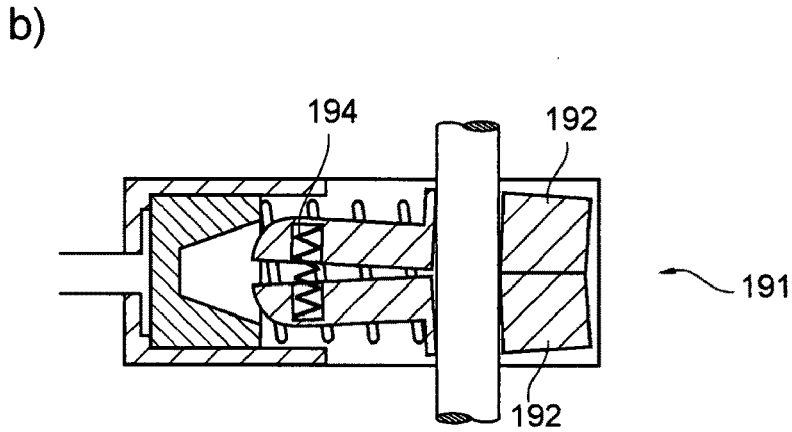

In one advantageous embodiment, in place of the holding element 111 that fixes the stop 79 in place, a holding element 191, as represented in FIG. 37, is provided, with which the transfer element 85, especially the piston rod 85 or a corresponding extension piece, can be clamped. The holding element 191 can be integrated into the actuator 84, or can be arranged between the actuator 84 and the stop 79 as shown here, in such a way that the transfer element 85 can be optionally held in place or can be freely movable in its direction of motion. For example, the holding element 191 has two clamping jaws 192 with openings 193 or at least recesses for encompassing the transfer element 85, which are in active connection with the transfer element 85 such that in a first functional position, in which the longitudinal axes of the openings 193 extend parallel to the transfer element 85, they release the transfer element 85, and in a second functional position, in which the longitudinal axes of the openings 193 are tilted relative to the longitudinal axis of the transfer element 85, especially they are spread apart from one another, the latter element is clamped, preventing motion. The holding element 191 is preferably configured to be self-locking, so that when the holding element 191 is not actuated, for example via the force of a spring 194, the second operational state is assumed. The actuation of the clamping jaws 192 is accomplished via surfaces of an actuator 196 that are inclined in such a way that when the actuator 196 is in a first position, the clamping jaws 192 are inclined, see above, and when it is in a second position, they are not inclined. In principle, the holding element 191, especially the actuator 196, can be actuated manually, for example via a corresponding actuation device, or non-manually, especially remotely, advantageously via a servo drive 197. In FIG. 37 the servo drive 197 is configured as a cylinder 197 that can be pressurized with pressure medium, in which the actuator 196, which is configured as a piston, is movable. When it is acted upon with the pressure $P_S$, as seen in FIG. 36 *a*, a release of the clamping occurs, in this case via a corresponding orientation of the clamping jaws 192 or their openings 193. With release (FIG. 36 b), a spreading or tilting of the clamping jaws 192 is accomplished via the spring 194, causing a clamping.

The stop 79 can reset either by the spring 86 shown in FIG. 9 or alternatively, as indicated in FIG. 37 by a dashed line, actively via the configuration of the actuator 84 as a cylinder that can be actuated with pressure medium, with dual-action pistons, in other words with two pressure medium supply lines, one on each side of a piston 90.

In the illustrated embodiment, all four cylinders 06; 07 are mounted such that they can be adjusted to the on/off positions via actuators 82, wherein, however, only the stops 79 of the two forme cylinders 07 and one of the transfer cylinders 06 can be adjusted non-manually, especially remotely, i.e. via the actuators 84 that can be actuated with pressure medium. The stop 79 of the other transfer cylinder 06 can be adjusted and secured in place, for example via a correcting element 84 that can be implemented as an adjustment screw. Thus, for example, no holding element 111 is necessary.

In an aforementioned simpler variant, all four cylinders 06; 07 are mounted so as to be linearly movable via actuators 82, wherein only the two transfer cylinders 06 have movable stops 79, optionally with the aforementioned actuators 84 and/or holding elements 111.

In a further simplified embodiment, although one of the two transfer cylinders 06 can be adjusted in its position, it is not operationally movable in the sense of an on/off adjustment, rather it is mounted, fixed to the frame. The three other cylinders 06; 07 are then movably mounted in the sense of an on/off adjustment, wherein in a first variant all of these three cylinders 06, 07, and in a second variant only the transfer cylinder 06 that differs from the fixed transfer cylinder 06, have a movable stop 79 and optionally the holding element 111.

Figure 25:
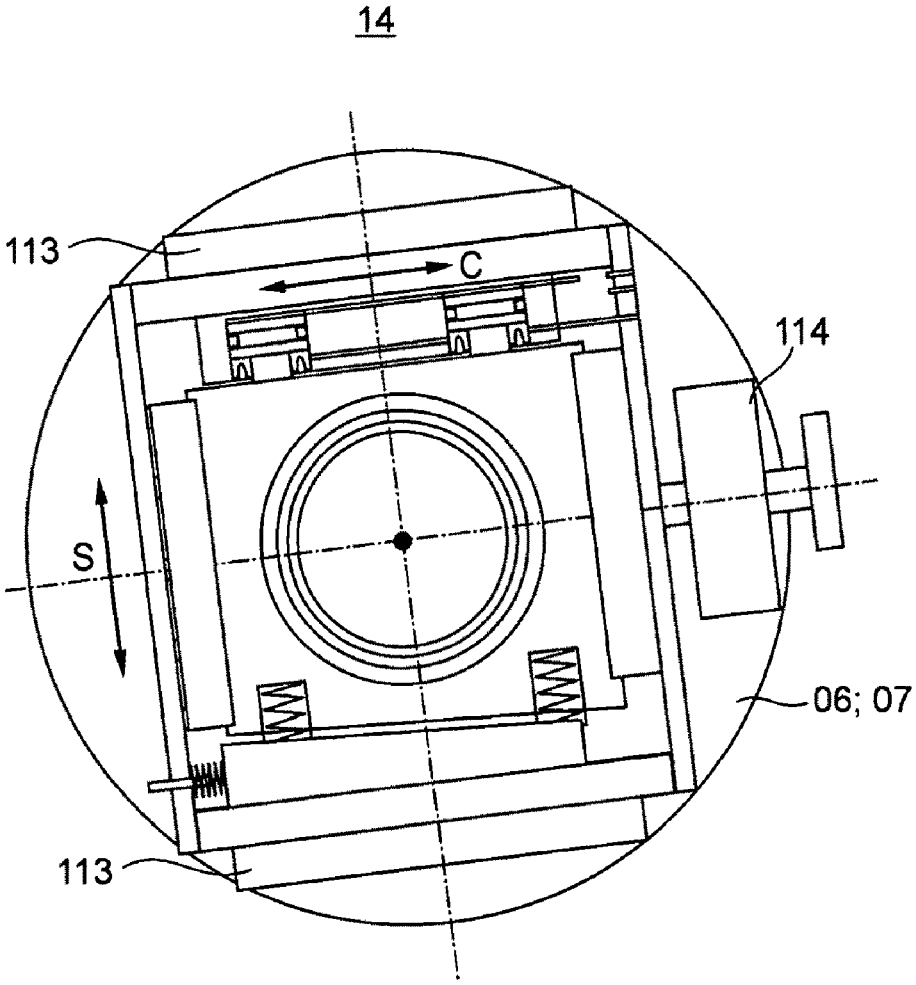
FIG. 25 a bearing unit with elements for the tilting of a cylinder.

In a further development of the cylinder mounting, the bearing units 14 of the forme cylinder 07 and/or the transfer cylinder 06, as schematically illustrated in FIG. 25, are themselves movably mounted on at least one end surface in bearings 113, for example linear bearings 113, such that they are movable in one direction of motion C, which extends perpendicular to the axis of cylindrical rotation, and has at least one component that is perpendicular to the direction of adjustment S. The direction of motion C is preferably selected to be perpendicular to the direction of adjustment S, and, with a single-side actuation, effects an inclination, or a so-called "cocking" of the relevant cylinder 06; 07. The cylinder 06; 07 can be adjusted via a manual or motorized correcting element 114, for example via a handwheel or preferably via a motorized adjustment screw. This type of additional mounting of the bearing unit(s) 14 on the forme cylinder 07 enables an inclination of said cylinder, and a register adjustment, and enables its inclination relative to the transfer cylinder 06.

Figure 38:
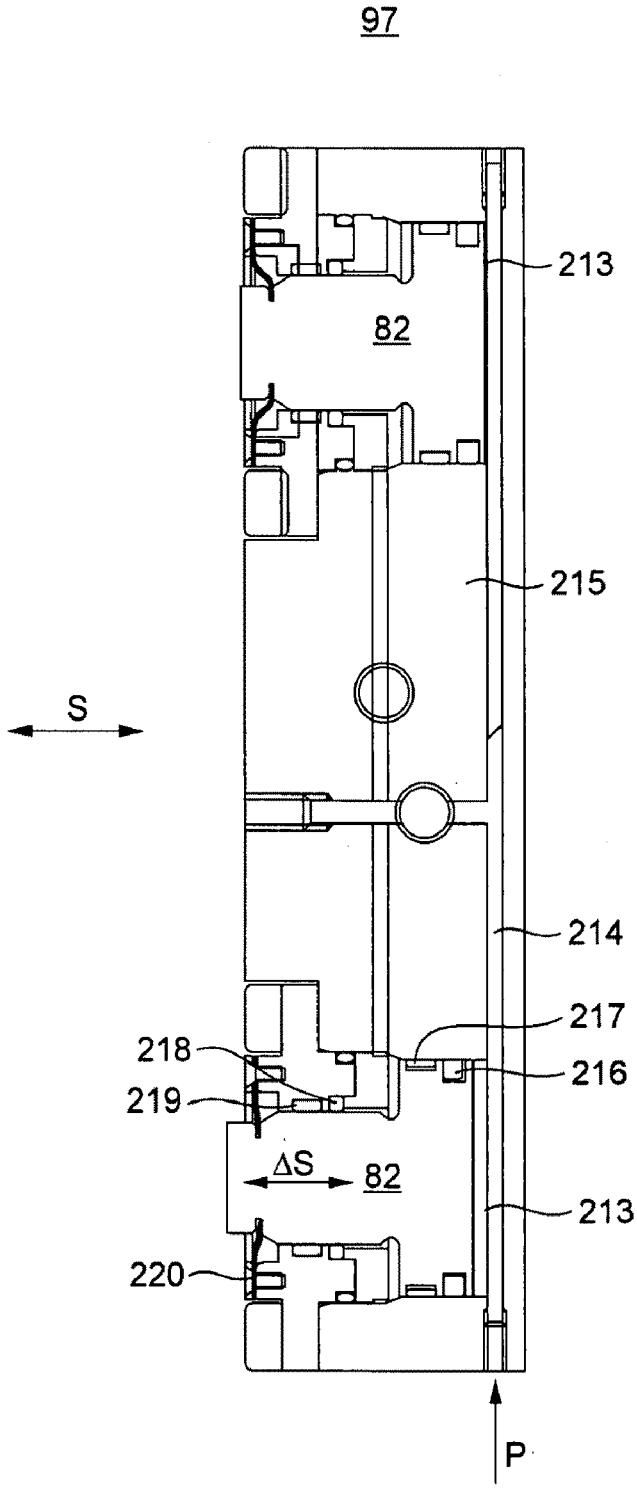
FIG. 38 an embodiment of an actuator element.

In addition, the actuator 82 provided in the preceding embodiment of the bearing units 14 is configured to provide an adjustment path ΔS that is suitable for on or off adjustment, and thus preferably has a linear stroke that corresponds at least to ΔS. The actuator 82 is provided for adjusting the contact pressure of rollers or cylinders 06, 07 engaged against one another and/or for performing the adjustment to the print-on/print-off position, and is configured accordingly. The adjustment path ΔS, or linear stroke amounts, for example, to at least 1.5 mm, and especially to at least 2 mm. In FIG. 38 an advantageous embodiment of an actuator element 97, for example configured as a preassembled component, is represented. This actuator element 97 comprises at least one, and preferably two, actuators 82 configured as pistons 82 that can be actuated with pressure medium to move in the direction of adjustment S, wherein the pistons are movably mounted in recesses 213 in a base component 215 that serve as pressure chambers 213 that can be acted upon with pressure medium. The actuator element 97 also comprises a supply line 214 for supplying the pressure chambers 213 with pressure medium at the pressure P. Preferably, the two pressure chambers 213 are supplied via a shared supply line, and thus are pressurized or depressurized in the same manner. In FIG. 38, however, the upper piston 82 is represented by way of example for both pistons 82 in an inserted position, and the lower piston is represented by way of example for both pistons 82 in a retracted position. For this reason the supply line 214 has also been characterized as only partly acted upon by pressure medium.

The piston 82 is sealed against the pressure medium chamber 213 by a seal 216 positioned near the pressure medium chamber and extending around the circumference of the piston 82, and is guided by a sliding guide 217 positioned near the pressure medium chamber. A second seal 218 and a second sliding guide 219 can also be advantageously provided in an area of the piston 82 that is distant from the pressure medium chamber. In one particularly advantageous embodiment, in place of, or in addition to the second seal 218, the piston 82 is also sealed against the outside by a membrane 220, for example made of rubber, especially a roller membrane 220. This is connected on one side, all the way around, to the piston 82, and on the other side, on its outer peripheral line, it is fully connected to the base component 215 or to other stationary internal parts of the actuator element 97.

In one advantageous embodiment of the printing unit 01, parts of the printing unit 01, especially panel sections 11; 12; 49, are arranged to be linearly movable in relation to one another, especially in a linear guide, for the purpose of loading or maintaining the printing unit 01, and cylinders 06; 07 are arranged to be linearly movable within the corresponding panel section 11; 12, in linear bearings, for the purpose of adjusting the contact pressure and/or for performing the print-on/print-off adjustment.

In principle, the actuation embodiments described in what follows are also advantageous independently of the above-described separability and/or modularity and/or the cylinder arrangement on the inner panels of the side frame 11; 12 and/or the linear arrangement and/or the special linear bearing and/or the mentioned on/off positioning and adjustment of the cylinders 06; 07. However particular advantages result specifically from a combination having one or more of the aforementioned characterizing features.

Below, preferred embodiments of drive transmissions configured as functional modules are described. In the drive solutions, functional groups for the printing unit 01 are logically combined and equipped with their own drive motors, as discussed below, especially servo, AC, or asynchronous motors. Here, a printing cylinder transmission with its own drive motor comprises, for example, the drive for a forme cylinder/transfer cylinder pair. In addition, an inking unit transmission with its own drive motor, for rotation and oscillating motion and, in the case of wet offset printing, a dampening unit transmission with its own drive motor, for rotation and oscillating motion provide a high degree of the aforementioned modularity.

The transmission units, which are preferably preassembled as modules, can be completely preassembled as sub-units for the printing unit cylinders 06; 07 (FIGS. 26, 27) and/or for the inking units 08 (FIGS. 26, 27), which are, for example, implemented as a module, and can, in one advantageous embodiment, be pre-mounted on the frame 147, or on framework 16 of the inking unit module before being installed in the printing unit 01. On the other hand, modularity also permits the installation/replacement/exchange of the transmission that is implemented as a module when the inking unit module is already installed in the machine.

The concept of modularity for separate printing group cylinders, inking unit drives and dampening unit drives ensures both the separability of the printing unit 01 at the printing point 05, see, for example, FIG. 3 and the separability between the forme cylinder 07 and the inking unit 08, see FIG. 24. The separate modules for the printing group cylinders 06; 07, the inking unit 08 and optionally the dampening unit 09 also permits the simultaneous set-up operation and printing forme exchange and/or washing of the rubber blanket while a washing of the inking unit and/or a pre-inking is taking place. In this connection, the process programs can differ from one another in terms of duration, speed and functional progress.

Figure 27:
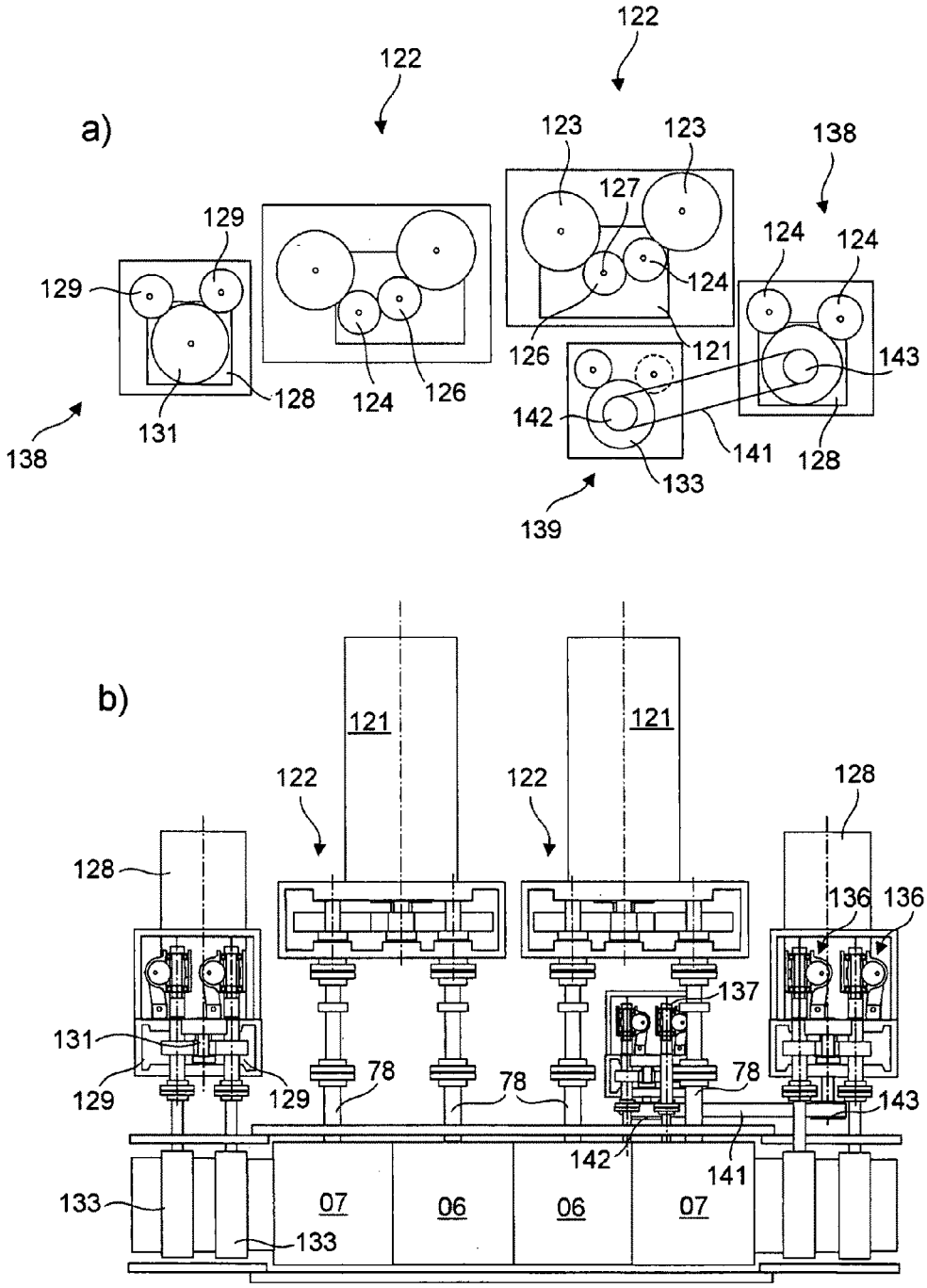
FIG. 27 a second embodiment of the drive for a printing group.
Figure 28:
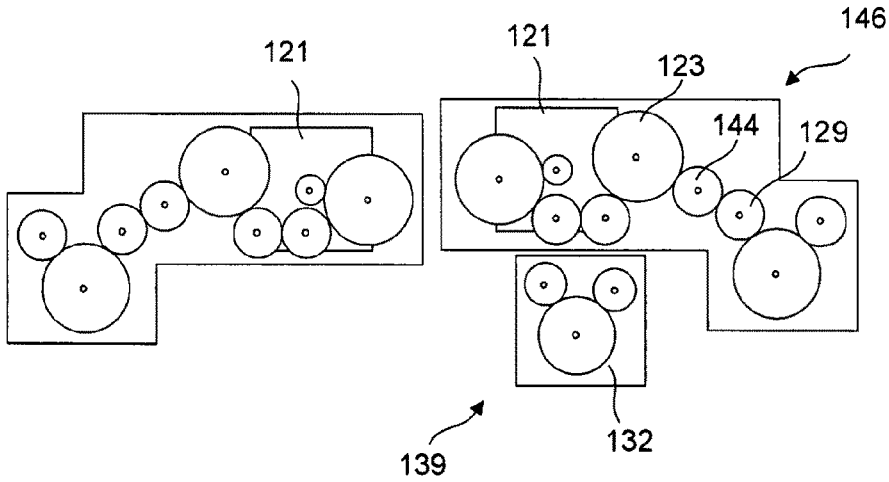
FIG. 28 a third embodiment of the drive for a printing group.
Figure 28:
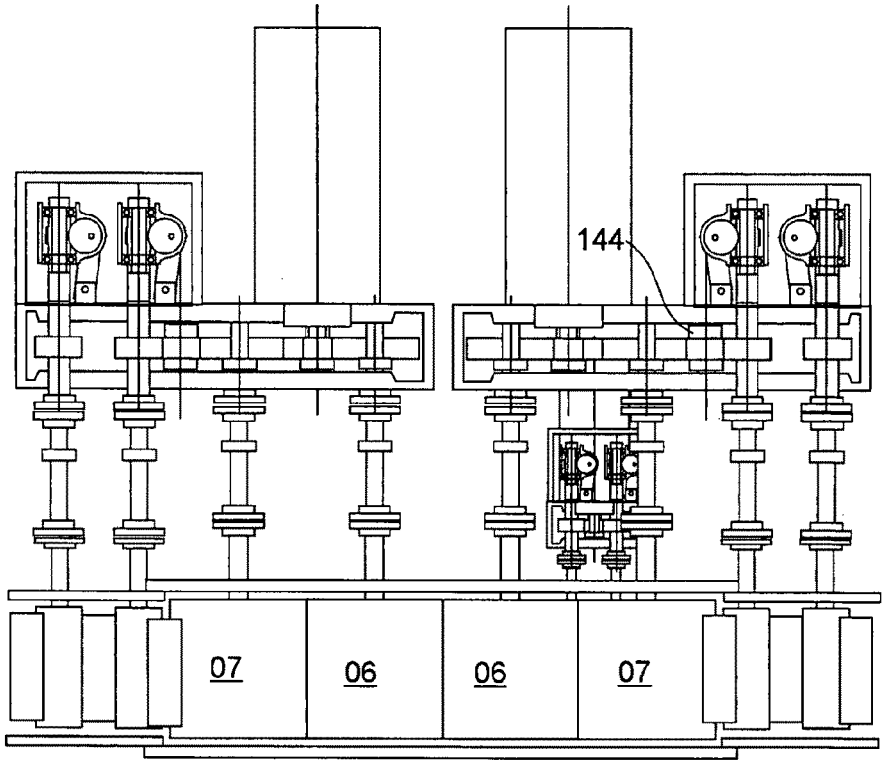
Figure 29:
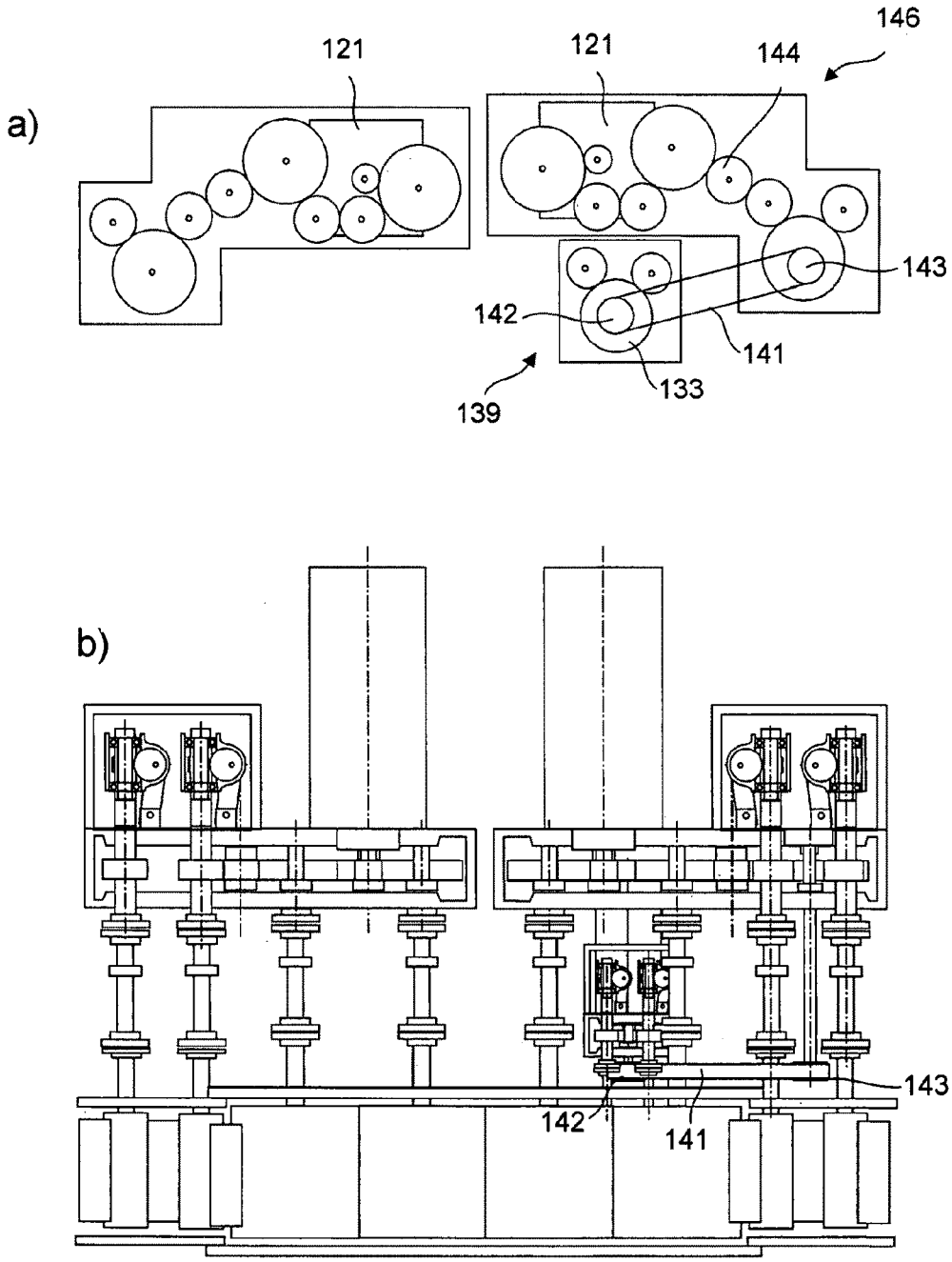
FIG. 29 a fourth embodiment of the drive for a printing group.

When requirements with respect to variation and/or modularity are low, larger functional groups can also be combined to form one module, as seen in FIGS. 27, 28, 29.

In the preferred embodiment, the transmission or the gear train of the respective drive module is, in each case, configured as a separately enclosed transmission, and is actuated by at least one drive motor that is mechanically independent from the other functional modules. Thus, when a printing unit 01 is comprised of modules, it is not necessary to account for an extensive fluid chamber and/or drive connections. The structural components, considered in and of themselves, are complete and separated.

By way of example, on the left side of each of the figures, the conditions for the dry offset process are shown, and on the right side, those for wet offset printing are shown. Naturally, the two printing groups 04 of an actual blanket-to-blanket printing unit 03 are of the same type. In the end-surface views, to provide an overall view, the roller layout is omitted and only the drive trains with motors are represented. In the plan view, the drive concept is in the example of an inking unit 08 with two rotationally actuated distribution cylinders 33, see inking unit 08.2 and in the case of wet offset printing in contrast to the FIGS. 11*a*) and 11*b*) in the example of a dampening unit 09 with two rotationally actuated distribution cylinders 33, indicated as optional in FIG. 26 by a dashed line.

The printing group cylinders 06; 07 are actuated in pairs. In other words, every pair of cylinders 06, 07 made up of the forme cylinder and its assigned transfer cylinder 07; 06, is equipped with at least one drive motor 121 of its own, which is mechanically independent from other printing group cylinders. In the variant that is not shown here, for example, this can be accomplished with a separate, mechanically independent drive motor 121, or, as represented in what follows, it can be accomplished with the paired actuation via drive connections or drive trains.

In FIG. 26*a*), in the end-surface view, and in FIG. 26*b*) in a plan view, a gear or drive train 122 is represented, especially configured as a drive or as a functional module 122, in each case for the pair of printing cylinders 06, 07. The cylinders 06; 07 are each equipped with drive wheels 123, especially spur gears 123, which are non-rotatably connected via the drive shafts 78, whose tip diameter is smaller than the outer diameter of the respective cylinder 06; 07 or barrel 67; 68. These spur gears 123 are in drive connection with one another via an even number of intermediate gears 124; 126, in this case two toothed gears 124; 126. In an embodiment represented in FIG. 26*a*), one of the two toothed gears 124; 126, especially the toothed gear 126 that is positioned near the transfer cylinder, acts as a sprocket and is actuated via the motor shaft 127 of the drive motor 121. In principle, as shown in FIG. 27, the drive can also be implemented by the drive motor 121 via an additional sprocket on one of the two drive wheels 123, especially on that of the transfer cylinder 06.

Figure 26:
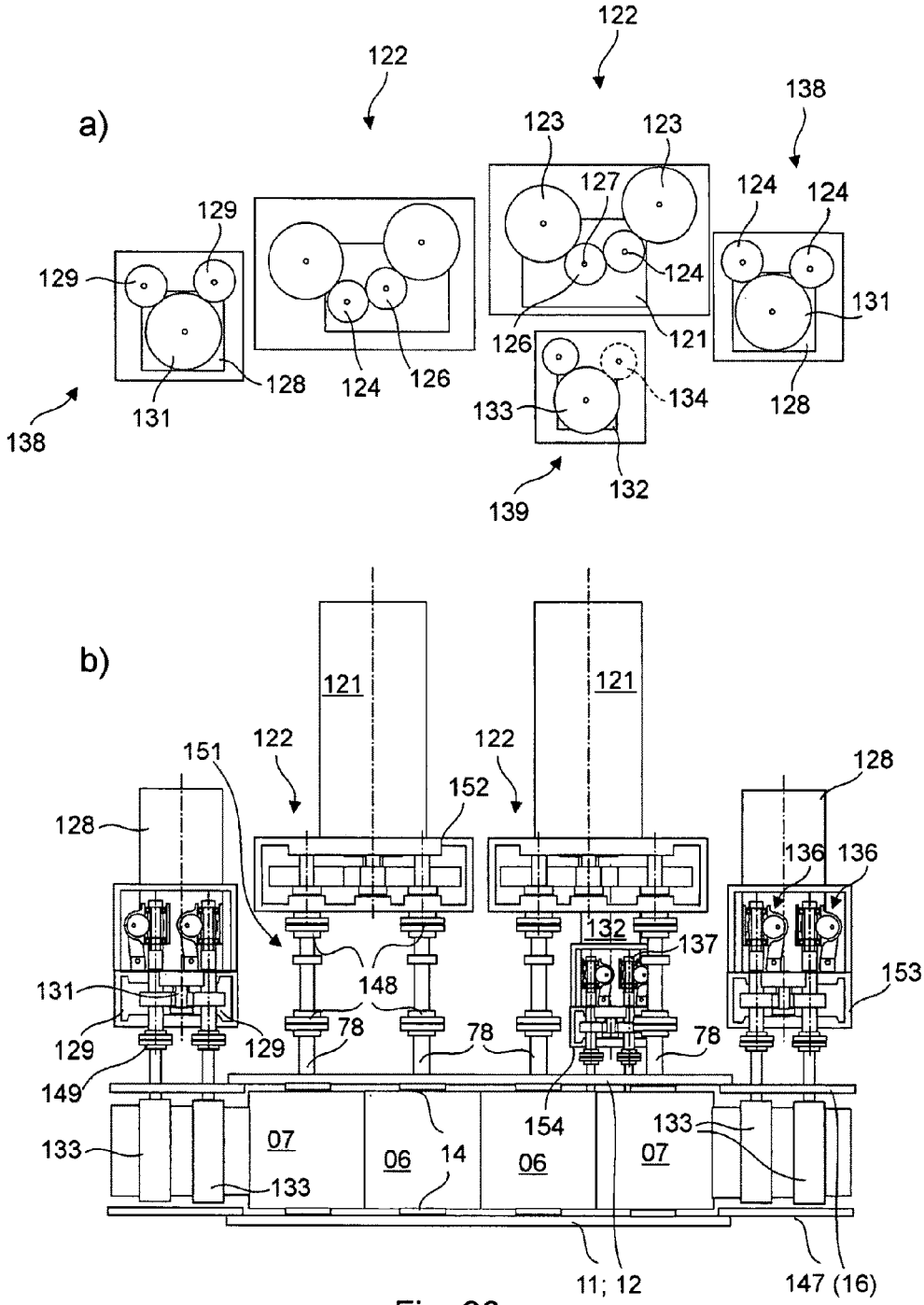
FIG. 26 a first embodiment of the drive for a printing group.

The inking unit 08 in each case is equipped with its own drive motor 128 for rotational actuation, which is mechanically independent from the printing group cylinders 06; 07. With this, especially the two distribution cylinders 33 of the inking unit 08.2, in the case of an anilox roller 26 the one, or in the case of three distribution cylinders 33 the three are actuated, for example via drive wheels 129 that are non-rotatably connected to these, and a drive sprocket 131. In the case of wet offset printing, on the right, essentially the same applies for the actuation of the dampening unit 09 with a drive motor 132, a drive sprocket 133 and one or more drive wheels 134, represented by a dashed line, of one or more distribution cylinders 42; 48. In FIG. 26*b*) one friction gearing 136 or 137 that generates the axial oscillating motion is provided per distribution cylinder 33 of the inking unit 08 and per distribution cylinder 42; 48 of the dampening unit 09. In principle, this can be actuated by an additional drive motor, or, as represented here, it can be configured as a transmission 136; 137 that converts the rotational motion into axial motion. In the modification of the embodiment according to FIG. 26, the actuation of the inking unit 08 can be accomplished according to FIG. 32, in other words only the distribution cylinder 33.2 that is positioned distant from the forme cylinder is forced into rotational actuation, however optionally both distribution cylinders 33.1; 33; 2 are forced into axial actuation, and/or a three-roller dampening unit 09 can be rotationally actuated purely via friction, as described above in reference to the further development of FIG. 11*a*).

The drive of the extra actuated inking unit 08 and, if provided, the dampening unit 09 is preferably implemented in each case as a functional group, especially as a drive or functional module 138; 139. These drive modules 138; 139 can especially be installed as a complete unit and can each preferably be implemented as enclosed units, see FIG. 26*b*.

In FIG. 26, by way of example for the other drive variants in the subsequent figures, an advantageous embodiment of the bearing as bearing units 14 is also indicated in the aforementioned embodiment for the mounting of the four cylinders 06; 07. For example, the shafts 78 are guided through corresponding recesses/openings, optionally, for purposes of modularity and thus with different axial spacing, as an elongated hole, in the side frame 11; 12.

Corresponding or repeated parts are not explicitly indicated by reference symbols in each case in FIGS. 26 through 29.

In the advantageous embodiment represented in FIGS. 26 and 27, the rotational axes of the four printing group cylinders 06; 07 of the blanket-to-blanket printing unit 03 are arranged by way of example in the shared plane E. However, the drive concept of FIG. 26 or 27 can also be applied to nonlinear arrangements of the cylinders 06; 07 as shown by way of example in FIGS. 1, 28 and 29, with the corresponding nonlinear arrangement of the drive wheels 123. The drive concept from FIGS. 28 and 29 can also be applied to the linear arrangement of the cylinders 06; 07.

In an embodiment according to FIG. 27, the printing group cylinders 06; 07 and the inking units 08 have their own drive, as is depicted also in FIG. 26. Although the inking and dampening unit drives are configured as separate functional modules, the printing group 04 on the right, which represents wet offset printing, has a dampening unit 09 without its own rotational drive motor. In this case, the rotational actuation is accomplished by the inking unit 08 via a mechanical drive connection 141, for example a belt drive 141, either directly via a drive wheel, such as a pulley, that is connected to the respective distribution cylinder 42; 48, or, as represented, via a drive wheel 142, such as a pulley, that is connected to the drive sprocket 133, which its distribution cylinder 42; 48 or its distribution cylinder 42; 48. Actuation is accomplished, for example, via a drive wheel 143, for example a pulley 143, which is non-rotatably connected to the drive shaft of the drive motor 128. In a modification of the embodiment according to FIG. 27, the inking unit 08 can be actuated according to FIG. 32. In other words, only the distribution cylinder 33.2 that is distant from the forme cylinder can be forced into rotational actuation, and optionally both distribution cylinders 33.1; 33.2 can be forced into axial actuation, and from there can be actuated on the dampening unit 09.

In an embodiment according to FIG. 28, the dampening unit 09 is configured as a functional module and has, as in FIG. 26, its own drive motor 132. However, the inking unit 08 does not have a drive motor that is independent from the printing group cylinders 06; 07. Rather, rotational actuation is accomplished via one of the cylinders 06; 07, especially the forme cylinder 07, via a mechanical drive connection 144, for example via at least one intermediate gear 144, especially a toothed gear 144, between the spur gear 123 and the drive wheel 129 of one of the distribution cylinders 33. In an advantageous variant, the drive connection 144 can also be implemented as a belt drive. The actuation of the printing group cylinder pair 06, 07 with an allocated inking unit 08 is preferably configured as a drive train 146 or a drive or functional module 146, especially at least the space that contains the drive train of the cylinder pair 06, 07 and inking unit 08 is, for example, enclosed. In a modification of the embodiment according to FIG. 28, the inking unit can be actuated according to the principle presented in reference to FIG. 32. In other words, only the distribution cylinder 33.2 that is positioned distant from the forme cylinder is forced into rotational actuation by the forme cylinder 07 via a drive connection. However, optionally both distribution cylinders 33.1; 33.2 can be forced into axial actuation. The drive of a three-roller dampening unit 09 can be rotationally actuated via the drive motor 132, or, as described above in reference to the further development of FIG. 11*a*), can be rotationally actuated purely via friction.

In an embodiment according to FIG. 29, the dampening unit 09 is configured as a functional module, however, as in FIG. 27, it does not have its own drive motor. The inking unit 08 has no independent drive motor, as in FIG. 28. Rather, it is again actuated, as in FIG. 28, rotationally by one of the cylinders 06; 07, especially by the forme cylinder 07, via a drive connection 144, for example an intermediate toothed gear 144. As in FIG. 27, the dampening unit 09 is actuated via a belt drive 141. The drive of the printing group cylinder pair with the allocated inking unit 08 is again preferably configured as a functional module 146, especially it is enclosed. In a modification of FIG. 29, the inking unit 08 can be actuated according to the principle presented in reference to FIG. 32, in other words only the distribution cylinder 33.2 that is distant from the forme cylinder is forced into rotational actuation by the forme cylinder 07 via a drive connection, however optionally both distribution cylinders 33.1; 33.2 are forced into axial actuation. The drive of a three-roller dampening unit 09 can be rotationally actuated via the drive connection 141, or as described above in reference to the further development of FIG. 11*a*), purely via friction.

In further, fifth variants, which are not illustrated here, in wet offset printing the printing cylinder transmission and the dampening unit transmission can be implemented together as a functional module with a shared drive motor, wherein the functional module 138 is retained as it is in FIG. 26, and has a drive motor 128. In a modification, the inking unit is implemented as a functional module 138. However, it is actuated without its own motor by the printing cylinder transmission via a belt drive.

In a modification of FIG. 27, actuation of the dampening unit drive that is implemented as a functional module 139 can be accomplished not by the inking unit 08, but by the drive train 122 of the printing group cylinders 06; 07, via a belt drive.

As is apparent in FIG. 26 through 29, the drive modules 122 with the two printing group cylinders 06; 07 are coupled in each case via at least one non-rotatable coupling 148, especially at least one angle-compensating coupling 148. Preferably two couplings 148 of this type are provided in series with an intermediate piece, or a component implemented overall as a double universal joint, which then in combination represent a coupling 151 that serves to compensate for an offset. In this manner, despite the movability, or on/off adjustment of the cylinders 06; 07, an arrangement of the drive modules 122 and drive motors 121 in which they are fixed to the frame is possible. During mounting, only those shafts 78 that have the coupling(s) 148 need to be flange-mounted to the functional modules 122, which are manufactured separately. From the functional module 122—which is especially closed to the outside or encapsulated—shaft butts or flanges, indicated in the figures, advantageously protrude, which during assembly of the printing unit 01 need only to be non-rotatably connected to the shaft piece that has the coupling 148; 151, which in turn is non-rotatably connected to the shaft 78. Especially advantageously, the coupling 148 is respectively implemented as a disk coupling 148 or as an all-metal coupling, and has at least one disk packet that is positively connected to two flanges, but is offset in the circumferential direction of the disks.

The coupling 151 between the functional module 122 and the forme cylinder 07 is preferably implemented to enable a lateral register control/regulation in such a way that it also accommodates an axial relative movement between the forme cylinder 07 and the functional module 122. This can also be accomplished with the aforementioned disk coupling 148, which, with deformation in the area of the disks, enables an axial length change. An axial drive that is not shown here can be provided on the same side or on the other side of the frame as the rotational drive.

The actuated rollers 33, especially the distribution cylinders 33, of the dampening unit 09 are also preferably coupled via at least one coupling 149, and especially a coupling 149 that compensates for angular deviations, to the functional module 138. Because ordinarily no off/on adjustment of these rollers 33 occurs, a coupling 149 of this type is sufficient. In a simple embodiment, the coupling 149 is also configured as a rigid flange connection. The same applies to the drive on the optionally functional module 139.

In FIG. 26 through 29, the friction gearing 136; 137 can be arranged outside of an enclosed space that can accommodate the rotational drive trains, especially the lubricant space.

The drive trains 122; 138; 139; 146 configured as drive modules 122; 138; 139; 146 are implemented as components that, as units, are each completely closed off by housings 152; 153; 154, different from the side frames 11; 12. For example, they have an intake, to which, for example, a drive motor or a drive shaft can be coupled, and one or more outlets, which can be non-rotatably connected to the cylinder 06; 07 or the roller, anilox roller or distribution roller 26; 33; 42; 48.

Figure 30:
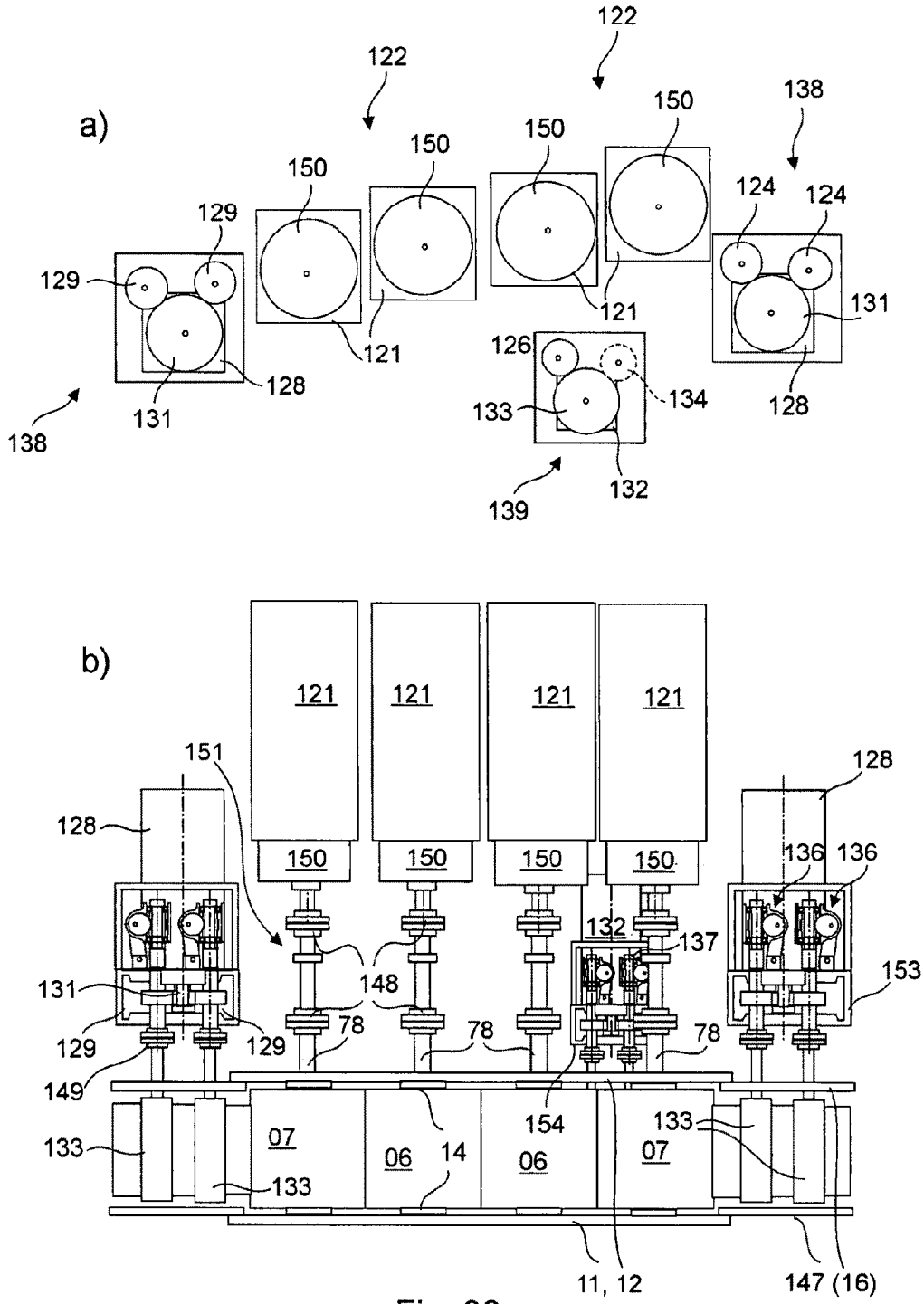
FIG. 30 a fifth embodiment of the drive for a printing group.

As an alternative to the above-described coupled printing cylinder drives, in another advantageous embodiment, the printing cylinders 06; 07 can also each be individually actuated by a drive motor 121 (FIG. 30). Preferably, in a "drive train" between the drive motor and the cylinders 06; 07 a transmission 150, especially a speed-reduction gear set 150, such as a planetary gear set, is provided. That gear set can be structurally pre-assembled as an adapter transmission mounted on the motor 121 to form a component unit. However, a modular transmission can also be provided as a drive or functional module, at the intake of which the drive motor can be coupled, and at the output of which the respective cylinder can be coupled, especially via a coupling 148 or 151 that serves to compensate for angle and/or offset.

In the embodiments according to FIG. 26 through 30, the drive motors 121 with their drive modules 122 or transmissions 150 can be arranged, fixed to the side frames 12. In this, the necessary offset in the on/off adjustment of the nip points is enabled by the couplings 148. In one advantageous embodiment that is not illustrated here, in a further development of the embodiment according to FIG. 30, the individual drive motors 121, especially with the adapter transmission 150 for each printing unit cylinder 06; 07 are rigidly connected not to the side frame 12, but directly to the movable bearing element 74, for example they are screwed on, and are moved along with the adjusting movement. To support the drive motors 121, a bracket with a guide can be provided on the side frame 12, on which bracket the drive motor 121 is supported and can be moved along with the movement of the relevant cylinder 06; 07 in the direction of adjustment S.

FIG. 31 through 35 show an embodiment of the inking unit 08 or the inking unit drive, advantageous, for example, in terms of ink transport and wear and tear, which alone, but also in combination with one or more characterizing features of the aforementioned printing units 01, contains benefits.

The inking unit 08, referred to, for example, as a single-train roller inking unit 08 or also as a "long inking unit", has a plurality of the rollers 28; 33; 34; 36; 37 mentioned above. It comprises, according to FIG. 31, at least two forme rollers 28 that apply ink to the printing forme of the forme cylinder 07, which rollers receive the ink via an oscillating distribution roller 33.1 or distribution cylinder 33.2, for example with a hard surface that is near the printing forme or forme cylinder, an inking or transfer roller 34, for example with a soft surface, a second oscillating distribution roller 33.2 or distribution cylinder 33.2 that is distant from the forme cylinder, another inking or transfer roller 34, for example with a soft surface, a film roller 37 and a fountain or dipping roller 36 from an ink fountain 38. Dipping and film rollers 36; 37, characteristic of a film inking unit can also advantageously be replaced by another ink supply or metering system, for example a pump system in an ink injector system, or a vibrator system in a vibrator inking unit.

Figure 31:
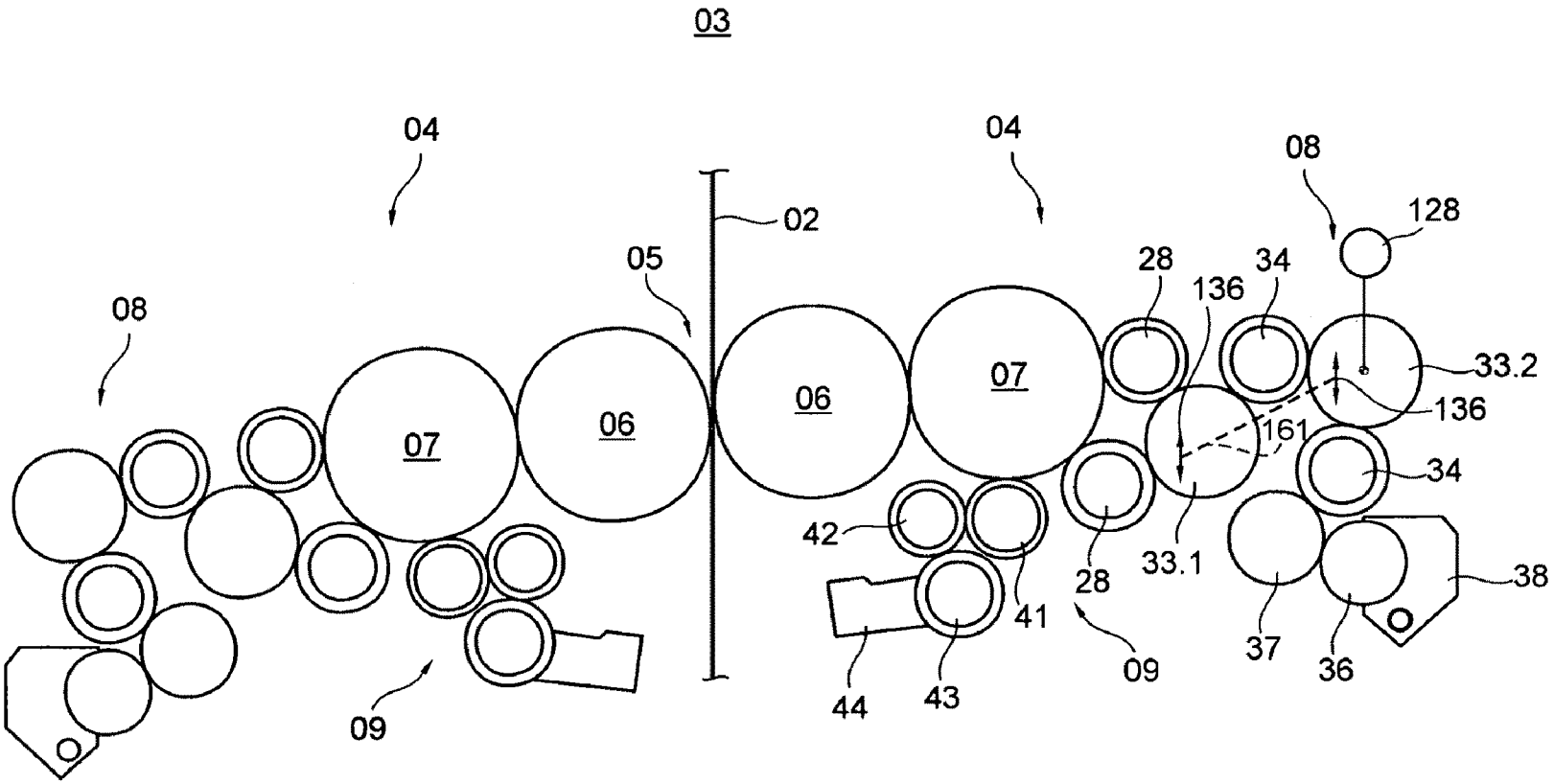
FIG. 31 an enlarged representation of a blanket-to-blanket printing unit built according to the planar construction principle.

The soft surfaces of the forme and/or transfer rollers 28; 34, in short: soft rollers 28; 34 are resilient in a radial direction. For example, they are configured with a rubber layer, which is indicated in FIG. 31 by the concentric circles.

Now if the rollers 28; 33; 34; 37 of the inking unit 08 are positioned adjacent to one another, then the hard surfaces of the distribution cylinders 33.1; 33.2 dip into the soft surfaces of the respective cooperating soft rollers 28; 34 to a greater or lesser extent, based upon contact pressure and/or the adjustment path. In this manner, based upon the impression depth, the circumferential ratios of rollers 28; 33; 34; 37 that roll against one another change.

If, for example, for one of multiple cooperating rollers a forced rotational actuation occurs based upon a preset speed, for example via a drive motor or a corresponding mechanical drive connection to another actuated component, then an adjacent soft roller that is actuated only via friction from the former roller, rotates at a different speed based upon impression depth. However, if this soft roller were to also be actuated by its own drive motor, or additionally via friction at a second nip point by another speed-set roller, then, in the first case, this could result in a difference between the motor-driven preset speed and the speed caused by friction, and in the second case it could result in a difference between the two speeds caused by friction. At the nip points, this results in slip and/or the drive motor or motors are unnecessarily stressed.

In the area of the inking unit 08 near the forme cylinder, especially in the area of the application of ink by the rollers 28 onto the printing forme, with the solution described below a slip-free rolling, or "true rolling" and inking are achieved The distribution cylinder 33.1 near the forme cylinder is rotationally actuated only via friction from the adjacent rollers 28; 34, and for its rotational actuation does not have an additional mechanical drive connection for actuating the printing group cylinders 06; 07, or another inking unit roller that is forced into rotational actuation, or its own separate drive motor. In this manner, the first distribution cylinder 33.1 is rotationally actuated predominantly via the, in this example, two, optionally also one or three forme rollers that are actuated by virtue of friction with the forme cylinder 07, and essentially has the circumferential speed of the forme cylinder, independent of the impressions in the nip points that lie between them. The distribution cylinder 33.2 that is distant from the forme cylinder, as indicated in FIG. 31, has a drive motor 128 that actuates it rotationally, but, aside from the friction gearing formed with the rollers 33.2; 34; 33.1, has no mechanical coupling with the first distribution cylinder 33.1. In the case of more than two distribution cylinders 33.1; 33.2, for example three, the two that are distant from the forme cylinder can be forced into rotational actuation. Alternatively, only the center distribution cylinder 33.2, or the one that is farthest from the forme cylinder, can be forced into rotational actuation.

Preferably, both distribution cylinders 33.1; 33.2 have an oscillation or friction gearing 136 that is symbolized in FIG. 31 by respective double arrows.

In an embodiment that is mechanically less involved, the distribution cylinder 33.1 that is near the forme cylinder has its own oscillation gearing 136 that converts only its rotational motion into an oscillating motion. This can advantageously be configured as a cam mechanism, wherein, for example, an axial stop, that is fixed to the frame, operates in conjunction with a curved, peripheral groove secured to the roller, or an axial stop that is fixed to the roller, in a peripheral groove of a cam disk, which is fixed to the frame. In principle, this transmission 136 that converts the rotation to an oscillating axial linear stroke, can be implemented as another suitable transmission 136, for example as a worm gear or crank mechanism that has an eccentric.

As is symbolized in FIG. 31 by a dashed line that connects the double arrows, the oscillation gearing 136 of the first distribution cylinder 33.1 is advantageously mechanically coupled to the oscillation gearing 136 of the second distribution cylinder 33.2 via a transmission 161. The two coupled oscillation gearings 136 advantageously represent a shared oscillation drive 162, oscillation gearing 162 and are force actuated for their oscillating movement via a drive motor. Preferably, the forced actuation of the oscillation gearing 162 is accomplished via the drive motor 128 that rotationally actuates the second distribution cylinder 33.2 (FIG. 32).

Figure 32:
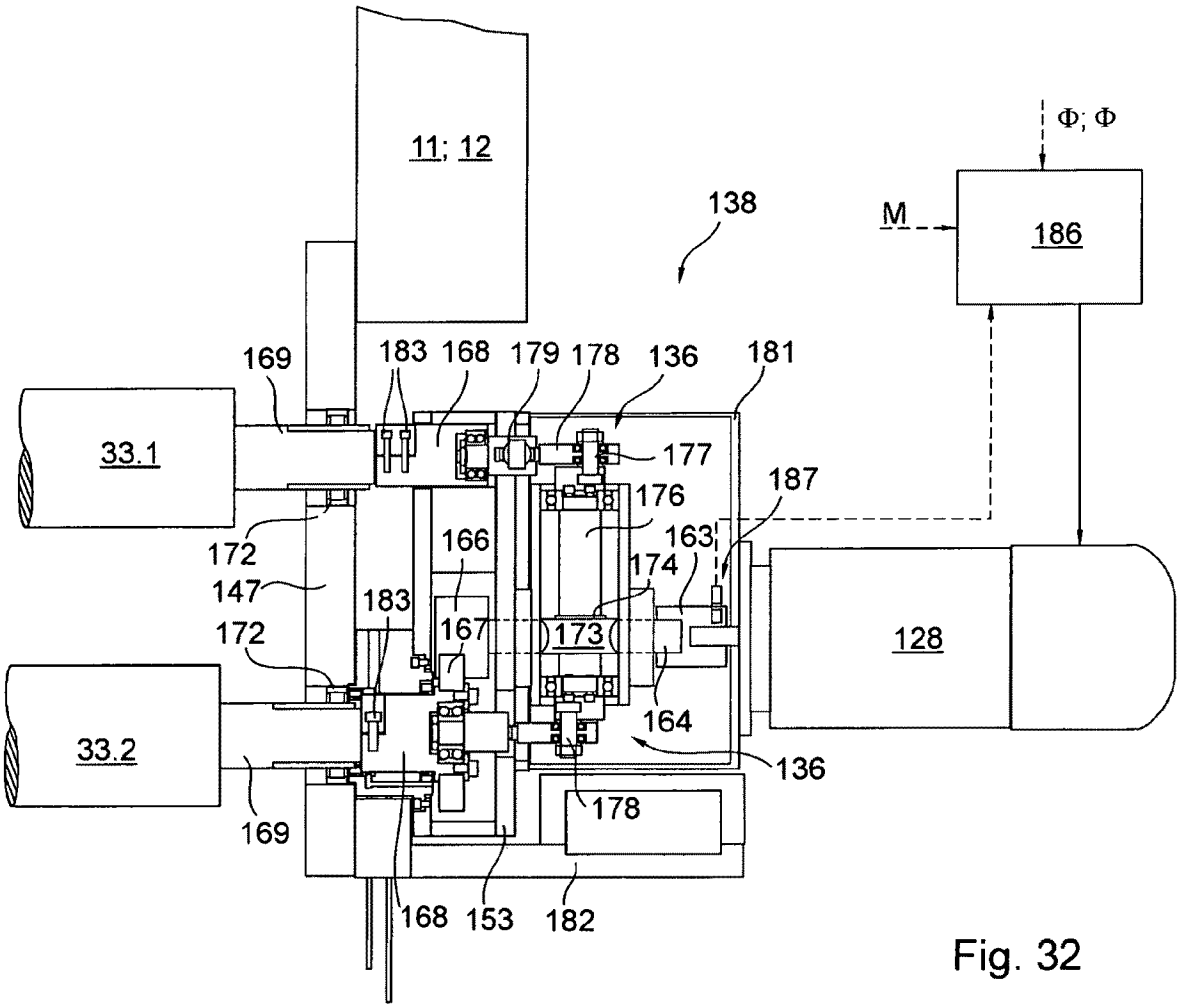
FIG. 32 a preferred embodiment of an inking unit drive.
Figure 33:
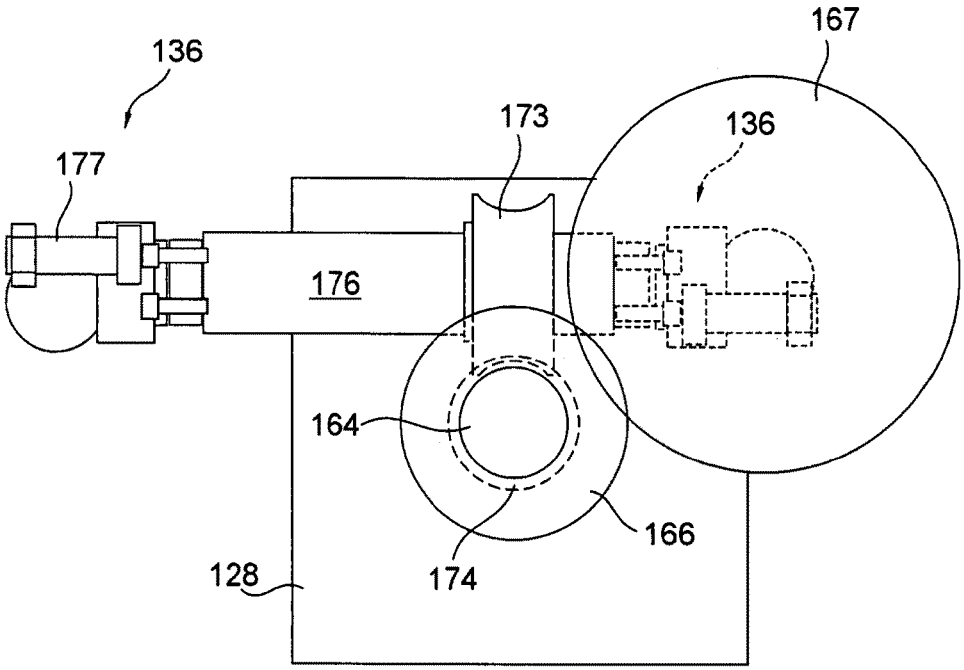
FIG. 33 a partial section of the inking unit drive according to FIG. 32.

In FIGS. 32 and 33, an advantageous embodiment for the actuation of the distribution cylinders 33.1; 33.2 is illustrated. Only the second distribution cylinder 33.2 is forced into rotational actuation, but both distribution cylinders 33.1, 33.2 are forced into axial actuation via the shared oscillation drive 162. The printing group cylinders 06; 07 can be implemented either in pairs, as represented in FIG. 26, with drive motors 121 for each cylinder pair, or advantageously individually, each with its own separate drive motor 121, as represented in FIG. 30.

In this embodiment, the drive motor 128 drives via a coupling 163 via a shaft 164 on a drive sprocket 166, which, in turn, acts in conjunction with a spur gear 167 that is non-rotatably connected to the second distribution cylinder 33.2. The connection can be made, for example, via an axle section 168, which supports the spur gear 167, on a journal 169 of the second distribution cylinder 33.2.

A corresponding axle section 168 of the first distribution cylinder 33.1 has no such spur gear 167 or no drive connection to the drive motor 128. The drive connection between the drive sprocket 166 and the spur gear 167 of the second distribution cylinder 33.2 are preferably evenly toothed and configured with a tooth engagement that has a sufficiently large overlap for each position of the oscillating movement. The two distribution cylinders 33.1; 33.2 are mounted in a frame 147 that is formed on the side frame 147 or the frame 16, in bearings 172, for example radial bearings 172, which also enable axial movement. In this, there is no rotational drive connection between the drive motor 128 and the first distribution cylinder 33.1. The drive sprocket 166 and the spur gear 167, which is arranged on the axle section 168, together represent a transmission, especially a speed-reducing transmission, which itself forms a unit that can be closed and/or preassembled and has its own housing 153. At the output side, the unit can be coupled with the journals 169.

The oscillation drive 162 is also actuated, for example via a worm gear 173, 174, by the drive motor 128. In this, actuation is accomplished via a worm 173 arranged out of the shaft 164 or via a section of the shaft 164 configured as a worm 173 on a worm gear 174, which is non-rotatably connected to a shaft 176 that extends perpendicular to the rotational axis of the distribution cylinder 33.1; 33.2. In each case, on the end surface of the shaft 176, a driver 177 is arranged eccentrically to the rotational axis of the shaft, which is, in turn, connected to the journals 169 of the distribution cylinder 33.1; 33.2, for example via a crank mechanism, for example via a lever 178 that is rotatably mounted on the driver 177 and a joint 179, so as to be rigid to pressure and tension in the axial direction of the distribution cylinder 33.1; 33.2. In FIG. 31 the friction gearing 136 of the distribution cylinder 33.2 that is distant from the forme cylinder is indicated only by a dashed line, as in this view it is covered by the spur gear 167. A rotation of the shaft 176 causes the driver to rotate, which, in turn, effects the linear travel of the distribution cylinder 33.1; 33.2 via the crank drive. The output on the oscillation gearing 162 can also occur at another point in the rotational drive train between the drive motor 128 and the distribution cylinder 33.2, or even on a corresponding oscillation gearing 162, on the other side of the machine from the journal 169 that is located at the other end surface of the distribution cylinder 33.2. A transmission that is different from a worm drive 173, 174 for decoupling the axial drive can also optionally be provided.

As represented in FIG. 32, the oscillation drive 162 or the oscillation gearing 162 is configured as a complete structural unit with its own housing 181, which can also be implemented as an encapsulated unit. The oscillation gearing 162 can be lubricated in the encapsulated space with oil, but is preferably lubricated with a grease. The oscillation gearing 162 is supported in the embodiment shown in FIG. 32 by a mount 182 that is connected to the side frame 147. In this, the drive motor 128 is separably connected to the housing 181 of the oscillation gearing 162.

Figure 34:
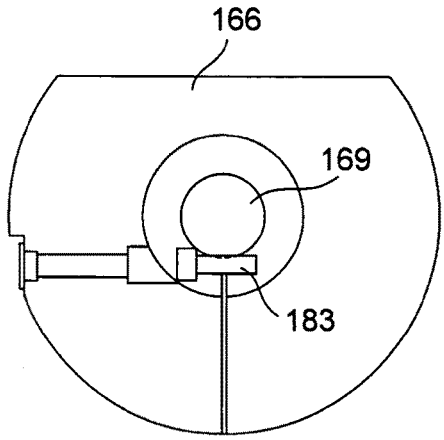
FIG. 34 a section through a non-rotatable connection from FIG. 32.

FIG. 34 shows an advantageous embodiment of a torsionally rigid connection between the axle section 168 and the respective journal 169. In this embodiment, rotation involves frictional contact, which is produced by a clamping of a tapered section of the journal 169 by the slotted axle section 168 that encompasses it. The position of a clamping screw 183 is measured such that, viewed crosswise to the rotational axis of the journal 169, it dips at least partially into a peripheral groove in the journal 169. It therefore represents a positive securing of the connection in an axial direction.

Figure 35:
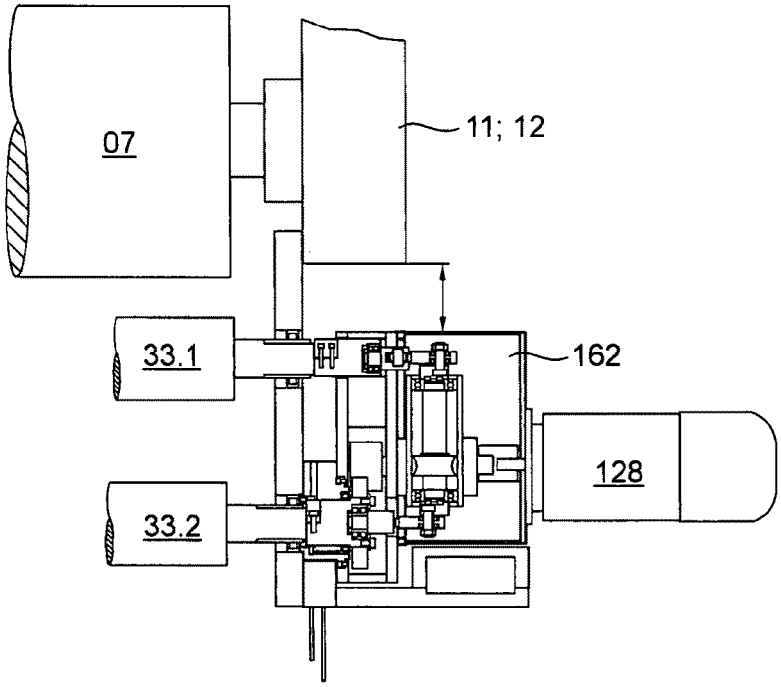
FIG. 35 a first position a) and a second position b) of the inking unit drive.
Figure 35:
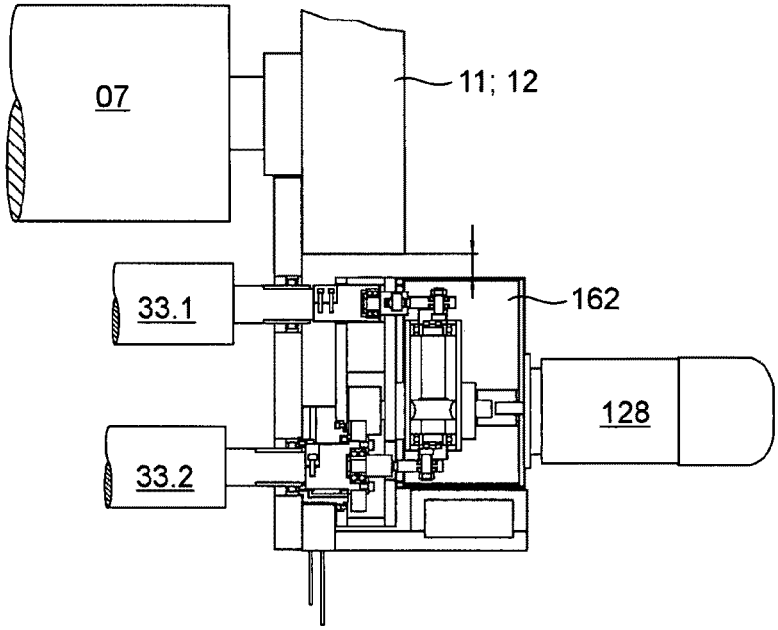

With reference to FIG. 35, a further advantageous development is described. The distribution cylinder 33.1; 33.2, along with the rotational and axial drive, are arranged in the manner of a module that can be preassembled and/or moved, on its own side frame 147 (16), which is structurally separate from the side frame 11; 12 that supports the printing group cylinders 06; 07. A second frame side, which supports the distribution cylinders 33.1; 33.2 on their other end surface, is not shown here. These side frames 147 (16) that support the distribution cylinders 33.1; 33.2 and their drive can then be positioned on the side frame 11; 12, based upon the size and geometric arrangement of the printing group cylinders 06; 07. FIGS. 35*a*) and 35*b*) show a position of the side frames 147 (16) and 11; 12 relative to one another, when one larger (a) and one smaller (b) forme cylinder 07 are in use. A distance, indicated by the double arrow in FIG. 35, between the side frame 11; 12 and the inking unit drive, in this case the oscillation gearing 162, is then different, based upon the position of the inking unit 08 that is implemented in the manner of a module. Thus, printing units 01 having printing group cylinders 06; 07 with different circumferential formats can be operated in a simple manner using the same inking unit 08.

The transmission unit, which is preferably preassembled as a module, from an axial gearing and/or oscillation gearing 162 can be completely pre-assembled as a sub-unit for the inking units 08 that are implemented, for example, as a module, and in an advantageous embodiment can be pre-mounted on the side frame 147 (16) of the inking unit module before being installed in the printing unit 01. On the other hand, modularity also allows the installation/replacement/exchange of the transmission that is implemented as a module when the inking unit module has already been installed in the machine.

Because the distribution cylinder 33.1 that is near the forme cylinder has no forced rotational actuation, the rollers 28 (34) roll against one another largely without slip, at least in the area of the inking unit that is near the forme cylinder.

In principle, the drive motor 128 that rotationally drives the second distribution cylinder 33.2 can be configured as an electric motor that can be controlled or regulated with respect to its output and/or its torque and/or also with respect to its speed. In the latter case, if the drive motor 128 is operated in a speed-regulated/controlled fashion even in the print-on setting, then, in the area of the inking unit 08 that is distant from the forme cylinder, the aforementioned problems involving the different effects of roller circumferences can still occur.

With respect to the aforementioned set of problems involving a preset speed competing with the friction gearing, however, the drive motor 128 is advantageously configured such that it can be controlled or regulated at least during the printing operation with respect to its output and/or its torque. In principle, this can be accomplished by the use of a drive motor 128 that is implemented as a synchronous motor 128 or as an asynchronous motor 128:

In a first embodiment, which is the simplest, the drive motor 128 is structured as an asynchronous motor 128, for which, in an allocated drive control 186, only one frequency, for example when the inking unit 08 is in the print-off position and/or one electrical drive output or one torque, when the inking unit 08 is in the print-on position is preset. In print-off for the inking unit 08, in other words when the forme rollers 28 are out of rolling contact with the forme cylinder 07, the inking unit 08 can be placed in a circumferential speed that is suitable for the print-on position, using the preset frequency and/or drive output, via the second distribution cylinder 33.2, at which speed the circumferential speeds of the forme cylinder 07 and forme rollers 28 differ by less than 10%, especially less than 5%. This limit advantageously also applies as a condition for the print-on position in the embodiments listed below. A preset frequency or output suitable for this can be determined empirically and/or through calculation performed in advance, and either in the drive control itself, in a machine control, or in a data processor of a control center. The preset value can preferably be changed by the operator, which advantageously also applies to the preset values listed below.

In the print-on position, in other words when the forme rollers 28 are in rolling contact with the forme cylinder 07, and all the inking rollers are engaged against one another, the rollers 28; 33; 34; 33; 34; 37 are rotationally actuated, in part, by the forme cylinder 07 via the friction gearing now produced between the rollers 28; 33; 34; 33; 34; 37, so that the drive motor 128 need only apply the dissipated power that increases in the friction gearing with its increasing distance from the forme cylinder 07. In other words, the drive motor 128 can be operated at a low drive torque or a low driving output, which contributes only to keeping the rear area of the inking unit 08 at the circumferential speed that is predetermined essentially by the frictional contact. In a first variant this driving output can be held constant for all production speeds, or speeds of the forme cylinder 07 and can correspond either to that preset value for starting up in print-off, or can represent its own constant value for production. In a second variant, for different production speeds, and optionally for starting up in print-off, different preset values, with respect to frequency and/or driving output can be predetermined and stored. Depending upon the production rate or production speed, the preset value for the drive motor 128 can then vary.

In a second embodiment, in addition to the drive control 186 and the asynchronous motor 128 of the first embodiment, the drive also has a rotational speed reset, so that in the phase in which the inking unit operation is in print-off, the drive motor 128 can be essentially synchronized with the speed of the assigned forme cylinder 07 or of the printing group cylinder 06; 07. In this, a sensor system 187, for example an angular sensor 187, configured to detect actual speed, can be arranged on a rotating component, for example a rotor of the drive motor 128, the shaft 164, that is non-rotatably connected to the distribution cylinder 33.2. In FIG. 32, an angular sensor 187 that is equipped with a rotating initiator and a sensor 187 that is fixed in place is represented by way of example on the coupling 163, wherein the signal of that sensor is transmitted via a signal connection, that is represented by a dashed line, to the drive control 186 for further processing. With the rotational speed reset, the comparison with a speed M that represents the machine speed and a corresponding adjustment of the output or frequency preset value, a slip in the momentum of the print-on position can be prevented or at least minimized to a few percent. In print-on operation, the drive motor 128 can then preferably be operated no longer strictly according to the described rotational speed reset, but essentially according to the above-described frequency or preset output values.

A third embodiment has a synchronous motor 128 in place of the asynchronous motor 128 of the second embodiment. A rotational speed reset and a relevant synchronization and regulation in the print-off phase are accomplished according to the second embodiment, for example, in the drive control 186.

In a fourth embodiment, a drive motor 128, especially a synchronous motor 128, is provided, which is optionally speed-controlled in a first mode, for the inking unit 08 in print-off and in a second mode can be controlled with respect to torque, for the inking unit 08 in print-on. For speed control, the drive control 186 and the drive motor 128 preferably again have an inner control circuit, which, similar to the second embodiment, comprises a reset for an external angular sensor 187 or a sensor system internal to the motor. When synchronous motors 128 are used, a plurality of these synchronous motors 128 in a printing unit 01 can be assigned a shared frequency transformer or converter.

A further development of the fourth embodiment, which is advantageous in terms of versatility but is more costly, involves the configuration of the drive motor 18 as a servo motor 128 that can optionally be position- and momentum-controlled, in other words, a three-phase alternating current synchronous motor with a device that allows the relevant rotational position or the formed rotational angle to be determined based upon an initial position of the rotor. The reporting of the rotational position can be accomplished via an angular sensor, for example via a potentiometer, a resolver, an incremental position transducer or an encoder. In this embodiment, each drive motor 128 is equipped with its own frequency transformer or converter.

In the case of a drive motor 128 that is implemented in the manner of the second, third, or especially fourth embodiment, and can be at least speed-synchronized, especially speed-controlled, the drive control 186 is advantageously in signal connection with a so-called virtual control axis, in which an electronically generated control axis position $\phi$ rotates. The rotating control axis position $\phi$ serves in synchronization, with respect to the correct angular position and its temporal change or angular velocity $\phi$ in mechanically independent drive motors of units that are assigned to the same web, especially drive motors 121 of individual printing group cylinders 06; 07 or printing group cylinder groups (pairs), and/or the drive of a folding unit. In the operating mode in which the inking unit 08 is to be actuated in synchronization with respect to the speed of the forme cylinder 07, a signal connection with the virtual control axis can thus supply the information on machine rate or speed to the drive control 186.

Preferably, in the actuation of the distribution cylinder 33.2 via the drive motor 128, the process is thus that when the inking unit 08 is running, but is in the print-off position, when the forme rollers 28 are disengaged, the drive motor 128 is actuated in a controlled or regulated fashion with respect to a speed, and when the machine is running, as soon as the inking unit 08, such as the forme rollers 28 has been adjusted to the print-on position, the speed regulation or control is intentionally abandoned. In other words, a speed is no longer maintained, and instead the drive motor 128 is operated in the further process with respect to a torque, for example at a predetermined electrical power, and/or with respect to a torque that can be adjusted using the controller of a drive motor 128, especially an asynchronous motor 128. The torque that is to be adjusted, or the power to be adjusted, is, for example, chosen to be lower than a threshold torque, which would lead to a first rotation, under slip of the driven distribution cylinder 33.2 with a cooperating roller 34 that is engaged but is fixed with respect to rotation.

The load characteristics of a drive motor 128 configured as an asynchronous motor 128 coordinate with the behavior targeted for this purpose in such a manner that with an increasing load, a frequency decrease with a simultaneous increase in drive torque takes place. If, in the friction gearing between the forme cylinder 07 and the second distribution cylinder 33.2, for example, a great deal of drive energy and thus circumferential speed stemming from the forme cylinder 07 is lost, so that the load of the drive motor 128 increases, then the increased momentum is provided at a diminished frequency. Conversely, little momentum is transmitted by the drive motor 128, it runs quasi empty, when sufficient energy is transmitted via the friction gearing to the distribution cylinder 33.2.

The embodiment of the cylinder bearings as bearing units 14 and/or the cylinders 06; 07 as a cylinder unit 17 and/or the inking units 08 in the manner of modules and/or the drives in the manner of drive modules and/or the separability of the printing unit 01 enables, depending upon the equipment to different extents, a simplified on-site assembly and therefore extremely short assembly and start-up times for clients.

Thus, for example, the side frames 11; 12 or panel sections 11; 12; 47 are set up and aligned, and the cylinder units 17 and/or inking units 08 and/or dampening units 09 are preassembled in the manner of modules outside of the side frames 11; 12.

In this, the cylinders 06; 07 are loaded with their bearing units 14 outside of the frames 11; 12, and are then installed and fastened as complete cylinder units 17 between the side frames 11; 12. Then from the outside of the side frame 11; 12, through corresponding recesses in the frame, depending upon the drive embodiment, the drive unit is connected in the manner of a drive module, for example transmission 150 or drive train 122 with the corresponding drive motor 121, optionally via the shaft 78 to the journal 63; 64.

If the printing unit 01 is implemented such that it can be separated in the area of the printing points 05, then the cylinder units 17 are preferably installed when the printing unit 01 is open, from the space that is formed between the two printing unit sections 01.1; 01.2, and the unit is closed again only following installation.

If the printing unit 01 is implemented so as to be separable on both sides of the blanket-to-blanket printing unit 03 up to the inking units 08 (FIG. 24), then the cylinder units 17 are preferably installed when the printing unit 01 is opened between the printing group cylinders 06; 07 and the panel sections 47 that accommodate the inking units 08, from the intermediate space that is formed there, and the unit is closed again only after installation.

For the inking units 08, the frames 16 or 147 allocated specifically to the inking units are loaded outside of the side frames 11; 12 with the appropriate rollers, from 26 through 39 and the corresponding drive module 138, optionally already including the drive motor 128, and are installed as a unit into the printing unit 01 and secured there.

With the dampening units 09, frames allocated specifically to the dampening units are also loaded with the appropriate rollers, from 41; 42; 43; 47; 48 while they are still outside of the side frames 11; 12 and, if necessary in the desired embodiment, with the corresponding drive module 138, optionally with or without its own drive motor 132, and are installed as a unit into the printing unit 01 and secured there.

Figure 39:
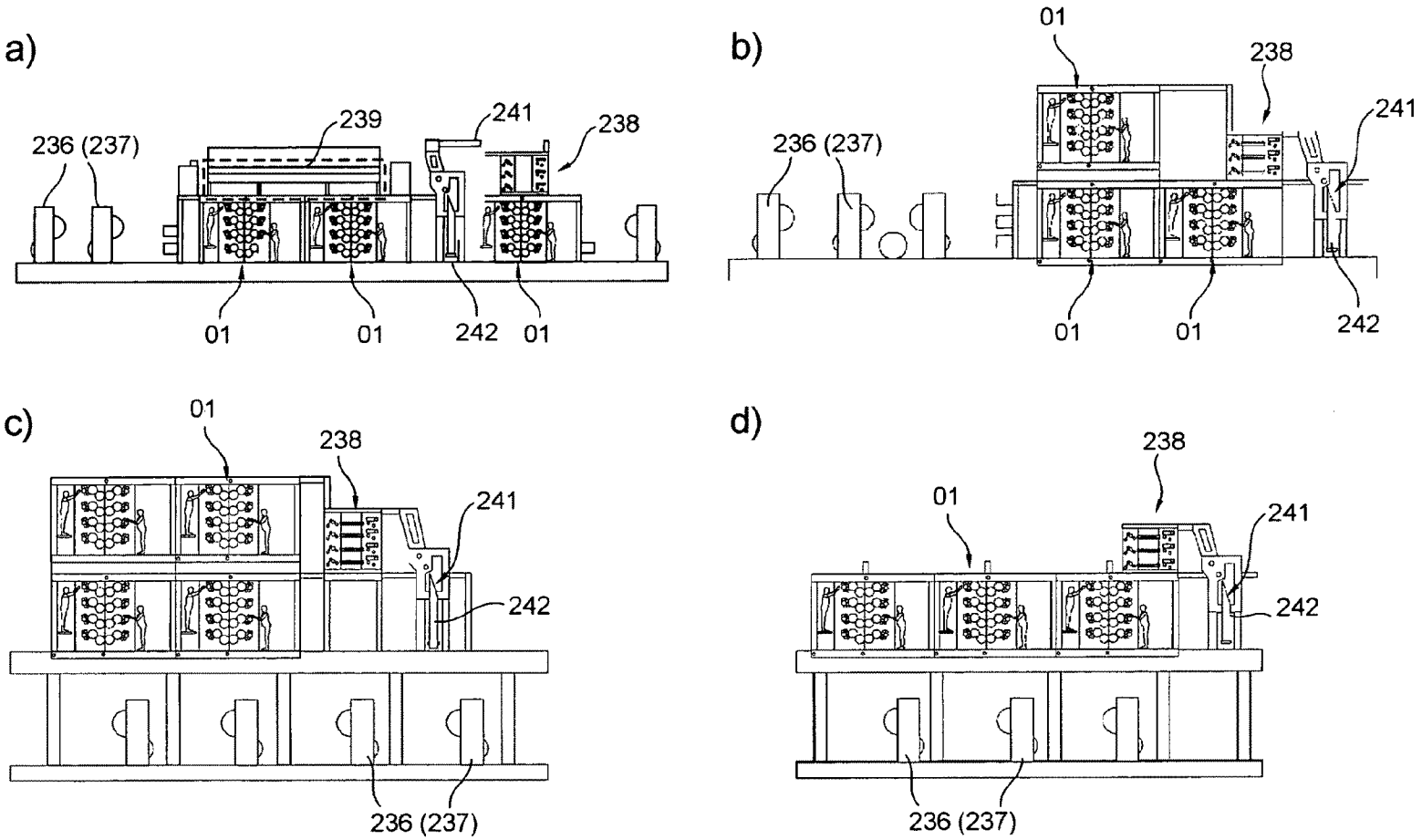
FIG. 39 a schematic representation of four embodiments a), b), c) and d) of a printing machine with separable or optionally non-separable printing units.

FIGS. 39*a*) through 39*d*) show schematic illustrations of four embodiments of a printing machine, which comprise a plurality of the above-described, separable or optionally non-separable, printing units 01. The printing machines are equipped with reel changers 236 with infeed units 237 that are not explicitly illustrated here, a superstructure 238 with at least one longitudinal cutting device, a turning deck and a longitudinal register device for longitudinally cut partial webs, an optional dryer 239, illustrated, by way of example, by a dashed line, a former structure 241 with one, two or even three fold formers, depending upon the width of the web, arranged side by side in a single plane, and a folding unit 242. With this printing machine that has three printing units 01, in the case of an embodiment that has printing cylinders 06; 07 that are double-width, in other words four printed pages, especially newspaper pages wide, and double-sized, with three webs 02 a total of 48 pages can be printed, each in four colors.

FIG. 39*a*) shows the printing machine in a parterre arrangement, in other words the printing units 01 and the reel changers 236 are aligned within the same plane. In FIG. 39*b*), a printing machine is represented, wherein two printing units 01, each with four blanket-to-blanket printing units 03, are arranged in two different planes. Especially the upper printing unit 01 is arranged with its entire height above the lower printing unit 01. With this printing machine that has three printing units 01, in the case of an embodiment that has printing cylinders 06; 07 that are double-width, in other words four printed pages, especially newspaper pages wide, and double-sized, with three webs 02 a total of 48 pages can be printed, each in four colors.

FIG. 39*c*) shows a printing machine in three planes, wherein the reel changers 236 are arranged in a lowest plane, and in the two planes that lie above this, two printing units, each containing four blanket-to-blanket printing units 03, are arranged one above another. Here, by way of example, the printing machine has two pairs of this type of two printing units 01 arranged one above another. With this printing machine that contains four printing units 01, in the case of an embodiment that has printing cylinders 06; 07 that are double-width, in other words four printed pages, especially newspaper pages wide, and double-sized, with four webs 02 a total of 64 pages can be printed, each in four colors.

In FIG. 39*d*) a printing machine in two planes is illustrated, wherein the reel changers 236 are arranged in the lower plane, and in the plane above this, the printing units 01, each containing four blanket-to-blanket printing units 03, are arranged. With this printing machine that contains three printing units 01, in the case of an embodiment that has printing cylinders 06; 07 that are double-width, in other words four printed pages, especially newspaper pages wide, and double-sized, with three webs 02 a total of 48 pages can be printed, each in four colors.

For all the embodiments of a printing machine having one or more of the aforementioned characterizing features related to separability and/or modularity and/or the cylinder arrangement on the inner panels of the side frame 11; 12 and/or the linear arrangement and/or the special linear bearing and/or the mentioned on/off setting and adjustment of the cylinders 06; 07 and/or the drive modules 122; 138; 139; 146, a folding unit 242 with its own drive motor that is configured to be mechanically independent from the printing units 01, and/or with a variable format or cut-off length, i.e. a variable-format folding unit 242 is preferably provided.

Figure 40:
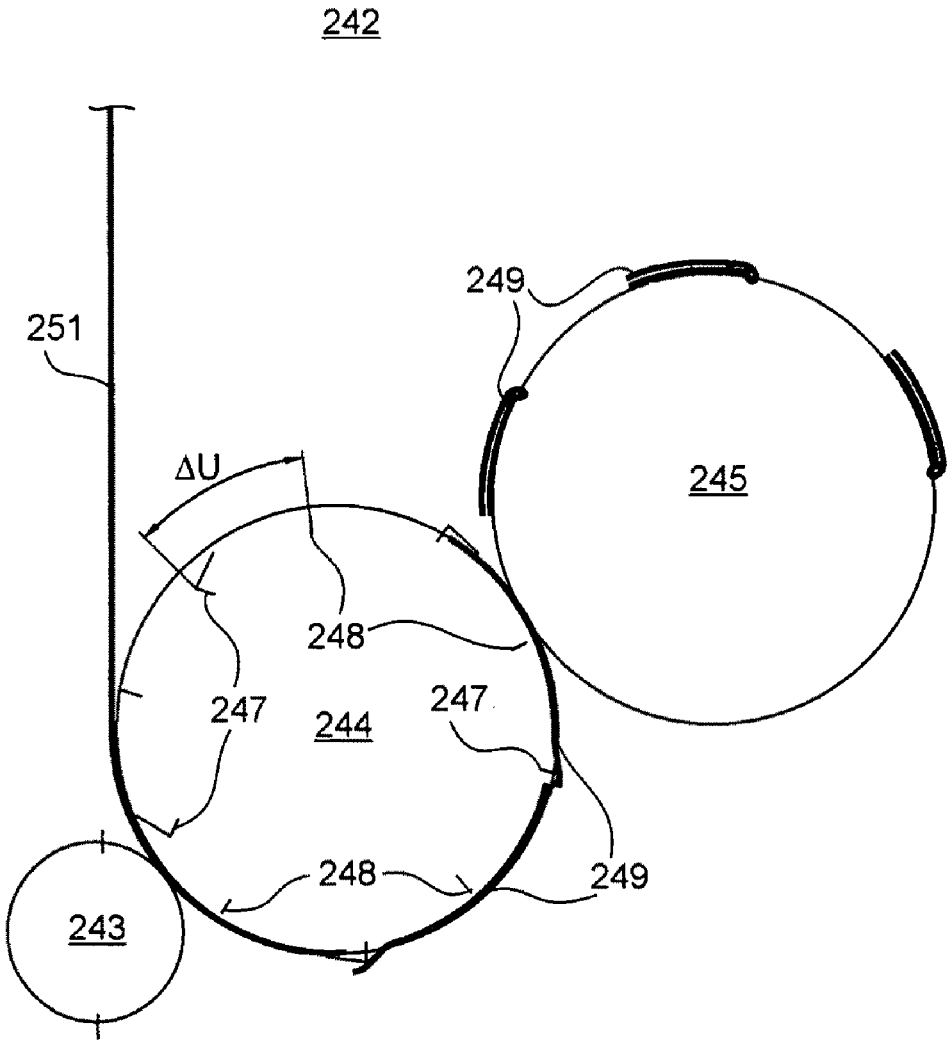
FIG. 40 a schematic representation of a folding unit.

The folding unit 242 illustrated schematically in FIG. 40 has, for example, a cutting cylinder 243, a transport cylinder 244 and a jaw cylinder 246. At least the transport cylinder 244, which is configured as a tucker blade cylinder 244, is configured to be format variable. In other words, a distance $\Delta U$ in a circumferential direction between the holding elements 247 and the respective tucker blades 248 arranged downstream on the circumference of the transport cylinder 244 is configured to be adjustable. In this configuration, the holding elements 247, implemented, for example, as pin strips or grippers, can be arranged on one side, while the tucker blades 248 are arranged on the other side on two different coaxially arranged cylinders, which are capable of rotating toward one another in a circumferential direction. If the distance AU between the holding elements 247 and the tucker blades 248 arranged downstream is decreased, then a product section 249 cut off crosswise from a line 251 by the cutting cylinder 243 will be folded crosswise after a shorter cut-off length when the tucker blade 248 is extended, and vice-versa. The line 251 can be comprised of one or more longitudinally folded or unfolded webs 02 or partial webs.

The drive control described below is advantageous in principle, independent of the above-described separability and/or modularity and/or the cylinder arrangement on the inside panels of the side frame 11; 12 and/or the linear arrangement and/or the special linear bearing and/or the mentioned on/off position adjustment of the cylinders 06; 07 and/or the drive modules. However, particular advantages are achieved specifically in combination with one or more of the listed characterizing features, especially in combination with units that are actuated mechanically independently of one another, for example a mechanically independently actuated folding unit 219 and/or printing unit 01 and/or infeed unit 214 and/or cylinders 06; 07 or cylinder groups and/or guide elements of a superstructure 216.

Figure 41:
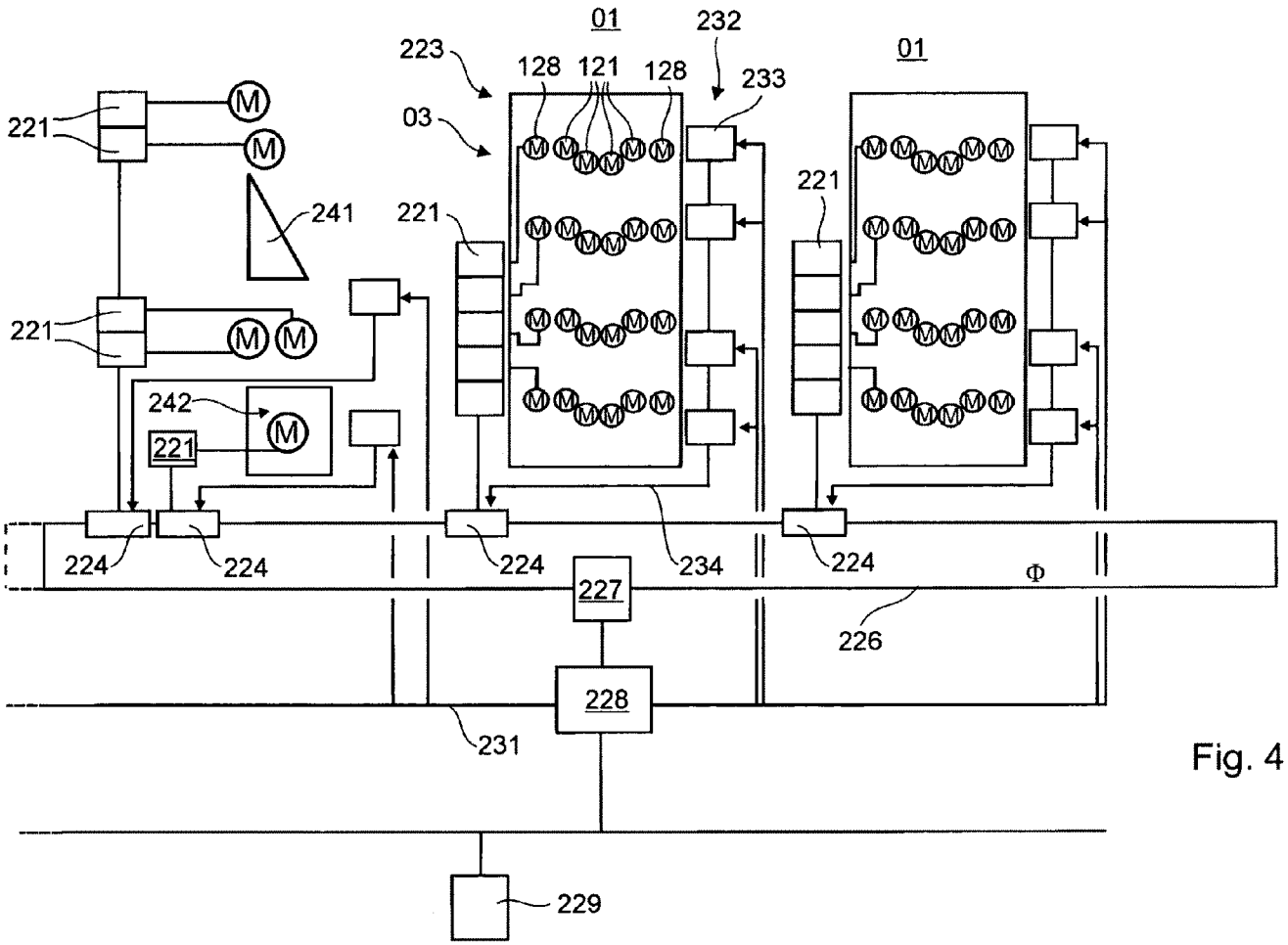
FIG. 41 a preferred embodiment of a drive for a printing machine.

FIG. 41 shows an example of a drive for a printing machine having multiple, in this case two, printing units 01 implemented as printing towers 01, each of which has multiple printing units 03, in this case blanket-to-blanket printing units 03. The printing units 03 of a printing tower 01, along with their drive controllers 221, in short their drives 221 and drive motors 121; 128, together form a group 223, for example a drive motor 223, especially a printing point group 223, which is connected via a subordinate drive control 224 for this group 223 to a first signal line 226 that guides signals from a respective control axis position $\phi$ of a virtual control axis. However the subordinate drive control 224 can also manage sub-groups of printing units 01 or other sections. Other units having their own subordinate drive control 224, for example one or more control elements for a superstructure 238 and/or a former structure 241 and/or one or more fold units 242, are also connected to this signal line 226. In this case, the signal line 226 is advantageously implemented as a first network 226 in ring topology, especially as a sercos ring, which receives the control axis position $\phi$ from a superordinate drive control 227 that is connected to the network 226. This generates the continuous control axis position $\phi$ on the basis of default values with respect to a predetermined production speed, which it receives from a computing and/or data processing unit 228, for example a sectional computer. The computing and/or data processing unit 228 in turn receives the default data on the production speed from a control center 229 or control center computer 229 that is connected to it.

In order to ensure printing and/or longitudinal cutting that are true to register, the units that are actuated mechanically independently of one another, for example based upon a web lead, are in the correct angular position in relation to one another. To accomplish this, offset values $\Delta\phi_1$ for the individual drives 221 are maintained, which define the angular position relative to the shared control axis and/or relative to one of the units that is correct for production.

The offset values $\Delta\phi_1$ that are relevant for the individual drives 221 are supplied for the relevant production by the computing and data processing unit 228, via a second signal line 231 that is different from the first signal line, especially a second network 231, to the subordinate drive controls 224 that are assigned to the respective drive 221, and are stored there in an advantageous embodiment, and processed using the control axis position $\phi$ to determine corrected control axis positions $\phi_1$.

The offset values $\Delta\phi_1$ are transmitted to the subordinate drive controls 224, for example, either via corresponding signal lines by the second network 231 directly to the drive control 224, not shown, or advantageously via a control system 232, to which the respective group 18 or the unit that has its own subordinate drive control 224 is allocated. To this end, the control system 232 is connected to the second network 231, or to the computing and data processing unit 227. The control system 232 controls and/or regulates, for example, the control elements and drives of the printing units 03 or folding units 242 that are different from the drive motors 121; 128, for example ink supply, adjustment movements of rollers and/or cylinders, dampening unit, positions, etc. The control system 232 has one or more, especially memory-programmable control units 233. This control unit 233 is connected via a signal line 234 to the subordinate drive control 224. In the case of multiple control units 233, these are also connected to one another via the signal line 234, for example a bus system 234.

Thus the drives 221 receive the absolute and dynamic information regarding the circulation of a shared control axis position $\phi$ that forms the basis via the first network 226, and the information necessary for a processing that is true to register, especially offset values $\Delta\phi_1$ for the relative positions of the drives 221 or units that are mechanically independent of one another, are transmitted via a second signal path, especially via at least one second network 231.

The aforementioned individual advantageous characterizing features, or multiple advantageous characterizing features that are related to one another, bearing unit 14, plane E, linear adjustment path S, modularity, drive trains for the horizontal blanket-to-blanket printing unit 03 can also be applied to I-printing units, in other words to blanket-to-blanket printing units 03 that are rotated essentially 90°. Up to the characterizing feature of the flat printing unit 03, the characterizing features of the bearing unit 14 and/or the linear adjustment path S and/or the modularity and/or the drive trains can also be applied to nine- or ten-cylinder satellite printing units, alone or in combination.

In what follows, devices used to adjust a contact force exerted by one roller in a roller strip against an adjacent rotational body, and/or to engage said roller against said rotational body and/or to disengage said roller from said rotational body, and the respective control or regulation of these devices, will be described in greater detail.

Figure 43:
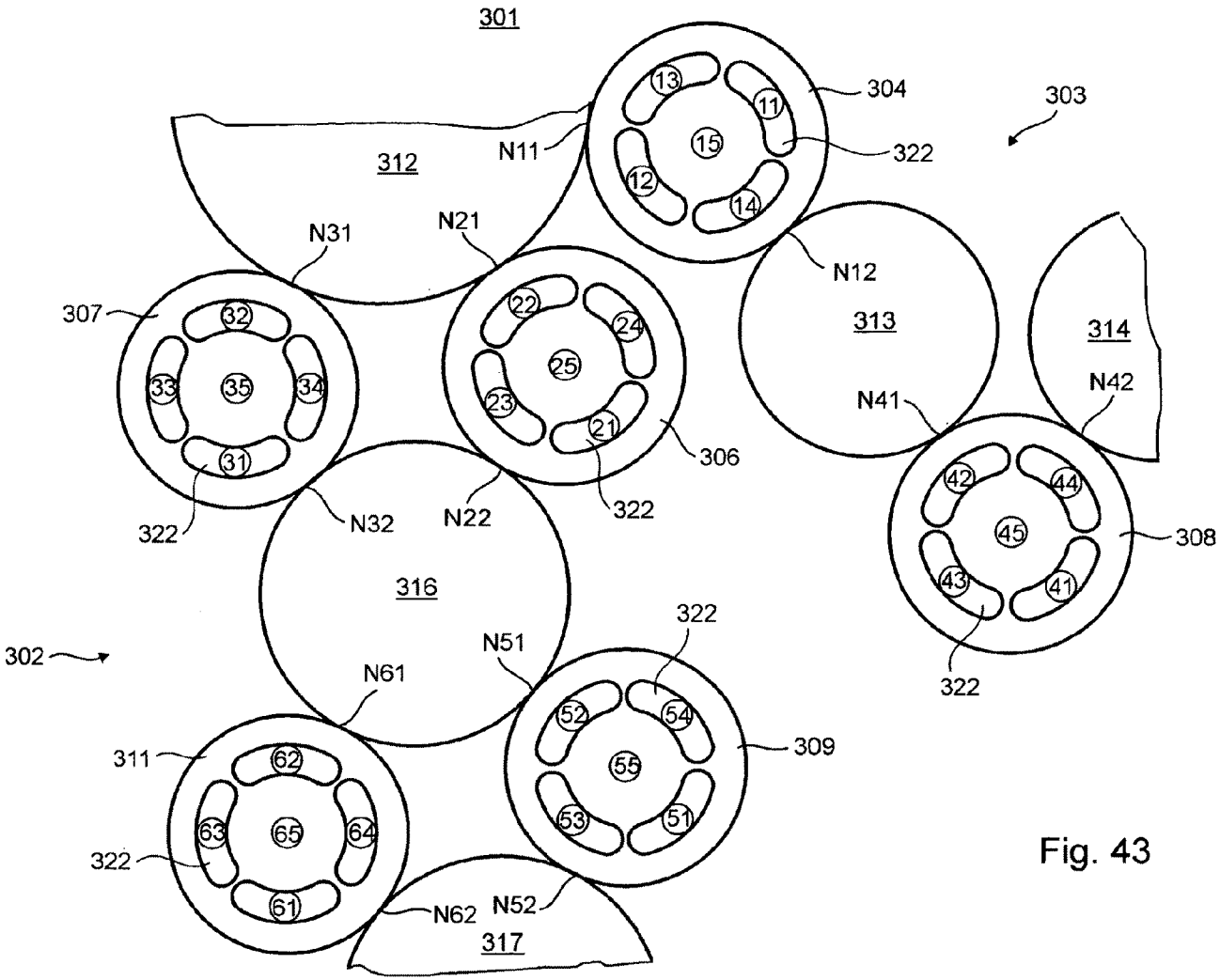
FIG. 43 a section of a printing group with an inking unit and a dampening unit, each with rollers that can be controlled, in terms of their contact force.

FIG. 43 shows a schematic, simplified, sectional representation of an example of a printing group 301 comprising an inking unit 302 and a dampening unit 303, each with rollers 304; 306; 307; 308; 309; 311 that can be controlled in terms of their contact force, wherein this printing group 301, with its inking unit 302 and its dampening unit 303, can be arranged in one of the printing units 01 described in connection with FIG. 1 through 15 or 39. The rollers 304; 306; 307; 308; 309; 311 that are controllable in terms of their contact force are displaceably mounted. In this represented example, each of these controllable rollers 304; 306; 307; 308; 309; 311 of the inking unit 302 or dampening unit 303 is in direct contact with two adjacent rotational bodies 312; 313; 314; 316; 317, i.e. each of these rollers 304; 306; 307; 308; 309; 311 is simultaneously engaged against two of the rotational bodies 312; 313; 314; 316; 317 provided in this arrangement, so that each of these rollers 304; 306; 307; 308; 309; 311 has roller strips N11; N12; N21; N22; N31; N32; N41; N42; N51; N52; N61; N62, also called nip points N11; N12; N21; N22; N31; N32; N41; N42; N51; N52; N61; N62, which extend essentially axially in relation to the respective roller 304; 306; 307; 308; 309; 311 on its peripheral surface. Each roller 304; 306; 307; 308; 309; 311 that is controllable in terms of its contact force presses with an adjustable level of contact force against its adjacent rotational body 312; 313; 314; 316; 317 in its respective roller strip N11; N12; N21; N22; N31; N32; N41; N42; N51; N52; N61; N62.

The roller 304 is configured, for example, as a dampening forme roller 304 and forms its first nip point N11 with a rotational body configured, for example, as a cylinder, 312, especially as a forme cylinder 312, and its second nip point N12 with a rotational body 313 configured, for example, as a dampening distribution roller 313. The roller 306 is configured, for example, as an ink forme roller 316 and forms its first nip point N21 with the forme cylinder 312 and its second nip point N22 with a rotational body 316 configured, for example, as an ink transfer roller 316. The roller 307 is likewise configured, for example, as an ink forme roller and forms its first nip point N31 with the forme cylinder 312 and its second nip point N32 with the ink transfer roller 316, wherein the forme cylinder 312 is mounted, for example, in a bearing unit 14 as described in connection with FIG. 17 through 23 or 25. In the dampening unit 303, for example, an additional roller 308 that is controllable in terms of its contact force is provided, for example an intermediate roller 308, which forms its first nip point N41 with the dampening distribution cylinder 313 and its second nip point N42 with a further dampening unit roller 314. In the inking unit 302, for example, two additional rollers 309 and 311 that are controllable in terms of their contact force are provided, for example two intermediate rollers 309 and 311, wherein the roller 309 forms its first nip point N51 with the ink transfer roller 316 and its second nip point N52 with a further inking unit roller 317, and the roller 311 forms its first nip point N61 with the ink transfer roller 316 and its second nip point N62 with the other inking unit roller 317.

The printing group 301 comprising an inking unit 302 and a dampening unit 303 shown by way of example in FIG. 44, again schematically and in cross section, each with rollers 304; 306; 307; 308; 309; 311, which can be controlled in terms of their contact force, differs from the printing group 301 shown by way of example in FIG. 43 in the arrangement of the rollers 311 in the inking unit 302, wherein the printing group 301 shown by way of example in FIG. 44 can also be arranged with its inking unit 302 and its dampening unit 303 in one of the printing units 01 described in connection with FIG. 1 through 15 or 39. In the printing group 301 shown in FIG. 44, the roller 311 is not in direct contact at its first nip point N61 with the ink transfer roller 316, rather the roller 311 is engaged against the roller 309, so that the roller 309 forms its second nip point N52 not with the other inking roller 317, but with the roller 311. Thus in this example the nip points N52; N61 characterize the same roller strips N52; N61.

Figure 44:
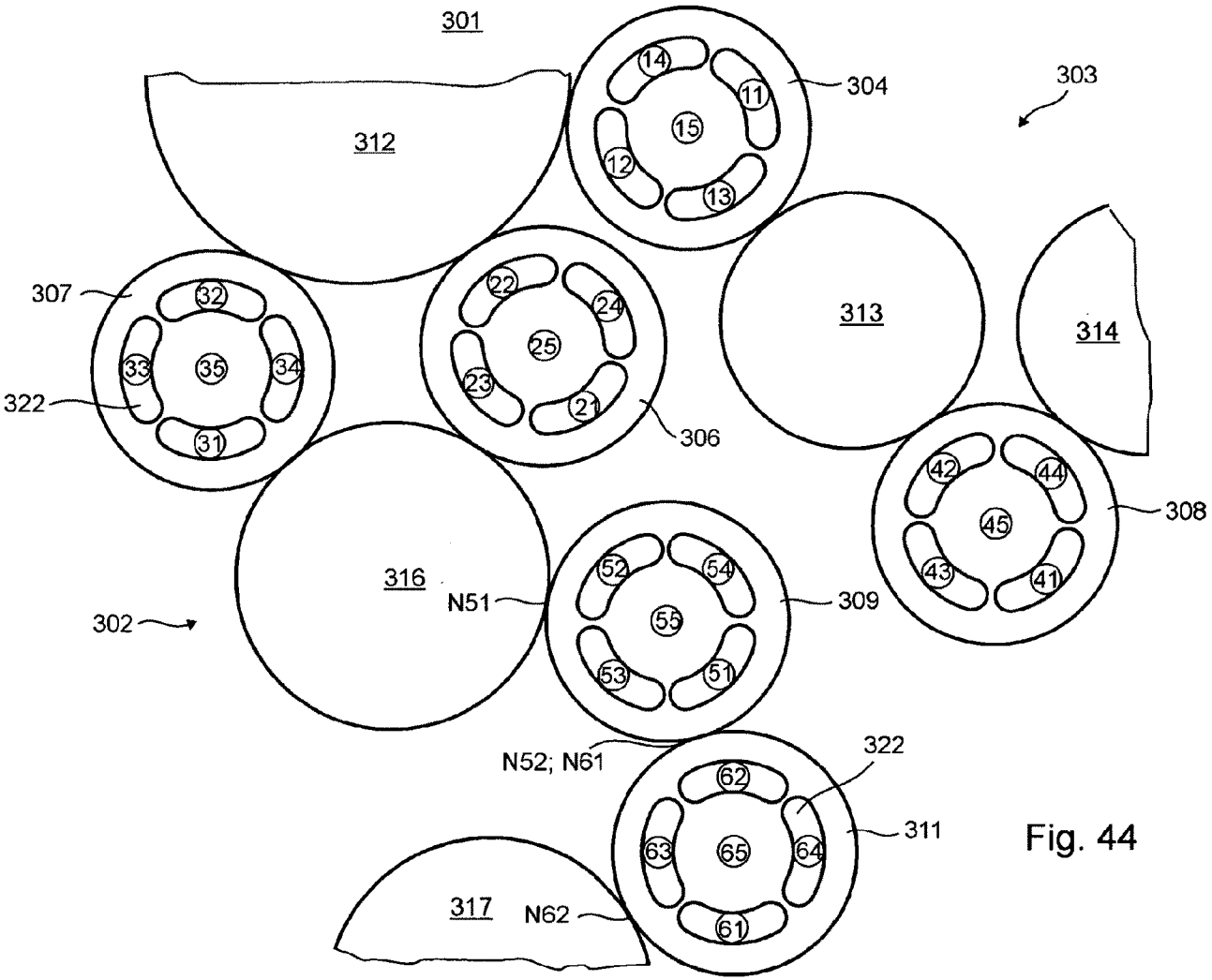
FIG. 44 a section of a printing group with an inking unit and a dampening unit, each with rollers that can be controlled in terms of their contact force, wherein in the inking unit, two rollers that can be controlled in terms of their contact force are engaged against one another.

In the configurations shown in FIGS. 43 and 44, the controllable rollers 304; 306; 307; 308; 309; 311 each have two nip points N11; N12; N21; N22; N31; N32; N41; N42; N51; N52; N61; N62. However, in the printing group 301 an operational position for at least one of these controllable rollers 304; 306; 307; 308; 309; 311 can also be provided, in which each roller 304; 306; 307; 308; 309; 311 is in direct contact with only one of the adjacent rotational bodies 312; 313; 314; 316; 317, and is disengaged from its second adjacent ones of the rotational bodies 312; 313; 314; 316; 317. A further operational position for at least one of the controllable rollers 304; 306; 307; 308; 309; 311 can provide that this controllable roller 304; 306; 307; 308; 309; 311 is disengaged from all its adjacent rotational bodies 312; 313; 314; 316; 317, whereas the remaining controllable rollers 304; 306; 307; 308; 309; 311 in this printing group 301 are each in direct contact with at least one adjacent rotational body 312; 313; 314; 316; 317. In the printing group 301, for at least one of the controllable rollers 304; 306; 307; 308; 309; 311 only a single adjacent rotational body 312; 313; 314; 316; 317 may be provided.

The printing group 301 is arranged in a printing machine that produces a printed product, wherein the printing machine—as described above—is preferably configured, for example, as a newspaper printing press, and is equipped, for example, with a plurality of printing groups 301, each with at least one inking unit 302 and/or one dampening unit 303. The printing group 301 operates, for example, using a planographic printing process, preferably in an offset printing process, wherein a transfer cylinder that is part of a printing group 301 and an impression cylinder that interacts with said transfer cylinder are not shown in FIGS. 43 and 44 (for these components of the printing group 301, reference is made instead to FIG. 1 through 15 or 39). The dampening unit 303 is omitted when the printing group 301 operates using a dry offset printing process.

The circumferential surface of the rotational body 312; 313; 314; 316; 317 configured as a forme cylinder 312 is loaded with at least one printing forme (not shown). Preferably, a plurality of printing formes, especially four or six printing formes, are arranged in the axial direction of the forme cylinder 312. In a circumferential direction of the forme cylinder 312, for example, two printing formes are arranged in tandem, so that a total of up to eight or twelve printing formes are arranged on the circumferential surface of the same forme cylinder 312. The printing group 301 can also have significantly more, but also fewer controllable rollers 304; 306; 307; 308; 309; 311 in its inking unit 302 and its dampening unit 303 than are shown by way of example in FIGS. 43 and 44.

In the direct contact between rollers 304; 306; 307; 308; 309; 311 and rotational bodies 312; 313; 314; 316; 317 engaged against one another a flattened area is created on the roller 304; 306; 307; 308; 309; 311, on the rotational body 312; 313; 314; 316; 317, or on both, of their respective cylindrical circumferential surface, wherein the chord of the flattened area corresponds to the width of the roller strip N11; N12; N21; N22; N31; N32; N41; N42; N51; N52; N61; N62 on the outer circumference of the roller 304; 306; 307; 308; 309; 311 or of the rotational body 312; 313; 314; 316; 317. The flattened area of the otherwise cylindrical circumferential surface of the roller 304; 306; 307; 308; 309; 311 or the rotational body 312; 313; 314; 316; 317 is possible because the roller 304; 306; 307; 308; 309; 311 or its adjacent rotational body 312; 313; 314; 316; 317 or both have a flexibly deformable circumferential surface. For example, the rollers 304; 306; 307; 308; 309; 311 have a rubber coated circumferential surface.

In practice, to achieve good quality for the printed product to be generated using the printing group 301, it is necessary to adjust the roller strip N11; N12; N21; N22; N31; N32; N41; N42; N51; N52; N61; N62 present in the printing group 301 to a certain width, said width measuring within a range of a few millimeters, for example between 1 mm and 10 mm. The rollers 304; 306; 307; 308; 309; 311 and their adjacent rotational bodies 312; 313; 314; 316; 317, which are controllable in terms of their contact force, have a diameter of, for example, 100 mm to 340 mm, and an axial length, for example, of between 1,000 mm and 2,400 mm. The width of the roller strip N11; N12; N21; N22; N31; N32; N41; N42; N51; N52; N61; N62 corresponds to the contact force exerted by the respective controllable roller 304; 306; 307; 308; 309; 311 on its adjacent rotational body 312; 313; 314; 316; 317 in the respective roller strip N11; N12; N21; N22; N31; N32; N41; N42; N51; N52; N61; N62.

Each roller 304; 306; 307; 308; 309; 311 that is controllable in terms of its contact force is mounted with at least one of its ends 318, but preferably with each of its ends 318, in a support bearing 321 having a roller mount 339 that is capable of radial travel, i.e. in a so-called roller socket 321, wherein each support bearing 321 or roller socket 321 has at least one, and preferably a plurality of actuators 322 that act upon the roller 304; 306; 307; 308; 309; 311, wherein the actuators 322 in turn are preferably arranged in a housing that is part of the support bearing 321 or roller socket 321, and can each, for example, be pressurized with a pressure medium. Although the actuators 322 are described in what follows as actuators 322 that can be pressurized with a pressure medium, which corresponds to their preferred embodiment, the subsequently described control of the support bearings 321 and/or their actuators 322 is independent of the medium that is used to exert the contact force. To implement the proposed control, the actuators 322 can also be configured, for example, as actuators 322 that exert the respective contact force, for example, based upon a hydraulic, electric, motor-driven or piezoelectric effect. In any case, activated actuators 322 cause the roller mount 339 to move eccentrically in relation to the support bearing 321 in a plane that extends orthogonally to the axial direction of the controllable roller 304; 306; 307; 308; 309; 311. In this, the radial travel can be oriented in a linear or non-linear movement path.

Figure 45:
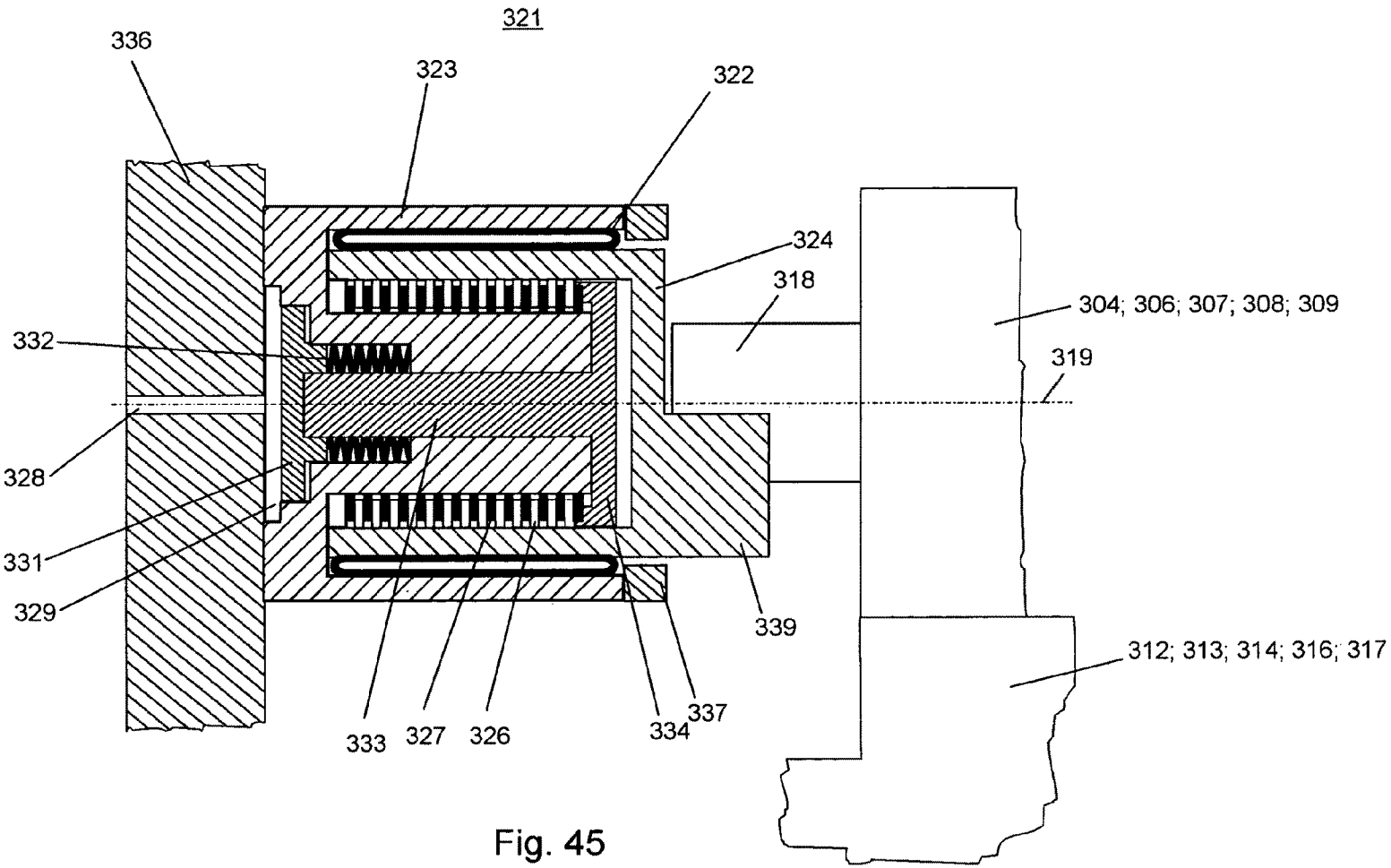
FIG. 45 a longitudinal section of a roller socket.
Figure 46:
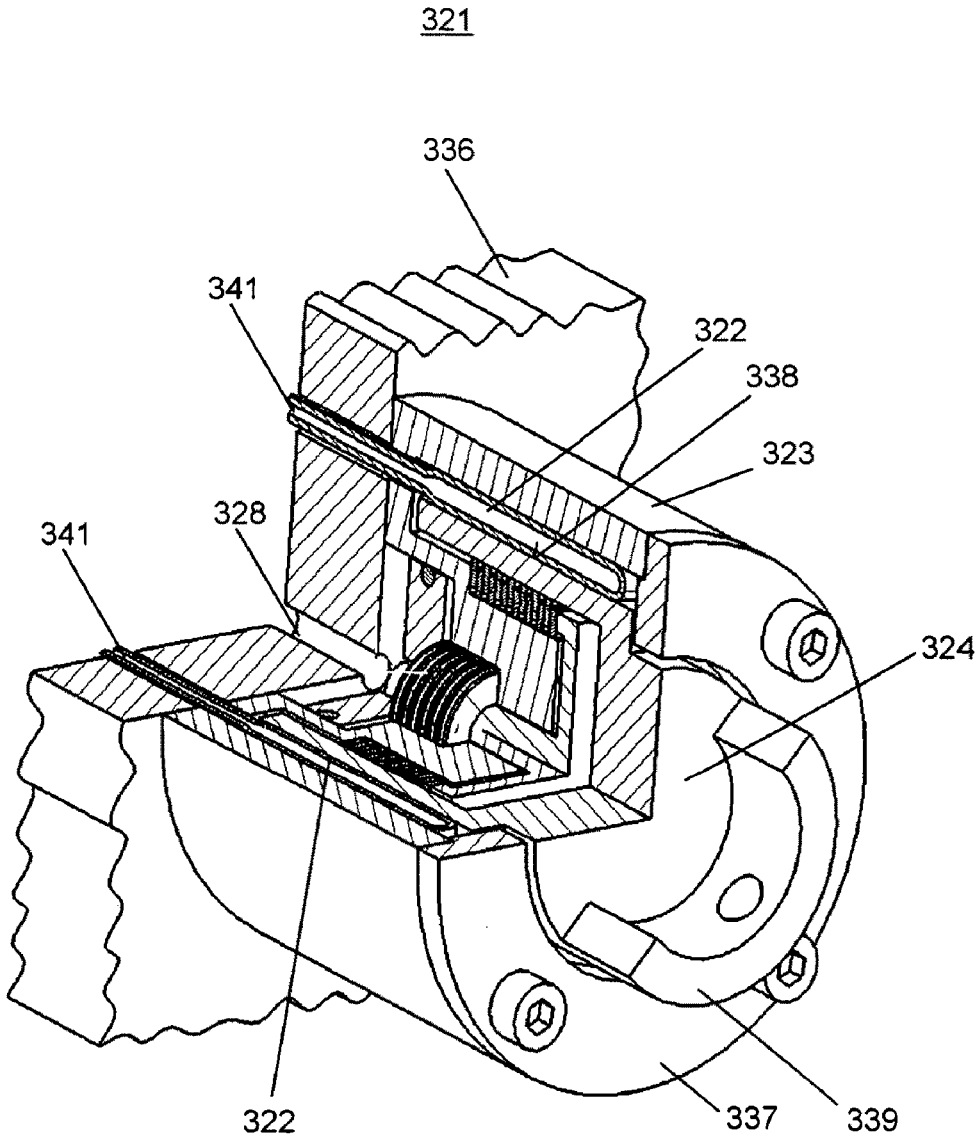
FIG. 46 the roller socket of FIG. 45 in a perspective view, with a partial longitudinal section in two planes oriented orthogonally to one another.

The radial travel of the roller mount 339, which is permissible, for example, in the support bearing 321 that is arranged fixed to the frame, thus leads to an eccentric displacement of the roller mount in the support bearing 321, which is preferably configured as a radial bearing. In FIGS. 45 and 46, the structure of a roller socket 321 is represented by way of example. FIG. 45 shows the roller socket 321 in a longitudinal section that is parallel to the axis 319 of the roller 304; 306; 307; 308; 309; 311. FIG. 46 shows the roller socket 321 of FIG. 45 in a perspective view, with a partial longitudinal section in two planes oriented orthogonally in relation to one another. It can be provided that at least each roller 304; 306; 307 that operates directly in conjunction with a forme cylinder 312 has at least one actuator 322, which is controlled independently of the other actuators 322 of the rollers 304; 306; 307 that operate directly in conjunction with the forme cylinder 312. It is preferably provided that at least three of the rollers 304; 306; 307 that operate directly in conjunction with the forme cylinder 312 are provided, and that each of these rollers 304; 306; 307 has at least one independently controlled actuator.

The housing of the roller socket 321 has a frame holder 323, for example sleeve shaped, in the interior of which a roller holder 324 is mounted, wherein the actuators 322 act upon the roller holder 324, and are capable of shifting the roller holder 324 radially in a gap that forms radially around the axis 319 between the frame holder 323 and the roller holder 324. The gap between the frame holder 323 and the roller holder 324 has, for example, a width of 1 mm to 10 mm, preferably approximately 2 mm. The actuators 322 are arranged, for example, in the gap between the frame holder 323 and the roller holder 324, or respectively in a chamber or recess in the frame holder 323, wherein the actuator 322 that is arranged in the chamber or recess of the frame holder 323 has an active surface 338 that is oriented toward the roller holder 324, with which surface the actuator 322, in its operational state in which it is acted on by a pressure medium, exerts surface pressure against the roller holder 324.

The actuators in the housing of the roller socket 321, opposite this housing or at least opposite the frame holder 323 are preferably non-rotatably arranged. Each of the actuators 322 is configured, for example, as a hollow component that can be acted upon by pressure medium, e.g. as a pressurized tube, wherein the hollow component has at least one surface 338 (FIG. 46) made of a reversibly deformable elastomeric material, wherein this surface 338 is configured, for example in a further embodiment not shown here as a membrane, wherein the membrane 338 preferably comes to rest against an outer circumferential surface of the roller holder 324 when the hollow body is pressurized. The reversibly deformable surface 338 thus corresponds at least largely to the surface 338 used to exert the surface pressure. In the preferred embodiment presented here, the actuators 322 have no pistons that are guided in a cylinder, and are instead without piston rods. The integration of the actuators 322 into the housing of the roller socket 321 obviously results in a highly compact construction of the roller socket 321. The pressure medium is supplied to each of the actuators 322 via a pressure medium line 341 (FIG. 46).

One of the ends 318 of the roller 304; 306; 307; 308; 309; 311 that is controllable in terms of its contact force is mounted in the roller mount 339 that is configured on the roller holder 324, for example in semicircular shape, preferably as a quick-release coupling, and is rigidly connected to said roller holder 324, wherein the rollers 304; 306; 307; 308; 309; 311 that are controllable in terms of their contact force are each capable of rotating around their own axis 319. As an alternative to a rigid connection of the roller mount 339 to the end of the roller 304; 306; 307; 308; 309; 311, the roller mount 339 has a bearing, for example a roller bearing or friction bearing, in which the end of the roller 304; 306; 307; 308; 309; 311 is rotatably mounted. The frame holder 323 is fastened, for example, on a frame panel 336 of the printing group 301. The roller socket 321 is preferably sealed against dust, moisture and other contaminants at its end surface that faces the roller 304; 306; 307; 308; 309; 311, which is controllable in terms of its contact force, by a sealing element 337 that especially covers the gap between the frame holder 323 and the roller holder 324, wherein the sealing element 337 is, for example, attached to the frame holder 323 with screws. With the sealing element 337, the actuators 322 are also especially protected against contamination and therefore against a breakdown of their mobility. With the radial displacement of the roller holder 324 in the frame holder 323, a roller 304; 306; 307; 308; 309; 311 can also be engaged against or disengaged from its adjacent rotational body 312; 313; 314; 316; 317.

The roller socket 321 has, for example, an immobilization device, which fastens the roller holder 324, and thereby the roller 304; 306; 307; 308; 309; 311 that is rigidly connected to it, in a first operating position, thereby locking it against any radial displacement in relation to the frame holder 323, or, in a second operating position, releasing it to permit such displacement. The immobilization device has, for example, a preferably coaxial first disk packet 326 that is rigidly connected, for example, to the roller holder 324, and a second disk packet 327, also coaxial, wherein the disks of the second disk packet 327 engage between the disks of the first disk packet 326. Immobilization is accomplished preferably non-positively or positively with the engagement of the disks. Once the non-positive or positive connection of the disks has been released, the second disk packet 327 is capable of moving in an axial direction off the roller socket 321.

The axial movement of the second disk packet 327 is accomplished in that a pressure medium is directed through a channel 328 formed in the frame panel 336 into a pressure chamber 329 arranged in the roller socket 321, wherein a pressure plate 331 arranged in the pressure chamber 329 moves a ram 333 that is preferably arranged in the roller holder 324 axially against the force of a spring element 332. The second disk packet 327 is fastened to a ram head 334 of the ram 333, and is also moved with an axial movement of the ram 333, whereby the disks of the disk packets 326; 327 are moved out of engagement. With a decrease in the pressure exerted by the pressure medium in the pressure chamber 329 on the pressure plate 331, the force exerted by the spring element 332 guides the disks of the disk packets 326; 327 back into engagement with one another, thereby immobilizing the roller holder 324 in the frame holder 323, the former being radially displaceable by the actuators 322 of the roller socket 321.

Figure 47:
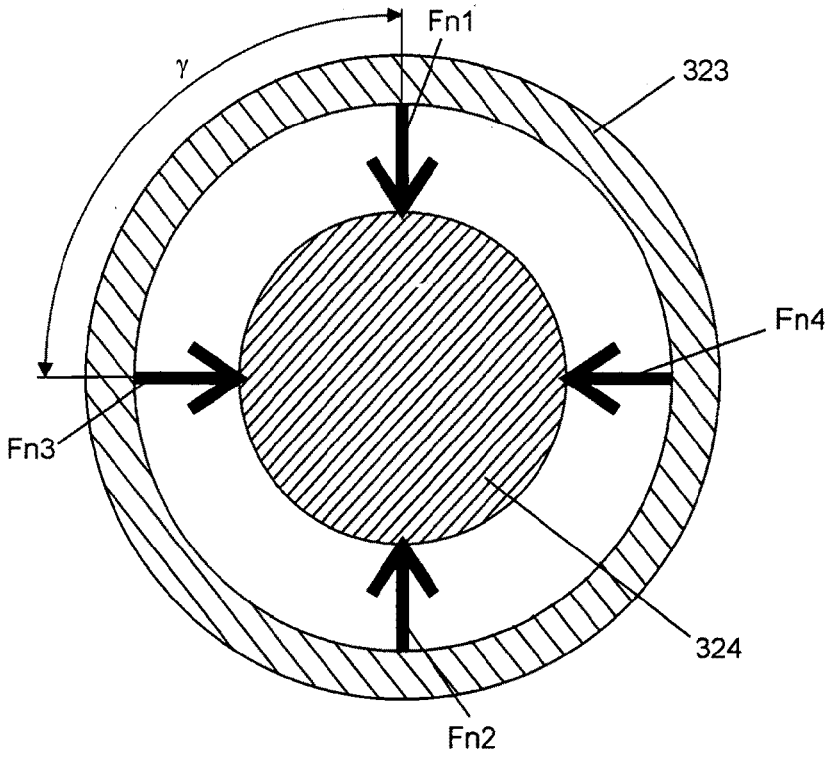
FIG. 47 a schematic representation of radial forces exerted by actuators on a controllable roller without a displacement of the controllable roller.
Figure 48:
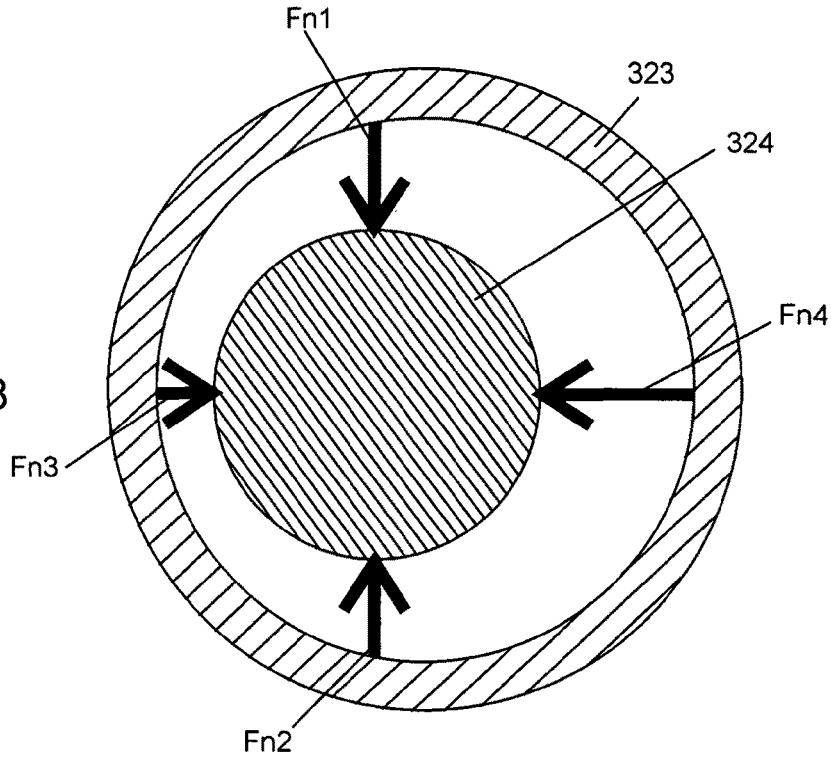
FIG. 48 a schematic representation of radial forces exerted by actuators on a controllable roller with a displacement of the controllable roller.

In the example shown in FIG. 43 through 46 each roller socket 321 has four actuators 322 arranged in a circular pattern around the axis 319 of the roller 304; 306; 307; 308; 309; 311, wherein the actuators 322 are preferably distributed, evenly spaced, around the axis 319 of the roller 304; 306; 307; 308; 309; 311 that is controllable in terms of its contact force. The actuators 322 are remotely controllable, i.e. they can be actuated via a control unit, and are preferably configured as pneumatic actuators 322. A compressed gas, preferably compressed air, is used as the pressure medium, for example. An alternative to the preferred pneumatic actuators 322 is presented especially by hydraulic actuators 322 that can be pressurized with a fluid, or even by electromotively operated actuators 322. As is shown in FIGS. 47 and 48 in a schematic representation, each actuator 322, when acted upon by pressure medium, exerts a radial force Fn1; Fn2; Fn3; Fn4, directed toward the interior of its roller socket 321, on the roller 304; 306; 307; 308; 309; 311 that is connected to said roller socket 321 and is controllable in terms of its contact force, wherein the actuators 322 are preferably supported radially on or in the frame holder 323 of the roller socket 321, and, with the surface pressure exerted on the roller holder 324 arranged in the frame holder 323 so as to be radially displaced, exert the radial force Fn1; Fn2; Fn3; Fn4 on the roller 304; 306; 307; 308; 309; 311 that is attached in the roller holder 324 and is controllable in terms of its contact force. The pressure exerted by the pressure medium in the respective actuator 322 and the radial force Fn1; Fn2; Fn3; Fn4 from this actuator 322 accordingly correspond to one another. Radial forces Fn1; Fn2; Fn3; Fn4 exerted by actuators 322 in the same roller socket 321 at the same time form an included angle $\gamma$ with one another, which is different from 0° and 180°, preferably lying between 45° and 135°, and measuring, for example, 90°. The contact force exerted by a roller 304; 306; 307; 308; 309; 311, which is controllable in terms of its contact force, in a roller strip N11; N12; N21; N22; N31; N32; N41; N42; N51; N52; N61; N62 on an adjacent rotational body 312; 313; 314; 316; 317 is then calculated as a vector sum of the simultaneously exerted radial forces Fn1; Fn2; Fn3; Fn4 of actuators 322 in the same roller socket 321—if applicable taking into account a force of weight exerted at least partially on the adjacent rotational body 312; 313; 314; 316; 317 by the controllable roller 304; 306; 307; 308; 309; 311 by virtue of its own mass.

With a characteristic identifier n in the symbol for the radial force Fn1; Fn2; Fn3; Fn4, a specific roller socket 321 can be characterized and accordingly identified. The significance of the characteristic identifier n will be addressed in what follows. Preferably each roller socket 321 that is assigned to a controllable roller and is integrated into the printing press is preferably assigned an identifier that can be used in the control system as an address, with which the roller socket 321 can be clearly identified in the printing press or at least in a printing group 301, and thereby selected in the control system. Likewise, each actuator 322 that assigned to a roller socket 321 is assigned an identifier, with which each actuator in one of the roller sockets 321 arranged in the printing press or in the respective printing group 301 can be clearly identified, selected and controlled. Furthermore, as with the previously described identifiers, the pressure chamber 329 allocated to the immobilization device of each roller socket 321 is assigned an identifier, whereby ultimately each immobilization device of the roller sockets 321 arranged in the printing press or in the printing group 301 can be clearly identified. The respective identifiers for the roller sockets 321, their actuators 322 and their immobilization device are preferably machine readable and can be stored in the control unit, preferably in an electronic control unit that processes digital data.

In the example shown in FIG. 43 through 46, for each roller socket 321, the identifier for its actuators 322 and its immobilization device consists of a sequence of numbers, wherein, for example, the first number identifies the relevant roller socket 321 and the second number, for example, identifies the relevant actuator 322 in the respective roller socket 321 or its immobilization device. For instance, an identifier nm refers in each case with a characteristic identifier n; m for the roller socket 321, its actuators 322 and its immobilization device to a roller socket 321 that is clearly defined within the printing group 301, an actuator 322 that is clearly defined within the printing group 301, and a immobilization device that is clearly defined within the printing group 301. With this, the identifier nm characterizes with its first characteristic identifier in a roller socket 321, and with its second characteristic identifier m a certain actuator 322 in this roller socket 321 or its immobilization device. For example, the identifier "12" consisting e.g. of a two-digit number identifies with its first digit the roller socket 321 characterized by the number "1", which in the example shown in FIG. 43 through 46 is assigned to the dampening forme roller 304, wherein the second digit in the number sequence, which in this case was chosen as the number "2", a very specific actuator 322 in the roller socket 321 identified by the number "1" is intended. The identifier "15" in this example identifies the immobilization device of the roller socket 321 characterized by the number "1". In the examples shown in FIG. 43 through 46, the identifier nm refers to number sequences having a first characteristic identifier n with a number between "1" and "6", because six roller sockets 321 to be differentiated from one another are provided, and with a second characteristic identifier m with a number between "1" and "5" for the four actuators 322 per roller socket 321 and the associated immobilization device. Because in the printing group 301 each roller socket 321, each of its actuators 322 and each immobilization device is assigned an identifier nm, each roller socket 321 each actuator 322 and each immobilization device can be clearly identified and addressed. The identifiers nm can each, for example, be stored in the control unit as an individual, unambiguous address, whereby each roller socket 321, each actuator 322 and each immobilization device can be identified, selected, addressed and controlled by the control unit individually and separately from other roller sockets 321, actuators 322 and immobilization devices arranged in the printing group 301.

If both ends 318 of the same roller 304; 306; 307; 308; 309; 311, which is adjustable in terms of its contact force and/or changeable in terms of its position, and/or at least one end 318 of two different rollers 304; 306; 307; 308; 309; 311, which are each adjustable in terms of their contact forces and/or changeable in terms of their positions, are mounted in a support bearing 321, i.e. in a roller socket 321, with a roller mount 339 that is capable of radial travel, wherein each support bearing 321 has at least one actuator 322 that acts upon the roller 304; 306; 307; 308; 309; 311, the control unit controls at least the actuator 322 of at least two support bearings 321 separately and independently of other support bearings 321 and actuators 322. The control unit accordingly controls at least one actuator 322 in a support bearing 321 separately and independently of an actuator 322 in another support bearing 321. The control unit can also control groups of actuators 322 and support bearings 321 together, especially when these jointly controlled actuators 322 and support bearings 321 form a functional unit, in other words they are continuously and necessarily adjusted in a fixed allocation to one another based upon their technical function in the printing process.

The at least two actuators 322 in each roller socket 321 are always arranged the same in their preferably circular distribution in each roller socket 321 with respect to a certain position of the roller socket 321, so that in all roller sockets 321 in a printing group 301 the characteristic identifier m of their actuators 322 and immobilization device can always be assigned in the same sequence. For actuators 322 occupying the same position in this sequence, the same characteristic identifier m is accordingly always assigned. For example, the actuators 322 and immobilization device are characterized in an ascending sequence, wherein in this sequence the identifier for the immobilization device is assigned the highest value, for example. Therefore, the actuators 322 in each roller socket 321 are characterized in a fixed sequence. For example, starting from a certain position on the circumference of the roller socket 321, the actuators 322 in each roller socket 321 are characterized in the same fixed sequence in a circumferential direction.

In each roller socket 321, the actuators 322, in their preferred pneumatic embodiment, are connected via a pneumatic line 341 to a pneumatic pressure source, e.g. a compressor that has a pressure level 342. As is apparent from the pneumatic layout shown in FIG. 49, it can be provided that actuators 322 arranged in different roller sockets 321, which have the same characteristic identifier m due to their same positioning in the respective roller socket 321, are connected in parallel via the same pneumatic line 341 to the same pneumatic pressure source or at least to the same pressure level 342. Actuators 322 arranged in the same roller socket 321 and having different characteristic identifiers m are also connected via different pneumatic lines 341 to different pneumatic pressure sources or at least to different pressure levels 342.

It can be provided that the actuators 322 arranged in the roller sockets 321 are continuously acted upon by pneumatic pressure, and that the existing pressure acts to displace the controllable roller 304; 306; 307; 308; 309; 311 and/or to exert an adjustable contact force on the controllable roller 304; 306; 307; 308; 309; 311 only if and as long as the immobilization device of the respective roller socket 321 is released, i.e. is in the operational position that will permit the displacement of the controllable roller 304; 306; 307; 308; 309; 311. If and as long as the immobilization device of the respective roller socket 321 is blocking the displacement of the controllable roller 304; 306; 307; 308; 309; 311, a pressure level present in at least one of the actuators 322, or a change in the pressure there, does not affect the controllable roller 304; 306; 307; 308; 309; 311. If and as long as an effect on the controllable roller 304; 306; 307; 308; 309; 311 is not intended, the pneumatic lines 341 to the actuators 322 that operate in conjunction with said roller 304; 306; 307; 308; 309; 311 can also be adjusted to be at least partially pressureless or at least substantially pressure reduced as an alternative to their continuous pressurization.

Preferably, roller sockets 321 that are connected to the same roller 304; 306; 307; 308; 309; 311 that is controllable in terms of its contact force have the same number of actuators 322. As in the example described here, the roller sockets 321 of a plurality of rollers 304; 306; 307; 308; 309; 311, or even all rollers, that are controllable in terms of their contact force can have the same number of actuators 322. In a printing group 301, a frame panel 336, in or on which a first bearing point for the rollers 304; 306; 307; 308; 309; 311 that are controllable in terms of their contact force and their respective rotational bodies 312; 313; 314; 316; 317 is located, is ordinarily referred to as "Side I" and the opposite frame panel 336 with a second bearing point for the rollers 304; 306; 307; 308; 309; 311 that are controllable in terms of their contact force and their adjacent rotational bodies 312; 313; 314; 316; 317 is referred to as "Side II".

According to the prior art, actuators 322 in roller sockets 321 that are connected to the same roller 304; 306; 307; 308; 309; 311 exert an equal amount of contact force in the roller strip N11; N12; N21; N22; N31; N32; N41; N42; N51; N52; N61; N62 on the adjacent rotational body 312; 313; 314; 316; 317 at both ends 318 of said roller 304; 306; 307; 308; 309; 311. If, however, the rotational body 312 configured as a forme cylinder 312 is not evenly loaded with printing formes in its axial direction, and instead the forme cylinder 312 is loaded over only half or at least discontinuously with printing formes, it is advantageous to adjust the contact force that is exerted on the forme cylinder 312 to different levels at the two ends 318 of the same roller 304; 306; 307; 308; 309; 311. With this, the vector sum of the radial forces Fn1; Fn2; Fn3; Fn4 of the actuators 322 in the roller socket 321 on "Side I" differs from the vector sum of the radial forces Fn1; Fn2; Fn3; Fn4 of the actuators 322 in the roller socket 321 on "Side II".

Figure 49:
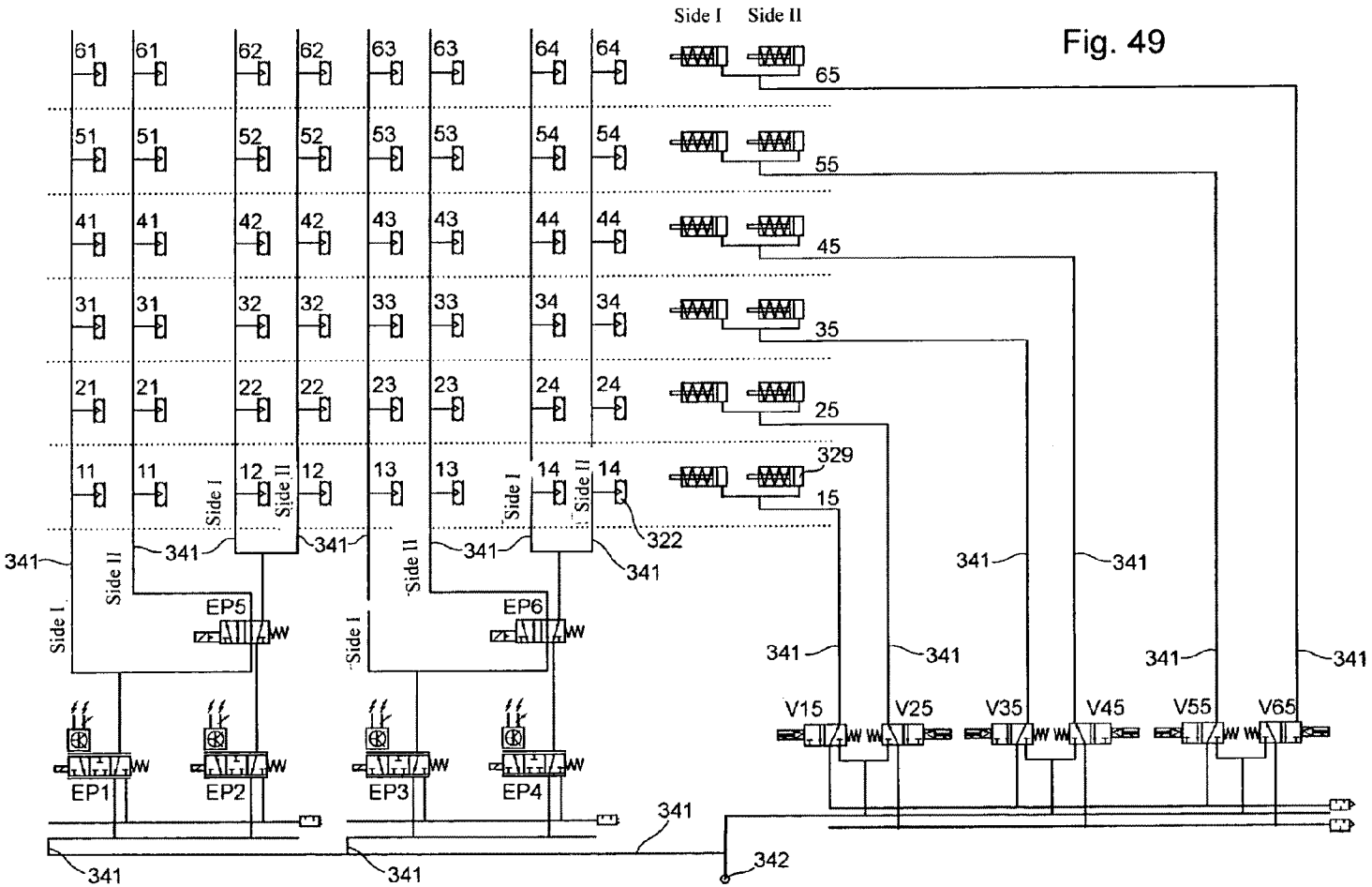
FIG. 49 a pneumatic plan for controlling actuators and immobilization devices that are part of a printing group.

In the example of a pneumatic circuit for the actuators 322 of all roller sockets 321 arranged in the printing group 301, shown in FIG. 49, controllable devices that are actuated preferably electrically or electromagnetically and arranged in the pneumatic line 341 originating from a pneumatic pressure source, which devices are preferably configured as rapid-reaction proportional valves EP1; EP2; or EP3; EP4, e.g. 3/3-way proportional valves EP1; EP2; EP3; EP4, determine the pressure level 342 that is present at the respective actuators 322, wherein, for example, one of the proportional valves EP1; EP2; EP3; EP4 is allocated to each roller socket 321, wherein the control unit activates actuators 322 arranged in the roller sockets 321 by means of the proportional valves EP1; EP2; EP3; EP4. With two additional controllable devices provided in the circuit, which are preferably configured as electrically or electromagnetically actuated valves EP5; EP6, e.g. 5/2-way valves, and which in the pneumatic line 341 are each arranged downstream in series connection from one of the proportional valves EP1; EP2; EP3; EP4 in the path of the pressure medium from its pneumatic pressure source to the actuators 322, it can be selected whether actuators 322 on "Side I" of the roller 304; 306; 307; 308; 309; 311 that is controllable in terms of its contact force will be acted upon with the same pressure level as on "Side II" or with a different pressure. The proportional valves EP1; EP2; EP3; EP4 can be used to adjust the pressure level 342 to any value, for example between 0 bar and 10 bar, preferably between 0 bar and 6 bar.

The immobilization devices of roller sockets 321 of the same roller 304; 306; 307; 308; 309; 311 are, for example, connected in parallel in their respective pneumatic line 341, and therefore preferably change their operating position simultaneously. With valves V15; V25; V35; V45; V55; V65, for example 3/2-way valves V15; V25; V35; V45; V55; V65, which are preferably also electrically or electromagnetically actuated, each immobilization device can be optionally placed in a first operating position, in which the immobilization device blocks the essentially radial displacement of the roller 304; 306; 307; 308; 309; 311 that is controllable in terms of its contact force, or in a second operating position, in which the immobilization device allows the essentially radial displacement of the roller 304; 306; 307; 308; 309; 311 that is controllable in terms of its contact force.

As an alternative or in addition to the interconnection of the actuators 322 shown in FIG. 49, a controllable device can be allocated to each roller socket 321, with said controllable device simultaneously pressurizing a plurality of pneumatic lines 341, preferably all, that are connected to their respective pneumatic pressure source, for actuators 322 of the same roller socket 321, with a first pressure level 342 in a first operating position, and with a second pressure level 342 in a second operating position, wherein in each of the operating positions the pressure level 342 present at the actuators 322 is different from zero for at least one of the actuators 322 in the same roller socket 321. Therefore, all actuators 322 in the same roller socket 321 are pressurized simultaneously at their respective pressure level 342, which preferably differs in the two operating positions of the controllable device. In the two operating positions of the controllable device, the pressure level 342 that exists at a plurality of, or all, actuators 322 in the same roller socket 321 is entirely different from the others, so that the actuators 322 in the same roller socket 321 are each pressurized at a different pressure level 342. Actuators 322 that are in different roller sockets 321 but are characterized by the same identifier m can have the same pressure level 342, whereas actuators 322 that are in the same roller socket 321 but have different identifiers m ordinarily have different pressure levels 342. The changeover between the first operating position and the second operating position preferably occurs abruptly, as a result of a switching process in the controllable device triggered via the control unit. The controllable device accordingly acts equally upon pneumatic lines 341 that lead to all the actuators 322 in the same roller socket 321, and can, for example, be configured as a flow-check valve having a plurality of passages that are independent of one another, or a plurality of synchronous, i.e. simultaneously switching, flow-check valves, or as a switched position of the proportional valves EP1; EP2; EP3; EP4. Because the adjustment of all actuators that are involved in the changeover occurs simultaneously, i.e. synchronously, the adjustment of a level of contact force exerted by a roller 304; 306; 307; 308; 309; 311 in a roller strip N11; N12; N21; N22; N31; N32; N41; N42;

N51; N52; N61; N62 on an adjacent rotational body 312; 313; 314; 316; 317 occurs rapidly, i.e. within a very short period of time. In this manner, with a change in setting implemented in the inking unit 302 or the dampening unit 303, especially when the printing group is in a production run, an unstable operating status that tends toward vibration is avoided. If a plurality of rollers 304; 306; 307; 308; 309; 311 each mounted in roller sockets 321 are provided, wherein each roller socket 321 has a characteristic identifier n, the control unit selects the controllable device allocated to each roller socket 321, in each case using the characteristic identifier n.

The printing group 301 can have a standard configuration with respect to the contact forces exerted by rollers 304; 306; 307; 308; 309; 311, wherein the standard configuration comprises a set of values FN11; FN12; FN21; FN22; FN31; FN32; FN41; FN42; FN51; FN52; FN61; FN62, wherein each value FN11; FN12; FN21; FN22; FN31; FN32; FN41; FN42; FN51; FN52; FN61; FN62 corresponds to a contact force exerted by a roller 304; 306; 307; 308; 309; 311 in this printing group 301 in a roller strip N11; N12; N21; N22; N31; N32; N41; N42; N51; N52; N61; N62 on a rotational body 312; 313; 314; 316; 317 that is adjacent to the respective roller 304; 306; 307; 308; 309; 311. The standard configuration can, for example, consist of numeric values, pairs of values or series of values that are listed in a table or graphic, wherein the control unit accesses these numeric values, pairs of values or series of values through a program for adjusting a desired contact force, which is running in the control unit, and uses these numeric values, pairs of values or series of values to adjust the desired contact force.

In the example shown in FIGS. 43, 44 and 49, in the printing group 301 six rollers 304; 306; 307; 308; 309; 311 that are controllable in terms of their contact force are provided with a total of twelve roller strips N11; N12; N21; N22; N31; N32; N41; N42; N51; N52; N62; N62, wherein each roller 304; 306; 307; 308; 309; 311 that is controllable in terms of its contact force is mounted in a roller socket 321 having four actuators 322. Considering the option of establishing different contact forces on "Side I" and "Side II" of the printing group 301, the standard configuration for this printing group 301 can comprise a set of twenty-four values FN11; FN12; FN21; FN22; FN31; FN32; FN41; FN42; FN51; FN52; FN61; FN62. For each of these roller strips N11; N12; N21; N22; N31; N32; N41; N42; N51; N52; N61; N62, the value FN11; FN12; FN21; FN22; FN31; FN32; FN41; FN42; FN51; FN52; FN61; FN62 of the respective contact force exerted there is derived from a vector sum of the radial forces Fn1; Fn2; Fn3; Fn4 exerted simultaneously by actuators 322 in the same roller socket 321, if applicable taking into account the force of weight exerted at least to some extent by the roller 304; 306; 307; 308; 309; 311, which is controllable in terms of its contact force, on its adjacent rotational body 312; 313; 314; 316; 317 due to its own mass. Therefore, five additional values, comprised of the four radial forces Fn1; Fn2; Fn3; Fn4 and if applicable the mass of the controllable roller 304; 306; 307; 308; 309; 311, are assigned to each value FN11; FN12; FN21; FN22; FN31; FN32; FN41; FN42; FN51; FN52; FN61; FN62 for one of the contact forces. Beyond this, each value for a radial force Fn1; Fn2; Fn3; Fn4 can be broken down into an indication of its absolute amount and its direction of application.

The values FN11; FN12; FN21; FN22; FN31; FN32; FN41; FN42; FN51; FN52; FN61; FN62 of the contact forces exerted in the roller strips N11; N12; N21; N22; N31; N32; N41; N42; N51; N52; N61; N62, the values allocated respectively to the former for the radial forces Fn1; Fn2; Fn3; Fn4, preferably broken down into amount and direction of application, and if applicable the mass of the controllable rollers 304; 306; 307; 308; 309; 311 are preferably stored in a memory device of the control unit. Likewise, the value for the gravitational constants used to calculate the force of weight from the mass of the controllable rollers 304; 306; 307; 308; 309; 311, and, for each of the rollers 304; 306; 307; 308; 309; 311 that is controllable in terms of its contact force, a value for the distance from the center point of said roller 304; 306; 307; 308; 309; 311 that lies on its axis 319 to the center point of the respective adjacent rotational body 312; 313; 314; 316; 317 with which it is in direct contact, are preferably stored in the memory of the control unit, wherein each value for one of said distances can be broken down to indicate the absolute amount and the direction in space.

In the standard configuration, based upon the values FN11; FN12; FN21; FN22; FN31; FN32; FN41; FN42; FN51; FN52; FN61; FN62 of the contact forces stored in the memory of the control unit, in the direct contact between rollers 304; 306; 307; 308; 309; 311, which are controllable in their contact force and are engaged against one another, and rotational bodies 312; 313; 314; 316; 317 on the roller 304; 306; 307; 308; 309; 311, on the rotational body 312; 313; 314; 316; 317 or on both, a certain degree of flattening of their respective cylindrical circumferential surfaces occurs, wherein the chord of the flattened area corresponds to the width of the roller strip N11; N12; N21; N22; N31; N32; N41; N42; N51; N52; N61; N62 extending on the outer circumference of the roller 304; 306; 307; 308; 309; 311 or the rotational body 312; 313; 314; 316; 317. The standard configuration generates a degree of flattening that corresponds to a certain target value for the width of each roller strip N11; N12; N21; N22; N31; N32; N41; N42; N51; N52; N61; N62, in order to achieve good quality for the printed product to be generated using the printing group 301 under standard operating conditions.

Under operating conditions that deviate from the standard, because the diameter of one of the rollers 304; 306; 307; 308; 309; 311 that are controllable in terms of their contact force, or the diameter of one of the rotational bodies 312; 313; 314; 316; 317, has expanded as a result of absorption of a substance, especially as a result of an absorption of dampening agent, or has decreased as a result of use, it is necessary to correct the width of a roller strip or a plurality of roller strips N11; N12; N21; N22; N31; N32; N41; N42; N51; N52; N61; N62 that has changed as a result of the change in the diameter, such that the width of each roller strip N11; N12; N21; N22; N31; N32; N41; N42; N51; N52; N61; N62 again corresponds to its target value. On the other hand, operating conditions may also require that the width of each roller strip N11; N12; N21; N22; N31; N32; N41; N42; N51; N52; N61; N62 be adjusted to a new target value. In either case, the contact force exerted in each relevant roller strip N11; N12; N21; N22; N31; N32; N41; N42; N51; N52; N61; N62 must be adjusted to a new value FN11; FN12; FN21; FN22; FN31; FN32; FN41; FN42; FN51; FN52; FN61; FN62, requiring that values for the radial forces Fn1; Fn2; Fn3; Fn4 for the relevant roller sockets 321 be changed.

The control unit is equipped with at least one operating element and, for example, one display device for displaying one or more values FN11; FN12; FN21; FN22; FN31; FN32; FN41; FN42; FN51; FN52; FN61; FN62 of the contact force exerted in a specific roller strip N11; N12; N21; N22; N31; N32; N41; N42; N51; N52; N61; N62. The reference symbol for the roller strips N11; N12; N21; N22; N31; N32; N41; N42; N51; N52; N61; N62 selected here by way of example can also be simultaneously used as an identifier for the roller strips N11; N12; N21; N22; N31; N32; N41; N42; N51; N52;

N61; N62, so that each roller strip N11; N12; N21; N22; N31; N32; N41; N42; N51; N52; N61; N62 can be clearly identified on the basis of its identifier.

With the control element of the control unit, configured, for example, as a keypad, as a keyboard or as a pointer instrument, a specific roller strip N11; N12; N21; N22; N31; N32; N41; N42; N51; N52; N61; N62 may be selected from a list of all roller strips N11; N12; N21; N22; N31; N32; N41; N42; N51; N52; N61; N62 in a printing group 301 that are equipped with an identifier, or the identifier for a specific roller strip N11; N12; N21; N22; N31; N32; N41; N42; N51; N52; N61; N62 can be input into the control unit via its control element. For each of these roller strips N11; N12; N21; N22; N31; N32; N41; N42; N51; N52; N61; N62 a value FN11; FN12; FN21; FN22; FN31; FN32; FN41; FN42; FN51; FN52; FN61; FN62, especially a target value, of the contact force exerted in the roller strip N11; N12; N21; N22; N31; N32; N41; N42; N51; N52; N61; N62 is stored in the memory of the control unit, at least for the standard configuration. In the selection or input of the identifier for a specific roller strip N11; N12; N21; N22; N31; N32; N41; N42; N51; N52; N61; N62 using the alphanumeric or graphic display device, for example, said value FN11; FN12; FN21; FN22; FN31; FN32; FN41; FN42; FN51; FN52; FN61; FN62 is displayed, for example, numerically, alphanumerically, in a diagram or in a pictogram.

With the control element, the displayed value FN11; FN12; FN21; FN22; FN31; FN32; FN41; FN42; FN51; FN52; FN61; FN62 of the contact force exerted in the roller strip N11; N12; N21; N22; N31; N32; N41; N42; N51; N52; N61; N62 is adjusted to a new value FN11; FN12; FN21; FN22; FN31; FN32; FN41; FN42; FN51; FN52; FN61; FN62 of the contact force exerted in the roller strip N11; N12; N21; N22; N31; N32; N41; N42; N51; N52; N61; N62, in that the displayed value FN11; FN12; FN21; FN22; FN31; FN32; FN41; FN42; FN51; FN52; FN61; FN62 is adjusted, for example continuously or gradually, preferably in steps of 10% from the displayed value, using the control element. Or the control element is used to select a certain factor from a list of potential factors by which the displayed value FN11; FN12; FN21; FN22; FN31; FN32; FN41; FN42; FN51; FN52; FN61; FN62 may be changed.

For the new value FN11; FN12; FN21; FN22; FN31; FN32; FN41; FN42; FN51; FN52; FN61; FN62 of the contact force exerted in the selected roller strip N11; N12; N21; N22; N31; N32; N41; N42; N51; N52; N61; N62, the control unit calculates the associated values for the radial forces Fn1; Fn2; Fn3; Fn4 exerted in the relevant roller socket 321 and/or the pressures to be adjusted in the actuators 322, and stores the calculated values for the radial forces Fn1; Fn2; Fn3; Fn4 and/or the pressures in its memory device. The control unit also controls the valves V15; V25; V35; V45; V55; V65, the proportional valves EP1; EP2; EP3; EP4 and the valves EP5; EP6. The calculation of the new values FN11; FN12; FN21; FN22; FN31; FN32; FN41; FN42; FN51; FN52; FN61; FN62 and/or the control of the valves V15; V25; V35; V45; V55; V65, the proportional valves EP1; EP2; EP3; EP4 and/or the valves EP5; EP6 is preferably performed once the control unit has received a specific instruction to do so, which can be input or selected, for example, via the control element.

The calculation of the new values FN11; FN12; FN21; FN22; FN31; FN32; FN41; FN42; FN51; FN52; FN61; FN62 of the contact forces takes into consideration the fact that these values and the radial forces Fn1; Fn2; Fn3; Fn4 are each to be viewed as a vector quantity in their original state and in their new state. Accordingly, the control unit applies suitable calculation methods in its calculation of vector quantities. For instance, in addition to applicable algebraic calculation methods, for example, trigonometric calculation methods can be used to calculate individual components of the respective vectors. In the calculation process, the control unit includes its previously input, essentially unchangeable values to the necessary extent, for example the respective mass of the controllable roller 304; 306; 307; 308; 309; 311 and the distance of the center of each roller 304; 306; 307; 308; 309; 311 that is controllable in terms of its contact force from its respective adjacent rotational body 312; 313; 314; 316; 317. The result of the calculation can be displayed on the display device of the control unit, for example like the original values FN11; FN12; FN21; FN22; FN31; FN32; FN41; FN42; FN51; FN52; FN61; FN62.

To establish the new value FN11; FN12; FN21; FN22; FN31; FN32; FN41; FN42; FN51; FN52; FN61; FN62 of a contact force exerted in a selected roller strip N11; N12; N21; N22; N31; N32; N41; N42; N51; N52; N61; N62, the control unit uses at least one of the valves V15; V25; V35; V45; V55; V65 to actuate the immobilization device of that roller socket 321 in which the radial force Fn1; Fn2; Fn3; Fn4 of at least one actuator 322 is to be adjusted to the calculated new value, so that the controllable roller 304; 306; 307; 308; 309; 311 that is mounted in said roller socket 321 can be radially displaced. The control unit then actuates at least one of the proportional valves EP1; EP2; EP3; EP4 and/or at least one of the valves EP5; EP6, in order to adjust the radial force Fn1; Fn2; Fn3; Fn4 of at least one actuator 322 in the relevant roller socket 321 to the calculated new value. The control unit then re-actuates the at least one previously actuated valve V15; V25; V35; V45; V55; V65, in order to place the immobilization device of the specific roller socket 321 in which the radial force Fn1; Fn2; Fn3; Fn4 of at least one actuator 322 has been adjusted to the calculated new value in the specific operating position in which the roller 304; 306; 307; 308; 309; 311 that is mounted in said roller socket 321 and is controllable in terms of its contact force can no longer be radially displaced. With the new value FN11; FN12; FN21; FN22; FN31; FN32; FN41; FN42; FN51; FN52; FN61; FN62 of the contact force exerted in a selected roller strip N11; N12; N21; N22; N31; N32; N41; N42; N51; N52; N61; N62, the width of said roller strip N11; N12; N21; N22; N31; N32; N41; N42; N51; N52; N61; N62 is also altered.

The above-described change in the value FN11; FN12; FN21; FN22; FN31; FN32; FN41; FN42; FN51; FN52; FN61; FN62 of the contact force exerted in a selected roller strip N11; N12; N21; N22; N31; N32; N41; N42; N51; N52; N61; N62 can take place simultaneously or sequentially for a plurality of rollers 304; 306; 307; 308; 309; 311 that are controllable in terms of their contact force. For example, the value FN11; FN12; FN21; FN22; FN31; FN32 of all contact forces exerted by forme rollers 304; 306; 307, in other words the dampening forme roller 304 and the ink forme rollers 306; 307, can be changed at the same time. Or the value FN21; FN22; FN31; FN32; FN51; FN52; FN61; FN62 of all contact forces exerted by rollers 306; 307; 309; 311 of the inking unit 302, or the value FN11; FN12; FN41; FN42 of all contact forces exerted by rollers 304; 308 of the dampening unit 303, or the value FN11; FN12; FN21; FN22; FN31; FN32; FN41; FN42; FN51; FN52; FN61; FN62 of the contact forces of all rollers 304; 306; 307; 308; 309; 311 in the printing group 301 can be changed at the same time. Thus, groups of simultaneously adjustable values FN11; FN12; FN21; FN22; FN31; FN32; FN41; FN42; FN51; FN52; FN61; FN62 can be formed. With the control unit, the value FN11; FN12; FN21; FN22; FN31; FN32; FN41; FN42; FN51; FN52; FN61; FN62 of the contact forces of all rollers 304; 306; 307; 308; 309; 311 for which the current contact force is to be changed, for example the rollers of an inking unit 302 and/or of a dampening unit 303, can be adjusted within a time period of less than a minute, preferably within a time period of a few seconds, It can be provided that each value FN11; FN12; FN21; FN22; FN31; FN32; FN41; FN42; FN51; FN52; FN61; FN62 of the contact force exerted by a roller 304; 306; 307; 308; 309; 311 that has been changed once or even multiple times, for example with the control element of the control unit, to the value FN11; FN12; FN21; FN22; FN31; FN32; FN41; FN42; FN51; FN52; FN61; FN62 that corresponds to the standard configuration, especially to the target value for the contact force exerted in the corresponding roller strip N11; N12; N21; N22; N31; N32; N41; N42; N51; N52; N61; N62, can be reset.

The control unit is configured, for example, as a component of a control center 229 or control center computer 229 (FIG. 41) that is a part of the printing press or at least a printing group 301, and is therefore allocated to the printing press or the printing group 301. Alternatively or additionally, the control unit can be configured, for example, as a mobile component, for example as a notebook, which is connected to the controllable device that is to be actuated to execute a change in a value FN11; FN12; FN21; FN22; FN31; FN32; FN41; FN42; FN51; FN52; FN61; FN62 of a contact force exerted in a roller strip N11; N12; N21; N22; N31; N32; N41; N42; N51; N52; N61; N62, i.e. especially to the relevant proportional valves EP1; EP2; EP3; EP4, the valves EP5; EP6 and the valves V15; V25; V35; V45; V55; V65, only when such change is required.

To execute a change in the value FN11; FN12; FN21; FN22; FN31; FN32; FN41; FN42; FN51; FN52; FN61; FN62 of a contact force exerted in a roller strip N11; N12; N21; N22; N31; N32; N41; N42; N51; N52; N61; N62, proof of authorization may be necessary in that, prior to implementation of the change, for example a valid password must be input in the control unit via its control element.

The change in the value FN11; FN12; FN21; FN22; FN31; FN32; FN41; FN42; FN51; FN52; FN61; FN62 of a contact force exerted in a roller strip N11; N12; N21; N22; N31; N32; N41; N42; N51; N52; N61; N62 can be implemented during the rotation of the relevant roller 304; 306; 307; 308; 309; 311. To the extent that at least one channel is configured with a preferably slot-like opening that is continuous in an axial direction of the forme cylinder 312 over the width of at least one printing forme, and is intended to accommodate angled suspension legs that are bent down from the printing formes, the change in the value FN11; FN21; FN31 of the contact force exerted in this roller strip N11; N21; N31 takes place when the opening in the channel and the roller strip N11; N21; N31 have no shared, overlapping surface, so that the roller 304; 306; 307, during the setting of the new value for its contact force that is exerted in this roller strip N11; N21; N31, is not pressed into the opening of the channel. Accordingly, the contact force that is exerted in a roller strip N11; N21; N31 is changed by the control unit only at times during which the roller 304; 306; 307 that is to be displaced and/or adjusted in terms of its contact force is rolling over the closed, ordinarily solidly configured part of the peripheral surface of at least one printing forme mounted on the forme cylinder 312. While the opening in the channel is being rolled over, the control unit blocks any change in the setting of a contact force that is exerted in the roller strip N11; N21; N31.

To test this condition, a sensor, such as a torque angle sensor, that detects the respective angular position of the forme cylinder 312 and/or of the roller 304; 306; 307 can be positioned on the forme cylinder 312 and/or on the roller 304; 306; 307 to emit a signal that corresponds to the respective angular position to the control unit, wherein the control unit evaluates this signal as a release signal to allow a change in the setting of a contact force exerted in the roller strip N11; N21; N31. If the aforementioned condition cannot be fulfilled, or can be fulfilled only with difficulty, the forme cylinder 312, together with the roller 304; 306; 307 in whose shared roller strip N11; N21; N31 the value FN11; FN21; FN31 of the contact force exerted therein is to be changed, is placed in rotation, specifically at such a rotational speed that the roller 304; 306; 307 rolling over the channel during the setting of the new value for its contact force exerted in this roller strip N11; N21; N31 will not produce a negative effect, because the duration of the rollover is very short, and therefore outweighs the effect of the inertia of the involved masses. Furthermore, the execution of the change in the value FN11; FN12; FN21; FN22; FN31; FN32; FN41; FN42; FN51; FN52; FN61; FN62 of a contact force exerted in a roller strip N11; N12; N21; N22; N31; N32; N41; N42; N51; N52; N61; N62 during the rotation of the relevant roller 304; 306; 307; 308; 309; 311 also has the advantage of preventing slip-stick effects. The change in the value FN11; FN12; FN21; FN22; FN31; FN32; FN41; FN42; FN51; FN52; FN61; FN62 of a contact force exerted in a roller strip N11; N12; N21; N22; N31; N32; N41; N42; N51; N52; N61; N62 is therefore performed during the rotation of the relevant roller 304; 306; 307; 308; 309; 311 and its relevant adjacent rotational body 312; 313; 314; 316; 317 at a speed, for example, of at least 3,000 revolutions per hour, preferably at least 5,000 revolutions per hour or more. The change in the value FN11; FN12; FN21; FN22; FN31; FN32; FN41; FN42; FN51; FN52; FN61; FN62 of a contact force exerted in a roller strip N11; N12; N21; N22; N31; N32; N41; N42; N51; N52; N61; N62 can therefore be executed even when the printing group 301 is in a production run.

Figure 50:
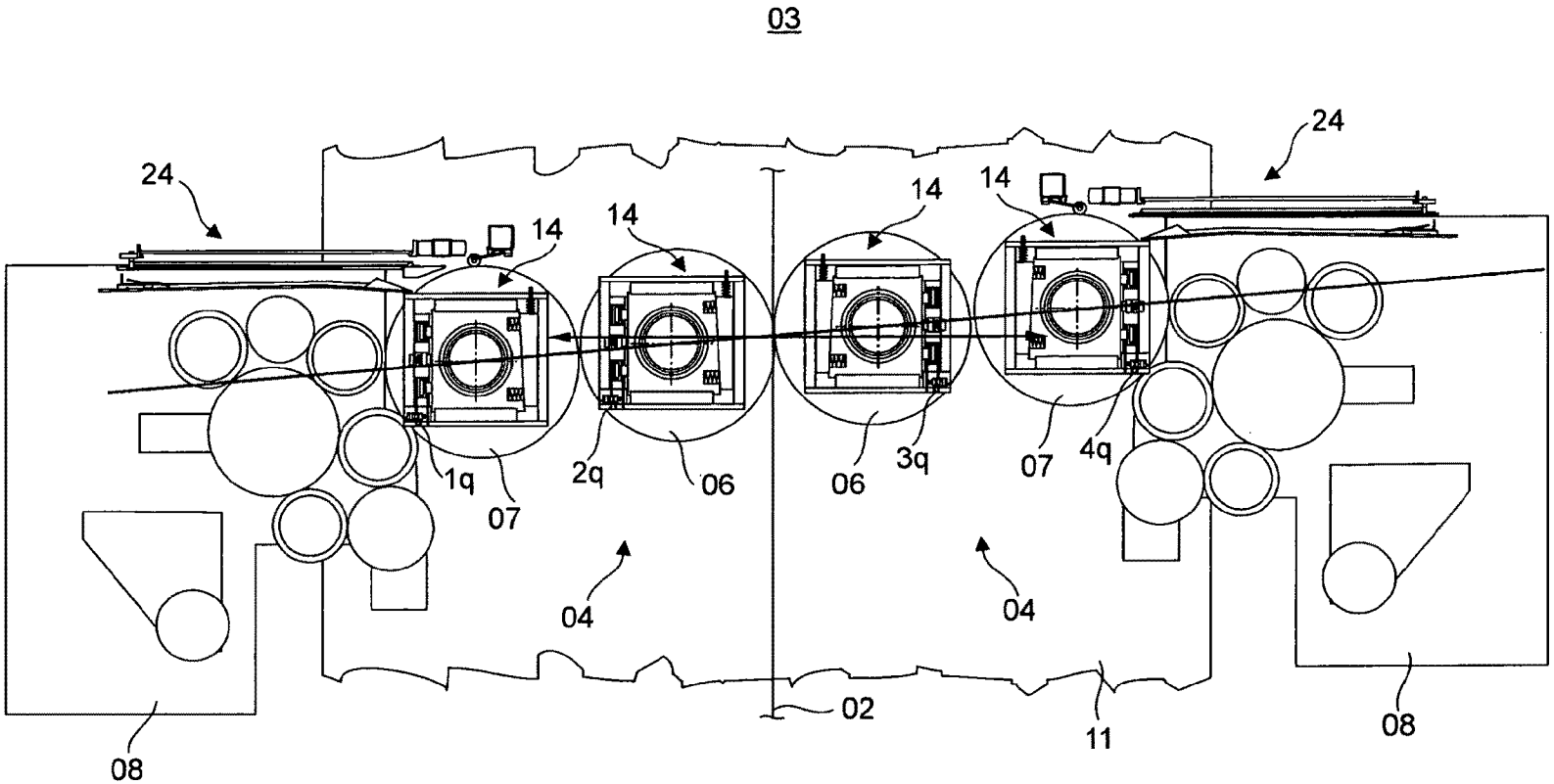
FIG. 50 an example of identifiers assigned to bearing units of a printing group.

In a manner similar to the control of the rollers 304; 306; 307; 308; 309; 311, the actuator 82; 84 or the actuators 82; 84 of the respective bearing units 14 (FIG. 19) of the cylinders 06; 07 arranged in a printing group 04 of a printing unit 01 configured, for example, as a printing tower 01 (FIG. 1 through 10, 12 through 15) can also preferably be identified and addressed via the control center 229 and/or via a control center computer 229, and, for example, controlled via at least one valve 93, in that in each case an unambiguous identifier is also assigned to the actuator 82; 84 or actuators 82; 84 of the respective bearing units 14. One example of identifiers assigned to the respective bearing units 14 is shown in FIG. 50, which shows the first bearing arrangement of a blanket-to-blanket printing group 03 according to FIG. 20, by way of example. In general, the identifier of a bearing unit 14 can be formed as an address consisting of at least two characteristic identifiers "p" and "q", and referred to by the combination of these characteristic identifiers "pq", wherein the first characteristic identifier "p", for example, identifies a specific cylinder 06; 07; 312 or a specific group of cylinders within a specific printing unit 01, and the second characteristic identifier "q", for example, identifies a specific actuator 82; 84 of the cylinder 06; 07; 312 that is identified by the first data packet "p". Using the characteristic identifier p, especially a controllable device that is allocated to each bearing unit 14 can be selected and actuated by means of a control unit that is integrated, for example, into the control center 229 or the control center computer 229. In FIG. 50, the identifiers 1*q*; 2*q*; 3*q*; 4*q* have been indicated by way of example. As with the characteristic identifiers m; n for identifying and addressing the actuators 322 in the support bearings 321 of the rollers

304; 306; 307; 308; 309; 311, each characteristic identifier p; q can be configured, for example, as a data packet or at least as a part of a data packet.

In a further embodiment, at least one printing group 04 of at least one printing unit 01 can have at least two cooperating cylinders 06; 07; 312, wherein each of the cylinders 06; 07; 312 is mounted in a radially displaceable bearing unit 14, wherein at least two actuators 82; 84 that act upon the same end of at least one of the cylinders 06; 07; 312 to displace said cylinder are provided, wherein the respective directions of action of the actuators 82; 84 that act upon the same cylinder end are oriented neither parallel nor antiparallel to one another, wherein a control device controls or regulates the adjustment of the actuators 82; 84 that is necessary for the displacement of the cylinder 06; 07; 312, wherein at least one of the cylinders 06; 07; 312 is mounted at each end in a radially displaceable bearing unit 14, wherein the at least two actuators 82; 84, which act upon the same cylinder end in different directions, are arranged in the bearing unit 14.

A controllable device is preferably allocated to each bearing unit 14 of a displaceable cylinder 06; 07; 312, wherein the controllable device synchronously pressurizes a plurality of actuators 82; 84 in the same bearing unit 14 with a first pressure level 42 in a first operating position, and with a second pressure level 42 in a second operating position, wherein in both operating positions the pressure level 42 that is present at each actuator 82; 84 in the same bearing unit 14 is not equal to zero.

The cylinders 06; 07; 312, at least one of which is configured, for example, as a forme cylinder 07; 312 or as a transfer cylinder 06, or as an impression cylinder 06 that cooperates with a transfer cylinder 06, are preferably each actuated independently of one another with a drive 121 (FIG. 30*b*). At least one of the cylinders 06; 07; 312 has, for example, a flexible surface.

Assigned to the printing group 04, an inking unit 08; 302 is preferably provided, wherein at least one of the cylinders 06; 07; 312 and one ink forme roller 28; 306; 307 of the inking unit 08; 302 are engaged against one another (FIG. 31). A dampening unit 09; 303 may also be provided, wherein at least one of the cylinders 06; 07; 312 and one dampening forme roller 41; 304 of the dampening unit 09; 303 are engaged against one another. In this, the at least one ink forme roller 28; 306; 307 of the inking unit 08; 302 and/or the at least one dampening forme roller 41; 304 of the dampening unit 09; 303 can each be actuated with its own drive 128, independently of the cylinder 06; 07; 312. Preferably, the ink forme roller 28; 306; 307 of the inking unit 08; 302 and/or the dampening forme roller 41; 304 of the dampening unit 09; 303 are each actuated separately with their own drive 128.

The at least one ink forme roller 28; 306; 307 of the inking unit 08; 302 and/or the at least one dampening forme roller 41; 304 of the dampening unit 09; 303 are preferably mounted with each of their two ends in a radially displaceable support bearing 321, as was described in the preceding in connection with FIG. 43 or 44. Preferably, all ink forme rollers 28; 306; 307 of the inking unit 08; 302 and/or dampening forme rollers 41; 304 of the dampening unit 09; 303 that can be engaged against one of the cylinders 06; 07; 312 are mounted at each end in a support bearing 312 and are therefore radially displaceable. The support bearings 321 of displaceable rollers 304; 306; 307; 308; 309; 311 of the inking unit 08; 302 and/or the dampening unit 09; 303 preferably have pneumatic actuators 322, whereas the actuators 82; 84 of the respective bearing unit 14 of the cylinders 06; 07; 312 to be displaced are preferably configured as hydraulic actuators 82; 84.

To control or regulate the actuators 322 of the support bearings 321 of displaceable rollers 304; 306; 307; 308; 309; 311 of the inking unit 08; 302 and/or the dampening unit 09; 303, either the same control device as is used to control or regulate the actuators 82; 84 of the bearing units 14 of the cylinders 06; 07; 312 is used, or the control or regulation of the actuators 322 of the support bearings 321 of adjustable rollers 304; 306; 307; 308; 309; 311 of the inking unit 08; 302 and/or the dampening unit 09; 303 is accomplished using a control device that is separate from the control or regulation of the actuators 82; 84 of the bearing units 14 of the cylinders 06; 07; 312.

In a preferred embodiment, at least one sensor is provided for detecting a surface pressure between a cylinder 06; 07; 312 that is to be displaced using actuators 82; 84 in the respective bearing unit 14 and the cylinder 06; 07; 312 that coordinates with the former. In this manner the control device monitors the actuators 82; 84 of the at least one cylinder 06; 07; 312 to be displaced, in order to adjust a surface pressure between said cylinder 06; 07; 312 and the cylinder 06; 07; 312 that coordinates with the former, said pressure remaining constant during operation of the printing group 04, by determining an actual value for this surface pressure, and, if the determined actual value should deviate from a target value that is stored in the control device, repositioning the actuators 82; 84 in their respective adjustment. The surface pressure is necessary in printing units 01 that operate in an offset printing process for the transfer of printing ink. With the surface pressure, a flexible surface of the cylinder 06; 07; 312 is pressed in, wherein the flexible surface can be provided by a rubber coating, a printing blanket or a sleeve. An unstable operational state with an inhomogeneous color transfer, especially between the cylinders 06; 07; 312, occurs, for example, in the case of variable tolerances in the thickness of the rubber coating, the printing blanket or the sleeve, in the case of flat spots in these, in the case of a difference in their manufacture, e.g. differences in their viscous properties, or as they age with potential hardening or absorption of water. Installation and/or alignment errors in the size of the gap between the cylinders 06; 07; 312 can also contribute to this.

To ensure a stable surface pressure and therefore a homogeneous color transfer, it is provided, for example, that the control device adjusts the actuators 82; 84 of the at least one cylinder 06; 07; 312 to be displaced, or the respective actuators 82; 84 of the two cooperating cylinders 06; 07; 312 to be displaced, in each case at least depending upon the diameter and/or upon a surface speed or a speed of the cylinder 06; 07; 312 to be displaced, or the cylinder 06; 07; 312 that coordinates with this. It can also be provided that the control device adjusts the actuators 82; 84 of the at least one cylinder 06; 07; 312 to be displaced or the respective actuators 82; 84 of the two cooperating cylinders 06; 07; 312 to be displaced, in each case based at least upon an inclined position of the cylinder 06; 07; 312 to be displaced in relation to the cylinder 06; 07; 312 that coordinates with the former. Or the control device adjusts the actuators 82; 84 of the at least one cylinder 06; 07; 312 to be displaced or the respective actuators 82; 84 of the two cooperating cylinders 06; 07; 312 to be displaced, in each case based at least upon a respective surface property of the cooperating cylinder 06; 07; 312. It can also be provided that the control device adjusts the actuators 82; 84 of the at least one cylinder 06; 07; 312 to be displaced or the respective actuators 82; 84 of the two cooperating cylinders 06; 07; 312 to be displaced, in each case based at least upon a property of a printing substrate 02 printed in the printing group 04, wherein the property of the printed substrate 02 relates, for example, to its thickness and/or width and/or guidance along the cylinder 06; 07; 312. In one advantageous embodiment, the control device adjusts the actuators 82; 84 of the at least one cylinder 06; 07; 312 to be displaced or the respective actuators 82; 84 of the two cooperating cylinders 06; 07; 312 to be displaced, in each case based upon a plurality of the aforementioned parameters. The listed variables can each be stored as a functional interrelationship, for example in the form of a table or as a curve or set of curves, in a memory device. With the ability to alter the positioning of the cylinders 06; 07; 12 in the printing process by means of the respective actuators 82; 84, the surface pressure can be adjusted fully automatically with respect to its target value.

Figure 6:
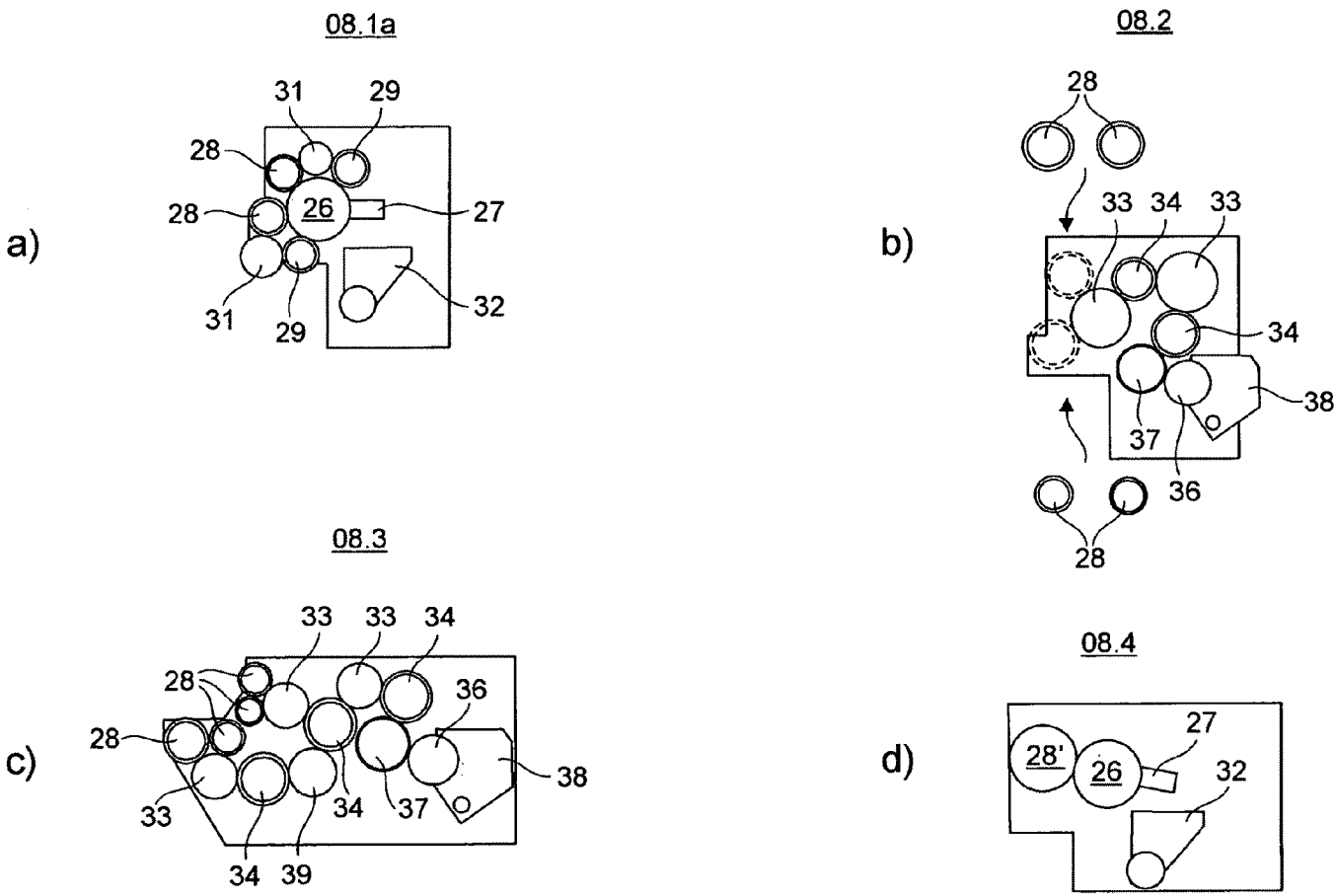
FIG. 6 various examples of modular inking units.
Figure 51:
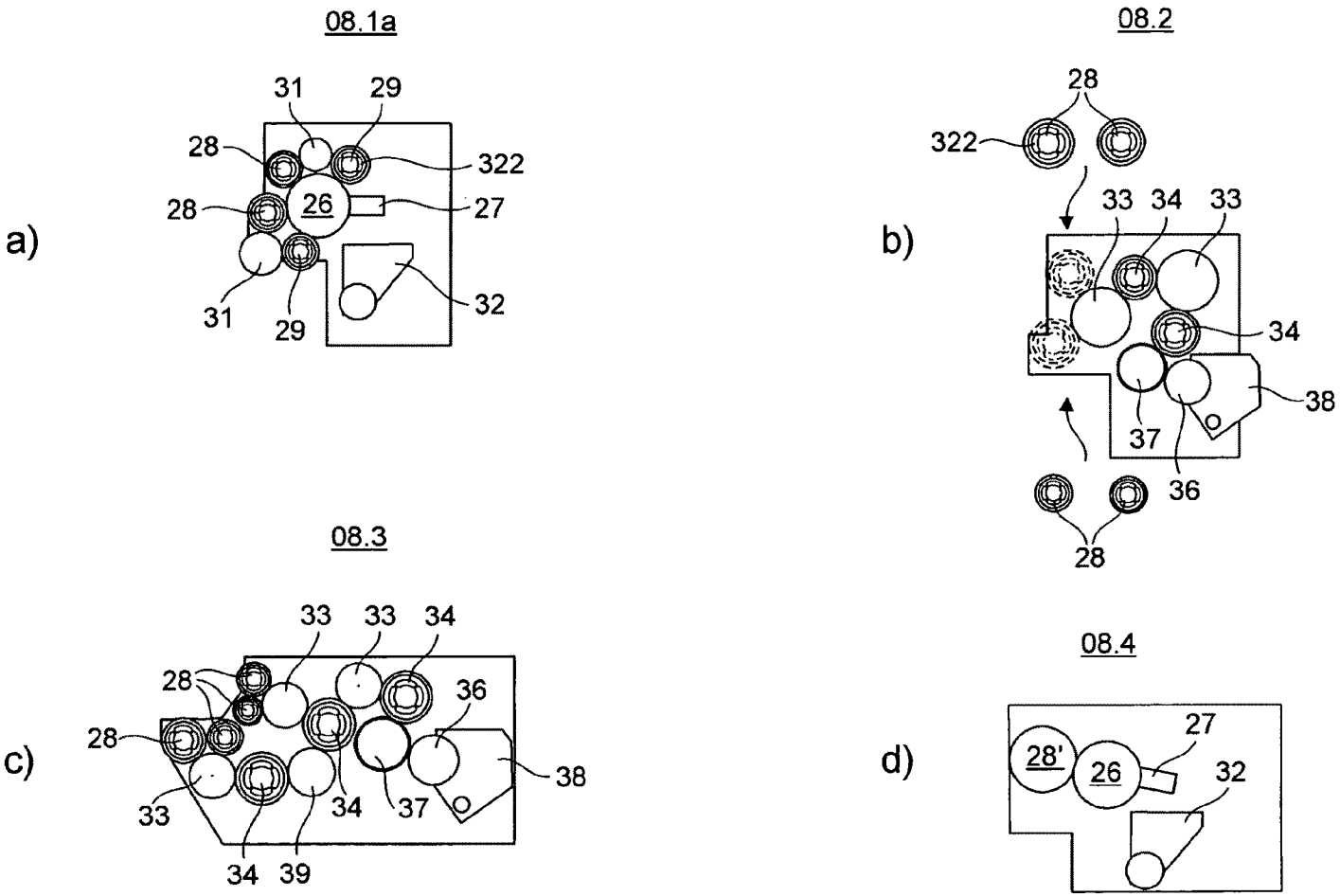
FIG. 51 various examples of modular inking units of FIG. 6, each with rollers that can be adjusted using actuators according to FIG. 43 or 44.
Figure 52:
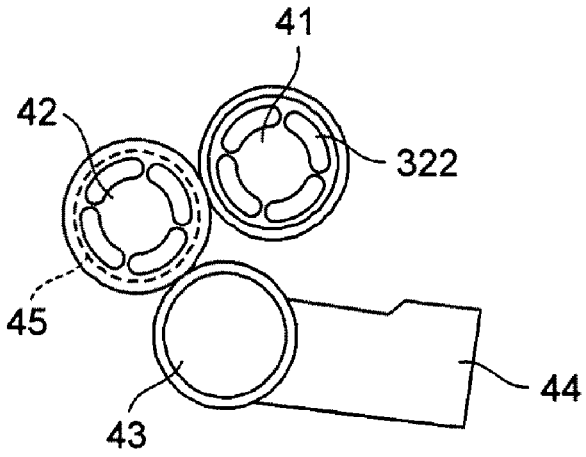
FIG. 52 various examples of modular dampening units of FIG. 11, each with rollers that can be adjusted using actuators according to FIG. 43 or 44.
Figure 52:
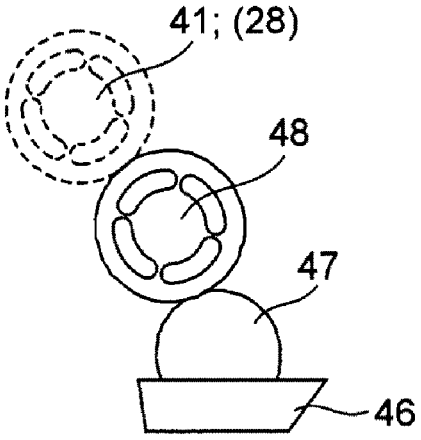

FIG. 51 shows the various examples of modular inking units 08; 302 represented in FIG. 6, each showing actuators 322 for their displaceable rollers 306; 307; 309; 311. FIG. 52 shows the various examples of modular dampening units 09; 303 shown in FIG. 11, each showing actuators 322 for their displaceable rollers 304; 308 indicated.

Figure 53:
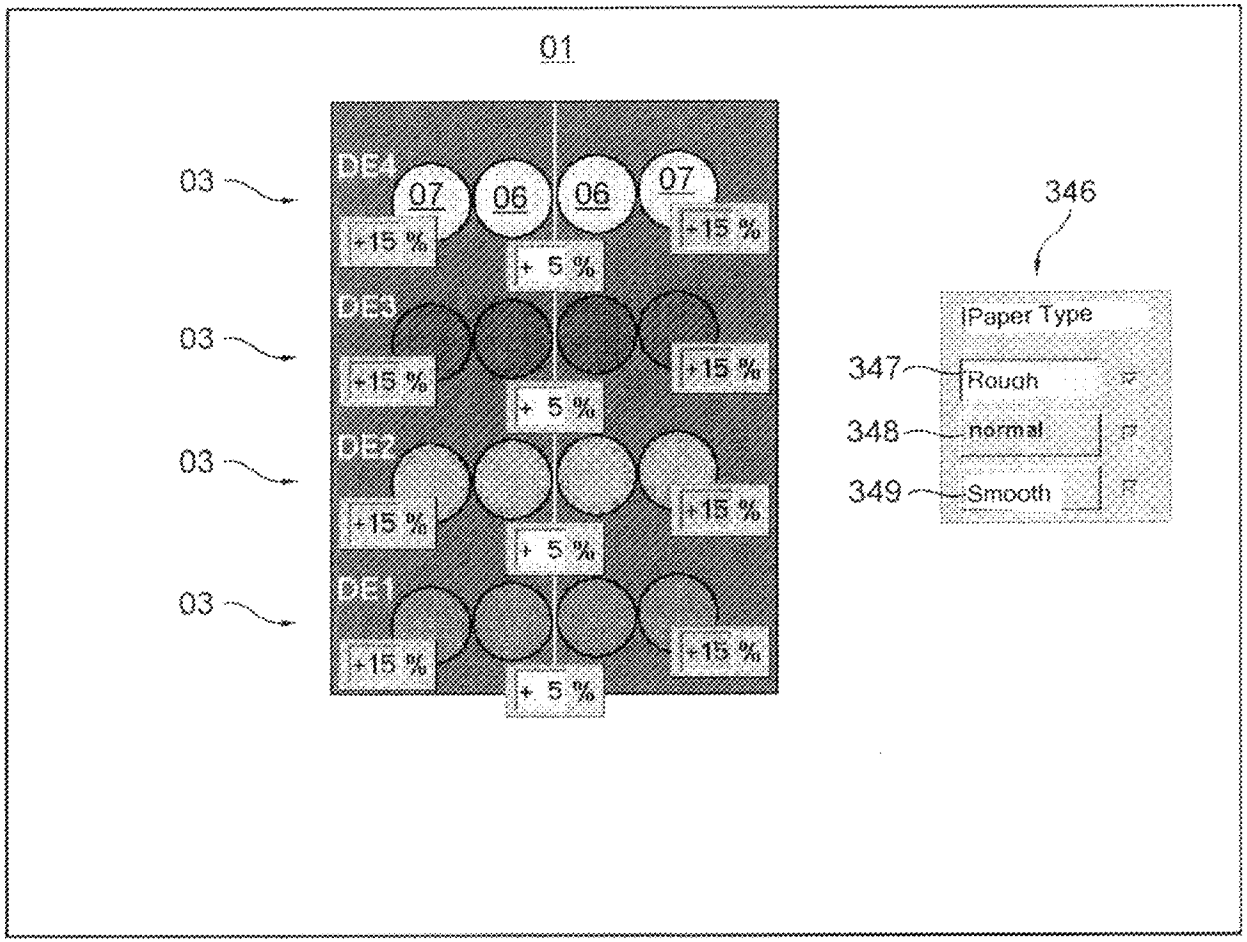
FIG. 53 a first program mask for a display unit of the control unit.
Figure 54:
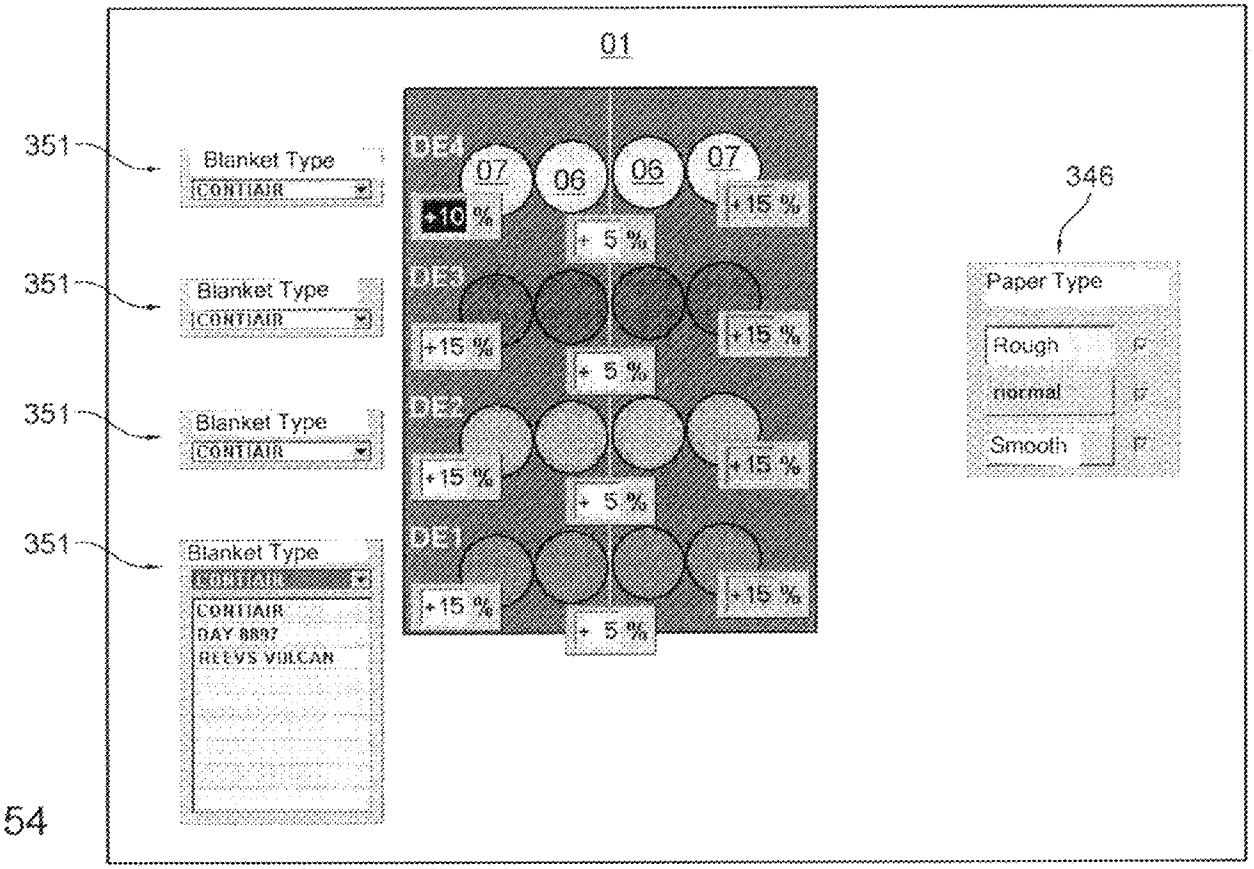
FIG. 54 a second program mask for the display unit of the control unit.

FIGS. 53 and 54 each show, by way of example, at least one section of a program mask that is or at least can be displayed, for example, on the display device of the control unit that is part of the control center 229 or the control center computer 229, wherein each of these program masks, in connection with at least one control element, such as a keyboard or a pointer instrument that is a part of the control unit, serves the purpose of adjusting the contact force exerted by a cylinder 06; 07; 312 in a roller strip on an adjacent rotational body, individually as needed, and of changing an existing setting, preferably remotely, for example even when the printing group is in a production run. Each of the two program masks schematically illustrates a printing unit 01 configured as a four-high tower, wherein four blanket-to-blanket printing groups 03 for generating a 4/4 print are shown vertically, one above another, wherein the respective transfer cylinders 06 of the blanket-to-blanket printing groups 03 are engaged against one another. A forme cylinder 07 is engaged against each of the transfer cylinders 06 of the blanket-to-blanket printing groups 03. For details regarding the configuration of these blanket-to-blanket printing groups 03, reference is made to FIGS. 1, 2, 7 through 10 and 12 through 15, in each case with the associated description.

To adjust the contact force exerted between the transfer cylinders 06 of the blanket-to-blanket printing groups 03, a plurality of adjustment levels, for example three, which differ in terms of amount and are preferably stored in the control unit, are provided, wherein each of these adjustment levels can be selected based, for example, upon a surface property of the printing substrate 02 printed in the printing unit 01, especially the material web 02, wherein the surface property relates, for example, to the roughness and/or the smoothness and/or the evenness of the surface and/or its capacity to accept printing ink and or the absorptive property of the printing substrate 02 and/or the number of lines if the surface of the substrate is lined. For example, to generate a good print quality on rough newsprint, a contact force is required that is three to four times higher than is required for a very smooth supercalendared paper.

The adjustment level that is based upon the surface property of the printed substrate 02 can be conveniently selected, for example, using selection buttons 347; 348; 349 that are or at least can be displayed in the program mask. In each of the program masks shown in FIGS. 53 and 54, a field 346 entitled "Paper Type" is indicated or at least inserted, wherein in this field 346 a plurality of selection buttons 347; 348; 349, for example three, are provided for selecting the adjustment level for a paper having a rough or a normal or a smooth surface. A specific value for the contact force exerted between the transfer cylinders 06 of the blanket-to-blanket printing groups 03, preferably established by the manufacturer of the printing press and not specified in greater detail in the program masks, is assigned to each of these selectable levels of adjustment, wherein the respective contact force that is assigned to one of the adjustment levels are adjusted by means of the actuators 82 arranged in the respective bearing unit 14 of the transfer cylinder 06, once the user of the printing press has made his decision with respect to the selectable adjustment level.

It can further be provided that the contact force exerted between the transfer cylinders 06 of the blanket-to-blanket printing groups 03 can be changed based upon at least one of the selectable adjustment levels via a fine adjustment, wherein said fine adjustment is preferably provided at all selectable adjustment levels. In the example shown in the program masks in FIGS. 53 and 54, the fine adjustment consists in a percentage addition based upon the selectable adjustment level, to increase the respective contact force, wherein the addition can be made, for example, in steps of one percent up to an established upper limit, for example up to 100%, i.e. up to a doubling of the value that corresponds to the respective selected level of adjustment of the contact force. The addition that is based upon the respectively selected level of adjustment is displayed or at least input into the program masks, for example within the schematically represented printing unit 01, for example with a numerically displayed percentage allocated to the respective transfer cylinders 06 of the blanket-to-blanket printing groups 03. In the example shown in FIGS. 53 and 54 the established addition for each of the blanket-to-blanket printing groups 03 is +5%. Of course, values that deviate from this and values that differ for the blanket-to-blanket printing groups 03 may also be established.

It can further be provided that, in addition or as an alternative to the adjustment of the contact force exerted between the transfer cylinders 06 of the blanket-to-blanket printing groups 03, the contact force exerted between one of the transfer cylinders 06 and one of the forme cylinders 07 can also be changed. The adjustment of the contact force exerted between one of the transfer cylinders 06 and one of the forme cylinders 07 is based, for example, on the elasticity and/or the compressibility of the printing blankets mounted on the transfer cylinders 06. FIG. 54 shows that in addition to the adjustability of the contact force exerted between the transfer cylinders 06 of the blanket-to-blanket printing groups 03, for example, a selection menu 351 is provided, preferably allocated to each blanket-to-blanket printing group 03, wherein each selection menu 351 has, for example, a list containing a plurality of names or identifiers for printing blankets having different technical properties, wherein the printing blanket that is mounted on a respective transfer cylinder 06 at a given time can be selected. Based upon the selected printing blanket, a certain value for the contact force between the respective transfer cylinder 06 and the associated forme cylinder 07, specified for the respective printing blanket, is adjusted, with each of these adjustments in turn specifying a certain adjustment level for the contact force.

Based upon this level of adjustment between all transfer cylinders 06 and the respective associated forme cylinder 07, which level can be selected based upon the printing blanket, the contact force that is actually to be exerted can preferably in turn be adjusted via a fine adjustment, wherein said change can be implemented, for example, in the form of an addition, for example in steps of one percent up to 100% each, i.e. up to a doubling of the value that corresponds to the respectively selected level of adjustment of the contact force. The addition based upon the respectively selected adjustment level is displayed on, or at least input into, the program mask shown in FIG. 54, for example within the schematically illustrated printing unit 01, for example in the form of a numerically displayed percentage, e.g. allocated to one of the forme cylinders 07 of the blanket-to-blanket printing groups 03. In the example shown in FIG. 54, the established addition for three of the four blanket-to-blanket printing groups 03 is 15% each, and for the uppermost blanket-to-blanket printing group 03 is, for example, +10%. Of course, values that differ from these and different values for the blanket-to-blanket printing groups can also be set.

The respective contact force that is allocated to one of the adjustment levels, along with its fine adjustment, whether this is the adjustment of the contact force based upon the surface property of the printed substrate 02 and/or the adjustment of the contact force based upon properties of the printing blanket that is used, are each implemented by means of the actuators 82 that are arranged in the respective bearing unit 14 of the transfer cylinder 06 and/or the forme cylinder 07.

To adjust a contact force exerted by a roller, e.g. an ink forme roller 28, 306; 307 of the inking unit 08; 302 and/or a dampening forme roller 41; 304 of the dampening unit 09; 303, on one of the cylinders 06; 07; 312 and/or to adjust a contact force exerted between two adjacent rollers 304; 306; 307; 308; 0.309; 311; 313; 314; 316; 317 (see FIG. 43 or FIG. 44), at least one additional program mask can be provided, which is comparable to the program masks described in the preceding in connection with FIGS. 53 and 54, which are, or at least can be, displayed on the display device of the control unit that is a part of the control center 229 or the control center computer 229, each being used to adjust a level of contact force between cylinders 06; 07; 312, and/or at least has a similar functionality to said program masks. The program masks, each of which is used to adjust the contact force of cylinders 06; 07; 312 and/or rollers 304; 306; 307; 308; 309; 311; 313; 314; 316; 317, can each be displayed, or at least displayable, on the same display device of the control unit that is a part of the control center 229 or the control center computer 229, so that the adjustment of the contact force of cylinders 06; 07; 312 and/or rollers 304; 306; 307; 308; 309; 311; 313; 314; 316; 317 can be implemented using the same display device that is a part of the control center 229 or the control center computer 229.

Figure 55:
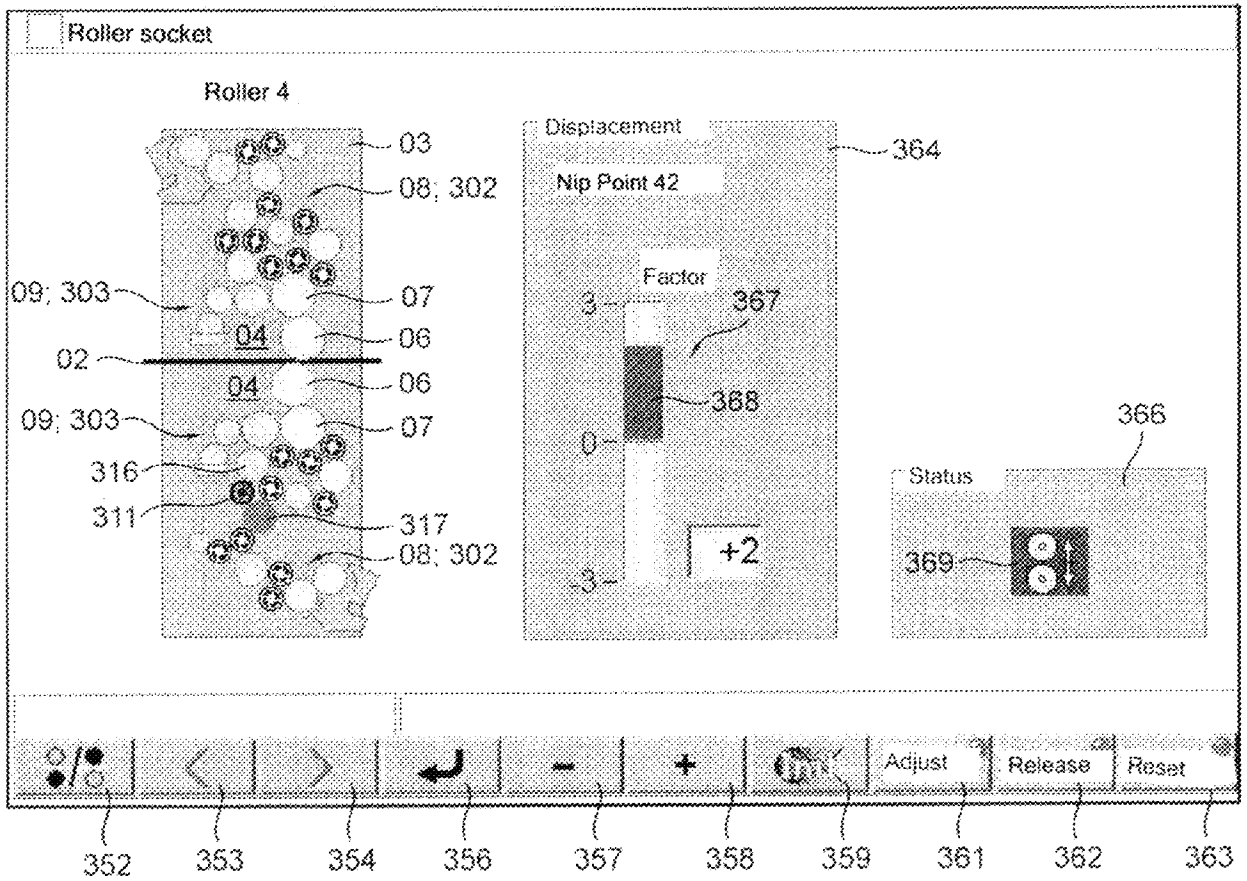
FIG. 55 a third program mask for the display unit of the control unit; and in FIG. 56 a fourth program mask for the display unit of the control unit
Figure 56:
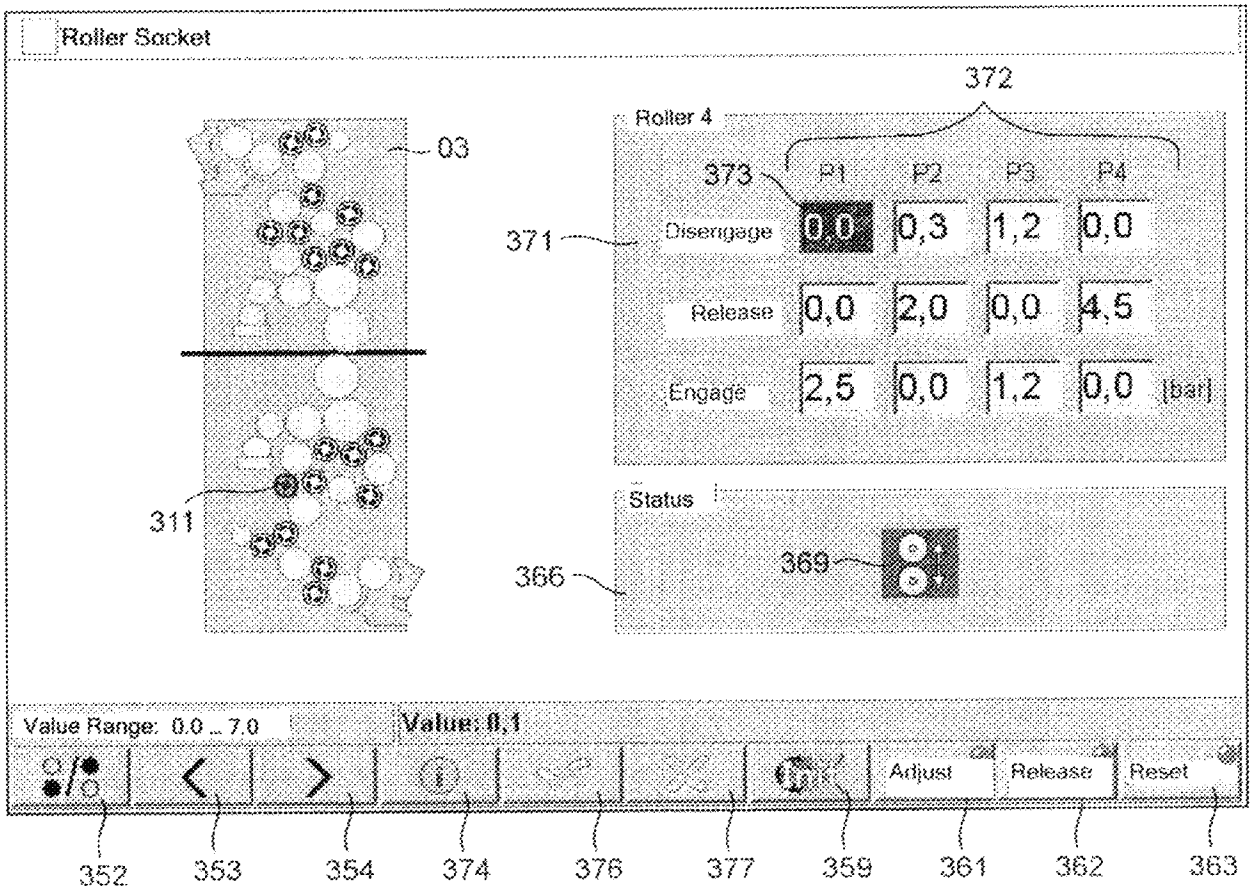

FIGS. 55 and 56 each show an example of a program mask used to adjust rollers 304; 306; 307; 308; 309; 311 that are controllable in terms of their contact force (see FIGS. 1, 43 and 44), wherein each of the program masks contains a schematic representation of a blanket-to-blanket printing group 03, in each case with a forme cylinder 07 having a roller train of an inking unit 08; 302 and with the roller train of a dampening unit 09; 302, wherein in this example the material web 02 to be printed is guided through the blanket-to-blanket printing group 03 horizontally between two transfer cylinders 06 that are engaged against one another.

With a control element, for example with a first selection button 352 that can be actuated on the program mask using a pointer instrument, a selection can be made regarding in which of the two printing groups 04 of the blanket-to-blanket printing group 03, for example, rollers 304; 306; 307; 308; 309; 311 of the inking unit 08; 302 are to be adjusted. Additional selection buttons 353; 354, which preferably are also arranged on the program mask, can be provided, in order to select a certain roller 304; 306; 307; 308; 309; 311 from the roller train of the inking unit 08; 302. The selection buttons 353; 354 can be configured such that with each actuation, beginning with a currently selected roller 304; 306; 307; 308; 309; 311, the subsequent or the preceding roller 304; 306; 307; 308; 309; 311 in the roller train is selected. Each of the rollers 304; 306; 307; 308; 309; 311 is therefore preferably assigned a number, and can be selected in steps using the selection buttons 353; 354, e.g. in ascending or descending order. In the example shown in FIG. 55, the roller 311 in the inking unit 08; 302 that is identified in the roller train of the inking unit 08; 302 by the number 4 has been selected, as is displayed in the program mask, for example above the blanket-to-blanket printing group 03 shown. The selection, made using the selection buttons 353; 354, of the roller 311 identified by the number 4 must be confirmed using a different selection button 356, in order to cause the control unit to execute a correction command that correlates to the selection.

In the example shown in FIG. 55, an adjustment is to be made at the nip point N61 between the roller 316 and the roller 317 (see FIG. 43). Based upon the corresponding selection, the mode in which the relevant rollers 316; 317 are displayed on the program mask can be altered, for example, via a color change, in order to visually emphasize these rollers 316; 317. On the program mask, additional selection buttons 361; 362; 363 may be provided to allow selection of a function to be executed by the control unit with regard to the selected nip point N61. These functions can relate to a new basic setting adjustment for the contact force between the selected rollers 316; 317 (selection button 361), a release of one of the selected rollers 316; 317 (selection button 362) or a restoration of the contact force between the selected rollers 316; 317 based upon a preset level (selection button 363), with the latter taking place especially when the printing group 04 is in a production run.

Depending upon the selected function, i.e. depending upon an actuation of the selection buttons 361, 362 or 363, at least one additional window 364; 366 can also be displayed or activated on the program mask, wherein a window 364 displays, for example, an implemented displacement with respect to the selected machine-related nip point N61, which is displayed on the program mask as nip point 42. In the example shown, the window 364 contains a scale 367 having the selected boundary values −3 and +3 as examples, wherein, for example, beginning with a base level identified as zero, for example using selection buttons 357; 358 also displayed on the program mask, a gradual change in the setting of the basic level is possible, wherein with one of the selection buttons 357, for example, a decrease in the setting and with the other selection button 358 an increase in the setting can be implemented. The increments in which a change in the setting can be made are established as needed, for example, in the control unit to correspond to the structural conditions of the existing printing press. In the example shown in FIG. 55, the setting of the basic level has been adjusted by a factor of +2, in other words the setting of the contact force exerted between the selected rollers 316; 317 has been increased, for example, by 200%. The factor by which the change is to be implemented can be displayed, for example, in the window 364 as a numeric value and/or on the scale 367 as a bar 368.

If the release function has been selected for two selected rollers 316; 317 using the selection button 362, the current status of these respective rollers 316; 317 can be displayed in a window 366 in the program mask, for example in the form of a pictogram 369, i.e. it is displayed whether these selected rollers 316; 317 have already been disengaged from one another or are still engaged against one another.

All inputs into the control unit, e.g. to select a roller 304; 306; 307; 308; 309; 311 or for a change in the setting to be implemented preferably require confirmation by actuating a selection button 356 provided for this purpose. Furthermore, another selection button 359 can be provided, which can be used, after a setting has been adjusted, to set at least one standard value provided, for example, by the manufacturer of the printing press. Accordingly, using the selection button 359 an original value can be easily reset. Accordingly a previous change can be reversed.

The program mask shown in FIG. 56 relates to a blanket-to-blanket printing group 30 having the same construction as is shown in FIG. 55. Thus for the blanket-to-blanket printing group 03 shown in FIG. 56, and for selection buttons having the same purpose, the same reference symbols are used as in FIG. 55. Preferably, the program mask shown in FIG. 56 is entirely or at least partially opened only with proof of authorization. For example, this program mask can be password protected. This program mask contains, for example in a window 371, a table 372 consisting of rows and columns, wherein in the individual fields 373 of the table 372, discrete pressure values, for example air pressure values measured in bar as the measuring unit, can be input. A field 373 that is currently activated for an input can, for example, have a colored background, in order to distinguish it from the remaining fields 373 of the table 372. The number of columns in the table 372 may correspond, for example, to the number of actuators 322 arranged in a roller socket 321.

In the example shown, a roller socket 321 from the roller 311 identified as roller 4 is selected and has four actuators 322, wherein in each case two of the actuators 322 arranged in the roller socket 321 are arranged diametrically opposite (see FIG. 43 through 48). In the window 371 the two columns having the headers P1 and P2 and the two columns having the headers P3 and P4, respectively, correlate with two actuators 322 arranged opposite one another. In the table 372, one of the two actuators that are arranged opposite one another is switched to the pressureless state, so that the entry zero is input at that point in the table 372. The value of the pressure in the respective other of the two actuators 322 arranged opposite one another can be adjusted within a range of values, for example between zero and seven bar. The pressure to be established is selected based upon the function the roller 311 is then to execute, in other words based upon whether the roller 311 is to be switched off, released or engaged (see characterization of the rows in table 372). The values that can be entered in the table 372 can be entered, for example, with a degree of precision up to one decimal place. The available range of values for adjusting the contact force of a roller 311 and the adjustable precision of the values can be displayed in the program mask in fields intended specifically for this purpose.

The program mask shown in FIG. 56 also contains, for example, the window 366, in which the current status of a selected roller pair 316; 317 is displayed, for example in the form of a pictogram 369, i.e. it is displayed whether these selected rollers 316; 317 have already been disengaged from one another or are still engaged against one another.

Furthermore, the program mask shown in FIG. 56 can contain selection buttons 374, 376 and 377, with which a setting recommended, for example, by the manufacturer of the printing press, or a previous setting, can be queried, selection button 374, the input of a value for the pressure to be exerted via an actuator 322 can be confirmed, selection button 376 or can be deleted, selection button 377.

While preferred embodiments of printing groups comprising at least two cooperating cylinders and radially movable bearing units, in accordance with the present invention, have been described fully and completely hereinabove, it will be apparent to one of skill in the art that various changes could be made, without departing from the true spirit and scope of the present invention, which is accordingly to be limited only by the appended claims.

What is claimed is:

1. A printing couple comprising:

at least first and second cooperating cylinders, wherein at least the first one of the cylinders is configured as a transfer cylinder, and at least the second one of the cylinders is configured as a forme cylinder, each of said at least first and second cylinders having an axis of rotation and spaced support journals, the axis of rotation of the at least first and second cooperating cylinders forming a line of connection;

a printing couple frame including spaced frame walls with each frame wall having an interior side;

a plurality of bearing units each supporting a respective one of the support journals and that each is capable of displacing its respective one of the first and second cylinders radially, each of the bearing units being attached to the interior side of one of the spaced frame walls and facing a respective one of the at least first and second cooperating cylinders, each bearing unit having a linear bearing including linear elements, each linear bearing rotatably supporting a journal of one of the at least first and second cooperating cylinders, the linear elements supporting and guiding each respective linear bearing forming an angle of no greater than 15° with the line of connection;

at least one hydraulic bearing unit actuator for each bearing unit of the respective ones of the at least first and second cylinders, the at least one hydraulic bearing unit actuator for each respective bearing unit being adapted to displace its respective linear bearing along the associated linear elements in a direction of adjustment that is oriented toward a print substrate being printed by the printing couple;

at least one of an inking unit with at least one ink forme roller, and wherein the forme cylinder and the at least one ink forme roller of the inking unit engageable against one another, and a dampening unit having at least one dampening roller, and wherein the forme cylinder and the at least one dampening roller of the dampening unit engageable against one another, the at least one of the at least one ink forme roller and the at least one dampening roller having spaced roller ends;

a support bearing supporting the ends of the at least one ink forme roller of the inking unit and the at least one dampening roller of the dampening unit, each such support bearing being capable of displacing its one of the respective ink forme roller and the respective dampening roller radially;

at least one pneumatic support bearing actuator for each of the support bearings of the at least one of the at least one ink forme roller and the at least one dampening roller; and a control unit which is usable to at least one of control and regulation of the at least one hydraulic bearing unit actuator of each bearing unit of the cylinder, and the at least one pneumatic support bearing actuator of each support bearing unit, wherein the respective at least one pneumatic support bearing actuator of each support bearing and the at least one hydraulic bearing unit actuator of each bearing unit is each remotely actuable, and wherein the same control unit at least one of controls and regulates the respective at least one pneumatic support bearing actuator of the support bearing and the respective at least one hydraulic bearing unit actuator of the bearing units.

2. A printing couple comprising:

at least first and second cooperating cylinders, wherein at least the first one of the cylinders is configured as a transfer cylinder and at least the second one of the cylinders is configured as a forme cylinder;

a separate bearing unit mounting each of spaced ends of each of the cylinders and wherein each such bearing unit is capable of displacing its respective cylinder radially;

a plurality of bearing unit actuators in each bearing unit, each bearing unit actuator haying a characteristic identifier a assigned to each such bearing unit actuator;

a control unit adapted to at least one of control and regulate each of the plurality of bearing unit actuators of each bearing unit mounting each cylinder;

a controllable device for each bearing unit that has the plurality of bearing unit actuators, wherein each controllable device is selected by the control unit using the characteristic identifier q, assigned to each such bearing actuator and wherein the control unit at least one of controls and regulates each bearing unit actuator of one of the at least first and second cooperating cylinders, separately and independently from the at least one bearing unit actuator of another bearing unit of another one of the at least first and second cooperating cylinders using the characteristic identifier q for the bearing unit actuator.

3. The printing couple of claim 1, characterized in that the at least one hydraulic bearing unit actuator of the respective bearing unit of the at least first and second cooperating cylinders has a characteristic identifier q, and further wherein a controllable device that is allocated to one of the bearing units can be selected by the control unit using the characteristic identifier q.

4. The printing couple according to claim 2, characterized in that at least one of an inking unit with at least one ink forme roller, and a dampening unit with at least one dampening roller is provided, wherein at least one of the at least first and second cooperating cylinders and at least one of the dampening roller of the dampening unit and the ink forme roller of the inking unit can be engaged against one another.

5. The printing couple according to claim 4, characterized in that the at least one of the ink forme roller of the inking unit and the at least one dampening roller of the dampening unit are mounted at each of their ends in a support bearing that is capable of displacing the at least one of the ink forme roller and the dampening roller radially.

6. The printing couple according to claim 5, characterized in that the support bearing of the at least one of the ink forme roller and the dampening roller has at least one bearing unit actuator.

7. The printing couple according to claim 6, characterized in that the control unit that at least one of controls and regulates the plurality of actuators of the bearing unit of each cylinder also at least one of controls and regulates the at least one actuator of the support bearing of the at least one of the ink forme roller or the dampening roller.

8. The printing couple according to claim 4, characterized in that the at least one ink forme roller of the inking unit has the circumference of the cylinder against which the at least one ink forme roller can be engaged.

9. The printing couple according to 6, characterized in that the control unit selectively at least one of controls and regulates the plurality of actuators for displacing one of the at least first and second cooperating cylinders and the at least one actuator for displacing the at least one ink forme roller and the at least one dampening roller.

10. The printing couple according to claim 1, characterized in that the control unit at least one of controls and regulates the at least one hydraulic bearing unit actuator of the bearing unit of one of the at least first and second cylinders, separately and independently of at least another hydraulic bearing unit actuator of another bearing unit of the at least first and second cylinders.

11. The printing couple according to claim 1, characterized in that the at least one of the inking unit and the dampening unit has a plurality of rollers, each of which is mounted at its ends in a support bearing.

12. The printing couple according to claim 6, characterized in that the control unit at least one of controls and regulates the at least one actuator of one of the support bearings of the at least one of the at least one ink forme roller and the at least one dampening roller, separately and independently of at least one other pneumatic support bearing actuator of the respective other support bearing of the other one of the in forme roller and the dampening roller.

13. The printing couple according to claim 12, characterized in that the control unit at least one of controls and regulates the at least one pneumatic support bearing actuator of one of the support bearings of the at least one of the at least one ink forme roller and the at least one dampening roller, separately and independently of the at least one other pneumatic support bearing actuator of another support bearing of at least another one of the other rollers in at least one of said inking unit and dampening unit.

14. The printing couple according to claim 6, characterized in that the plurality of actuators of the bearing unit of at least one of the first and second cylinders and the at least one actuator of the support bearing of the at least one ink forme roller and of the at least one dampening roller is a component of a fastening device that fixes the respective cylinder at least one of the first and second cylinders the respective ink forme roller and the respective dampening roller in its respectively adjusted position.

15. The printing couple according to claim 1, characterized in that each bearing unit of the at least first and second cooperating cylinders has associated with it controllable device capable of being selected by the control unit.

16. The printing couple according to claim 15, characterized in that each of the controllable devices pressurizes a plurality of the hydraulic bearing unit actuators of the same bearing unit synchronously with a first pressure level in a first operating position and with a second pressure level in a second operating position.

17. The printing couple according to claim 16, characterized in that in both of the first and second operating positions, the pressure level that is present at the hydraulic bearing unit actuators is different from zero for at least one of the hydraulic bearing unit actuators in the same bearing unit.

18. The printing couple according to claim 1, characterized in that, the at least first and second cooperating cylinders are each rotated independently of one another by a drive.

19. The printing couple according to claim 1, characterized in that at least one further one of least first and second cooperating cylinders is constructed in the form of a counter-impression cylinder, cooperating with a transfer cylinder.

20. The printing couple according to claim 1, characterized in that the transfer cylinder is configured to be double sized.

21. The printing couple according to claim 20, characterized in that the double-sized transfer cylinder has one of two and three printing blankets arranged side by side in an axial direction of the double-sized transfer cylinder.

22. The printing couple according to claim 1, characterized in that the forme cylinder is loaded with one of four and six printing formes side by side in its axial direction.

23. The printing couple according to claim 4, characterized in that at least one of the at least one ink forme roller of the inking unit and the at least one dampening roller of the dampening unit are each rotatably driven independently of the cylinder by means of a drive.

24. The printing couple according to claim 4, characterized in that the at least one of the at least one ink forme roller of the inking unit and the at least one dampening roller of the dampening unit are each rotatable driven separately by means of a drive.

25. The printing couple according to claim 4, characterized in that at least one of the at least first and second cooperating cylinders and at least one of the rollers of the at least one of the inking unit and the dampening unit has a flexible surface.

26. The printing couple according to claim 1, characterized in that the control unit monitors the at least one hydraulic bearing unit actuator of the at least one of the at least first and second cooperating cylinders to be displaced, to set a surface pressure between that at least one cylinder to be displaced and the cylinder that cooperates with it, the surface pressure remaining constant during operation of the printing couple, by determining an actual value for this surface pressure, and in the event of a deviation of the determined actual value from a target value stored in the control unit, by returning the at least one hydraulic bearing unit actuator to its setting.

27. The printing couple according to claim 1, characterized in that the control unit adjusts the at least one of one hydraulic bearing unit actuator of the at least one cylinder of the at least first and second cooperating cylinders to be displaced and at least another hydraulic bearing unit actuator of another of the at least first and second cooperating cylinders to be displaced, at least based upon one of a diameter and a surface speed and a rotational speed of the one of the cylinders to be displaced and of the cylinder that cooperates with that cylinder to be displaced.

28. The printing couple according to claim 1, characterized in that the control unit adjusts the at least one of one hydraulic bearing unit actuator of the at least one cylinder on the at least first and second cooperating cylinders to be displaced and at least another hydraulic bearing unit actuator of another of the at least first and second cooperating cylinders to be displaced, based at least upon an inclined positioning of the cylinder to be displaced relative to the cylinder that cooperates with the cylinder to be displaced.

29. The printing couple according to claim 1, characterized in that, in the control unit, various setting levels for setting at least one of the at least one hydraulic bearing unit actuator of the at least one cylinder of the at least first and second cooperating cylinders to be displaced, and for at least another hydraulic bearing unit actuator of the other of the at least first and second cooperating cylinders to be displaced, are stored, wherein each of these setting levels can be selected at least based upon a respective surface property of the respective one of the at least first and second cooperating cylinders.

30. The printing couple according to claim 1, characterized in that, in the control unit, various setting levels for setting the at least one hydraulic bearing unit actuator of the at least one cylinder of the at least first and second cooperating cylinders to be displaced, and for at least another hydraulic bearing unit actuator of the other of the at least first and second cooperating cylinders to be displaced, are stored, wherein each of these setting levels can be selected in each case based at least upon a property of a printing substrate being imprinted in the printing couple.

31. The printing couple according to claim 30, characterized in that the property of the printed substrate relates to at least one of its thickness and its width and its guidance along the one of the at least first and second cooperating cylinders.

32. The printing couple according to claim 1, characterized in that the control unit for each of hydraulic bearing unit actuators and each of the pneumatic support bearing actuators is arranged in one of a control center and a control center computer that is assigned to the printing couple.

33. The printing couple according to claim 1, characterized in that the printing couple is arranged in one of a blanket-to-blanket printing couple and printing tower.

34. The printing couple according to claim 6, characterized in that the plurality of bearing unit actuators are remotely actuable.

35. The printing couple according to claim 6, characterized in that the support bearings for a plurality of rollers each have the same number of bearing unit actuators.

36. The printing couple according to claim 1, characterized in that the bearing units that are connected to the same cylinder of the at least first and second cooperating cylinder each have the same number of hydraulic bearing unit actuators.

37. The printing couple according to claim 6, characterized in that the support bearings that are connected to the same roller each have the same number of bearing unit actuators.

38. The printing couple according to claim 6, characterized in that each support bearing is positioned in a support bearing housing and has a plurality of bearing unit actuators.

39. The printing couple according to claim 6, characterized in that the control unit adjusts the plurality of bearing unit actuators using controllable valves.

40. The printing couple according to claim 6, characterized in that each support bearing has a controllable fastening device, and wherein, when each said fastening device is in a first operating position, it blocks an essentially radial displacement of the roller and the at least one dampening roller effected by the at least one actuator, and in a second operating position permits said displacement.

41. The printing couple according to claim 40, characterized in that the control unit controls a change in the operating position of the controllable fastening device using at least one valve.

42. The printing couple according to claim 39, characterized in that the valves to be controlled by the control unit are actuated one of electrically and electromagnetically.

43. The printing couple according to claim 4, characterized in that all of the ink forme rollers and all of the dampening rollers that can be engaged against one of the at least first and second cooperating cylinders are mounted in support bearings, each with at least one actuator, and are each radially displaceable.

44. The printing couple according to claim 2, characterized in that the respective bearing unit of each cylinder of the at least first and second cooperating cylinders has a linear bearing which is guided by linear elements.

45. The printing couple according to claim 44, characterized in that in each respective linear bearing, a journal, which is configured on one of the at least first and second cooperating cylinders is rotatably mounted.

46. The printing couple according to claim 44, characterized in that the linear elements of each respective linear bearing form an angle measuring a maximum of 15° with one of a line and a plane of connection that extends through respective rotational centers of the at least first and second cooperating cylinders.

47. The printing couple according to claim 44, further including at least one hydraulic bearing unit for actuator of the bearing unit and which displaces the respective linear bearing along the linear elements in a direction of adjustment oriented toward the printing substrate to be printed by the printing couple.

48. The printing couple according to claim 47, characterized in that a length of the linear bearing, as viewed in the direction of adjustment, is smaller than a diameter of the allocated one of the at least first and second cooperating cylinders.

49. The printing couple according to claim 2, characterized in that each separate bearing unit is attached to an interior side of a frame wall of the printing couple, which interior side is turned to face the respective cylinder.

* * * * *

UNITED STATES PATENT AND TRADEMARK OFFICE

CERTIFICATE OF CORRECTION

PATENT NO. : 8,069,786 B2
APPLICATION NO. : 11/918949
DATED : December 6, 2011
INVENTOR(S) : Ralf Georg Christel et al.

It is certified that error appears in the above-identified patent and that said Letters Patent is hereby corrected as shown below:

CLAIMS 2, 4, 15 & 19 ON PAGE 85

Please correct (page 85) to read as follows:

Column 69, Claim 2, line 14, before "assigned", "a" should be --q--.

Column 70, Claim 14, line 38, after "respective", the word "cylinder" should be deleted.

Column 71, Claim 15, line 44, after "it", insert --a--;

Column 71, Claim 19, line 61, after "of", insert --the at--.

Column 72, Claim 32, line 9, after "of", insert --the--.

Column 73, Claim 47, line 8, after "toward", change "the" to --a--.

Signed and Sealed this
Twenty-eighth Day of February, 2012

David J. Kappos

David J. Kappos
*Director of the United States Patent and Trademark Office*